US007224932B2

(12) United States Patent
Omata

(10) Patent No.: US 7,224,932 B2
(45) Date of Patent: May 29, 2007

(54) IMAGE FORMING APPARATUS INCLUDING A CONVEYANCE UNIT FOR PASSING A RECORDING MEDIUM

(75) Inventor: Yasukuni Omata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 10/874,383

(22) Filed: Jun. 24, 2004

(65) Prior Publication Data

US 2005/0025538 A1 Feb. 3, 2005

(30) Foreign Application Priority Data

Jun. 25, 2003 (JP) ..... 2003-180547
Jun. 27, 2003 (JP) ..... 2003-184877
Jul. 30, 2003 (JP) ..... 2003-203650

(51) Int. Cl.
*G03G 15/00* (2006.01)

(52) U.S. Cl. ..... 399/400

(58) Field of Classification Search ..... 399/68, 399/309, 396, 397, 400
See application file for complete search history.

(56) References Cited

U.S. PATENT DOCUMENTS 5,970,295 A * 10/1999 Samizo ..... 399/309
6,096,468 A * 8/2000 Ohno et al. ..... 430/108.3
6,154,621 A * 11/2000 Yamamoto et al. ..... 399/68
6,574,448 B2 6/2003 Mochimaru et al.
6,584,295 B2 6/2003 Omata et al.
6,608,985 B2 8/2003 Mochimaru et al.
6,633,733 B2 10/2003 Mochimaru et al.
6,643,489 B2 11/2003 Omata et al.
6,728,505 B2 4/2004 Omata et al.
6,741,825 B2 5/2004 Omata et al.
2003/0016970 A1* 1/2003 Omata et al. ..... 399/309 X
2003/0103779 A1* 6/2003 Yokoyama ..... 399/122

FOREIGN PATENT DOCUMENTS

JP 1-209470 8/1989
JP 9-68879 3/1997
JP 10-142869 5/1998
JP 11-24443 1/1999
JP 2003-66738 3/2003
JP 2003-173051 6/2003

(Continued)

OTHER PUBLICATIONS

U.S. Appl. No. 09/915,398, filed Jul. 27, 2001, Mochimaru et al.

(Continued)

*Primary Examiner*—Sandra L. Brase
(74) *Attorney, Agent, or Firm*—Oblon, Spivak, McClelland, Maier & Neustadt, P.C.

(57) ABSTRACT

A one-pass system image forming apparatus for forming an image on both sides of a recording medium is capable of easily suppressing image disturbance caused when an unfixed toner image suffers abrasion when a sheet of transfer paper is conveyed from double-sided transfer means to a fixing device, and image disturbance caused when toner that has become adhered to a guide portion for guiding the transfer paper from the double-sided transfer means to a fixing nip of the fixing device is transferred to a subsequent sheet of transfer paper.

41 Claims, 18 Drawing Sheets

FOREIGN PATENT DOCUMENTS

JP 2003-177611 6/2003

OTHER PUBLICATIONS

U.S. Appl. No. 10/161,742, filed Jun. 5, 2002, Mochimaru et al.
U.S. Appl. No. 10/252,104, filed Sep. 23, 2002, Mochimaru et al.
U.S. Appl. No. 10/321,455, filed Dec. 18, 2002, Omata et al.
U.S. Appl. No. 10/310,892, filed Dec. 6, 2002, Omata et al.
U.S. Appl. No. 10/424,077, filed Apr. 28, 2003, Suzuki et al.
U.S. Appl. No. 10/434,079, filed May 9, 2003, Omata et al.
U.S. Appl. No. 10/645,614, filed Aug. 22, 2003, Sohmiya et al.
U.S. Appl. No. 10/665,479, filed Sep. 22, 2003, Kikuchi.
U.S. Appl. No. 10/874,383, filed Jun. 24, 2004, Omata.
U.S. Appl. No. 11/370,853, filed Mar. 9, 2006, Omata.

* cited by examiner

IMAGE FORMING APPARATUS INCLUDING A CONVEYANCE UNIT FOR PASSING A RECORDING MEDIUM

BACKGROUND OF THE INVENTION

1. Field of the Invention

The present invention relates to an image forming apparatus such as a copier, printer, or facsimile device, and more particularly to an image forming apparatus or the like which forms images on both sides of a recording medium using a so-called one-pass system.

2. Description of the Background Art

The so-called switch back system and one-pass system are known as conventional systems used to form an image on both sides of a recording medium such as paper. In the switch back system, an image is formed on one side of a sheet of paper by passing the paper through transfer means and fixing means, whereupon the paper is reversed and switched back through the transfer means and fixing means such that an image is formed on the other side. However, the switch back system suffers from a large number of problems that need to be solved, including high costs due to the need to provide complicated mechanisms, the length of time required for image formation by means of switch back, jams caused by switching back paper that has curled due to the heat applied by the fixing means, and so on. Thus a method of solving these various problems has been disclosed in Japanese Unexamined Patent Application Publication H1-209470. In this method, toner images are formed on both sides of a sheet of paper, whereupon fixing is performed only once. More specifically, a first image formed on a photosensitive body serving as an image carrier is transcribed onto a transfer belt by first transfer means, then a second image formed on the photosensitive body is transcribed onto one side of the paper by the first transfer means, and then the first image on the transfer belt is transcribed onto the other side of the paper by second transfer means, thus forming images on both sides of the paper.

In this method proposed in the prior art, however, images are formed on both sides of a sheet of paper using a belt-form intermediate transfer body. This results in an additional transfer operation, and moreover, the thickness of the paper greatly affects the image. Hence, a problem arises in that high image quality cannot be achieved. Another problem lies in that a charger is used as the second transfer means, resulting in the generation of ozone which stains the wires.

In the one-pass method, on the other hand, images are formed on both sides of a sheet of paper without switching the paper back by transcribing images onto both sides of the paper using double-sided transfer means, and then passing the paper through fixing means. Since the problems in the switch back method described above can be solved, this method can be considered superior thereto.

However, a problem in this type of one-pass method lies in that the images can easily be disturbed when the paper is conveyed from the double-sided transfer means to the fixing means after images have been transcribed on both sides. This image disturbance arises in the following manner. That is, when the paper is removed from the double-sided transfer means and passed over to the fixing means, one of the unfixed images on the two sides of the paper may scratch against a guiding member or the like disposed between the double-sided transfer means and fixing means, thus disturbing the image.

Hence, an image forming apparatus has been proposed in Japanese Unexamined Patent Application Publication H10-142869 in which a spur which is capable of being driven to rotate and comprises a plurality of protrusions on its periphery is provided between the double-sided transfer means and fixing means such that a sheet of paper is guided by the spur from the double-sided transfer means to the fixing means. In this image forming apparatus proposed in the prior art, the spur is rotated in accordance with the motion of the paper, with the protrusions impinging on the rear surface of the paper, and thus the paper can be guided from the double-sided transfer means to the fixing means without disturbing the image on the rear surface.

However, even when the protrusions on the spur are sharp, if they pierce the paper, the unfixed image will be considerably disturbed. Moreover, it is extremely difficult to clean this type of spur, having a complex form with a plurality of protrusions, every time a sheet of paper passes through, and hence it is highly likely that toner which has become adhered to the protrusions will be transferred onto a subsequent sheet of paper, thus disturbing the image on that sheet of paper.

SUMMARY OF THE INVENTION

It is an object of the present invention to provide an image forming apparatus which is capable of suppressing image disturbance caused when an unfixed toner image on a recording medium is scratched as the recording medium is conveyed from double-sided transfer means to fixing means.

It is another object of the present invention to provide an image forming apparatus which is capable of easily suppressing image disturbance caused when toner, which has become adhered to a guiding member for guiding the recording medium from the double-sided transfer means to a fixing nip of the fixing means, is transferred to a subsequent recording medium.

It is a further object of the present invention to provide an image forming apparatus which is capable of suppressing adverse effects on an image caused when the double-sided transfer means are heated by the fixing means.

It is a further object of the present invention to provide an image forming apparatus which is capable of obtaining a high quality double-sided print without reducing the transfer efficiency.

It is a further object of the present invention to provide an image forming apparatus which is capable of avoiding an increase in the size and a deterioration in the energy efficiency of the fixing means caused when a belt member is heated from the rear surface side.

In an aspect of the present invention, an image forming apparatus comprises an image carrier for carrying a toner image, visible image forming means for forming a toner image on the surface of the image carrier, double-sided transfer means for transcribing the toner image from the image carrier onto both sides of a recording medium, and fixing means for fixing the toner image onto both sides of the recording medium. The fixing means comprise a belt member which performs an endless motion, a plurality of stretching members which stretch the belt member while supporting the belt member from the rear surface side thereof, a front surface heating element which contacts a front surface of the belt member to heat the front surface and form a fixing nip, and rear surface heating means for heating the belt member from the rear surface side thereof. The fixing means implement fixing processing for fixing the toner image onto both sides of the recording medium with the recording medium sandwiched in the fixing nip, and the rear surface heating means being constituted to heat a region of the entire circumferential direction of said belt member, the region extending from the point where the belt member is stretched by the stretching member disposed nearest to the double-sided transfer means, up to the point where the belt member reaches the fixing nip.

In another aspect of the present invention, an image forming method for forming an image on a recording medium comprises an image forming step for forming a toner image on the surface of an image carrier, a double-sided transfer step for transcribing the toner image on the image carrier onto both sides of the recording medium, and a fixing step for fixing said toner image, transcribed onto both sides of the recording medium, on the both sides. The fixing step further comprises a step of stretching and supporting a belt member from the rear surface side thereof using a plurality of stretching members, a step of causing the stretched belt member to perform an endless motion, a step of causing a surface heating element to contact a front surface of the belt member for heating the front surface while forming a fixing nip, a rear surface heating step for heating the belt member from the rear surface side thereof, and a step of implementing fixing processing of the toner image onto both sides of the recording medium by sandwiching the recording medium in the fixing nip. In the rear surface heating step, a region of the entire circumferential direction of the belt member is heated, the region extending from the point where the belt member is stretched by the stretching member disposed nearest to the double-sided transfer means, up to the point at which the belt member reaches the fixing nip.

In another aspect of the present invention, an image forming apparatus comprised an image carrier for carrying a toner image, visible image forming means for forming a toner image on the surface of the image carrier, double-sided transfer means for transcribing the toner image from the image carrier onto both sides of a recording medium, fixing means for fixing the toner image onto both sides of the recording medium after the recording medium passes through the double-sided transfer means, and conveyance means for passing the recording medium received from the double-sided transfer means to the fixing means by conveying the recording medium while carrying the recording medium on a self-propelled conveyance portion.

In another aspect of the present invention, an image forming method comprises a toner image forming step for forming a toner image on an image carrier, a double-sided transfer step for transcribing the toner image formed on the image carrier onto both sides of a recording medium using double-sided transfer means, a fixing step for fixing the toner image onto both sides of the recording medium after the double-sided transfer step, and a conveyance step for passing the recording medium received from the double-sided transfer means to fixing means by conveying the recording medium while carrying the recording medium on a self-propelled conveyance portion.

In another aspect of the present invention, an image forming apparatus comprises a first image carrier, a second image carrier, and a third image carrier. The image forming apparatus implements the steps of transcribing a visible image from the first image carrier to the second image carrier, electrostatically transferring the visible image by repulsive force onto one side of a recording medium from the second image carrier, electrostatically transferring the visible image by repulsive force from the second image carrier to the third image carrier, and electrostatically transferring said visible image by repulsive force onto the other side of the recording medium from the third image carrier. The second image carrier and the third image carrier are constituted to press against each other such that a nip which is suitable for simultaneous electrostatic transfer by repulsive force onto both sides of the recording medium is secured between the second image carrier and the third image carrier.

In another aspect of the present invention, an image forming apparatus wherein, when a step of transferring a first visible image from a first image carrier to a second image carrier, a step of electrostatically transferring the first visible image by repulsive force from the second image carrier onto a third image carrier, and a step of transferring a second visible image from the first image carrier to the second image carrier are complete, a step of electrostatically transferring the second visible image by repulsive force from the second image carrier onto one side of a recording medium, and a step of electrostacially transferring the first visible image by repulsive force from the third image carrier onto the other side of the recording medium are performed simultaneously while securing an appropriate transfer nip between said second image carrier and the third image carrier.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

First, an image forming apparatus that is under development by the inventor, or more specifically an image forming apparatus having a novel constitution which combines a one-pass system and a so-called belt-fixing system, will be described with reference to the drawings.

Figure 1:
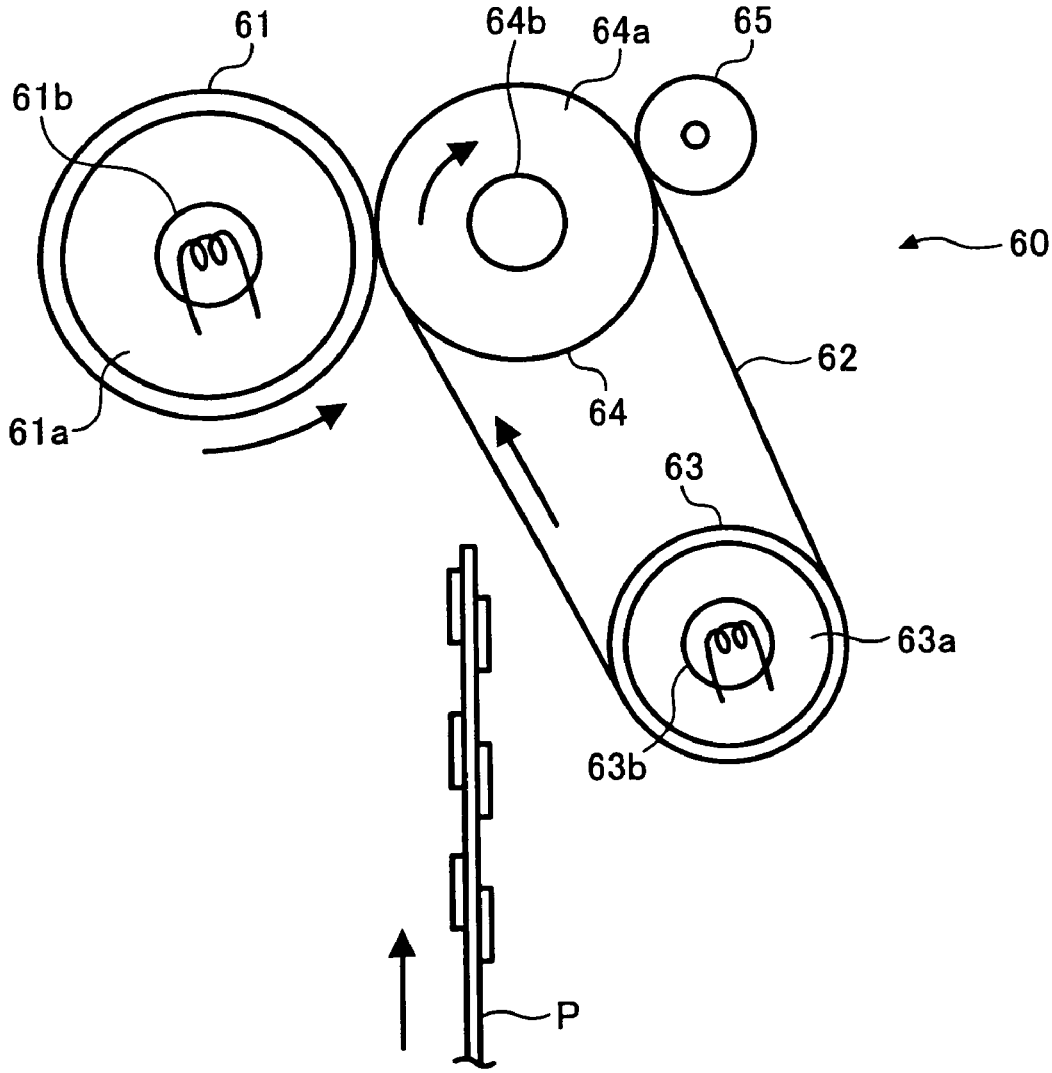
FIG. 1 is a diagram showing the schematic constitution of a fixing device in a belt-fixing system used in a novel image forming apparatus which is under development by the inventor.

FIG. 1 shows the schematic constitution of a fixing device in a belt-fixing system used in this image forming apparatus. As shown in the drawing, a fixing device 60 comprises a front surface heating roller 61, a fixing belt 62 constituted by an endless belt member, a rear surface heating roller 63, a nip rear side roller 64, a cleaning roller 65, and so on. The fixing belt 62 is stretched across the rear surface heating roller 63 and nip rear side roller 64 at a predetermined tension while being supported thereby from the rear side. The nip rear side roller 64 is driven by driving means not shown in the drawing to rotate in the clockwise direction of the drawing, thus causing the fixing belt 62 to perform an endless motion in the clockwise direction of the drawing.

The front surface heating roller 61 and rear surface heating roller 63 respectively comprise metallic pipe members 61*a*, 63*a* rotatably supported by support means not shown in the drawing, and halogen lamps 61*b*, 63*b* disposed non-rotatably in the interior of the rollers 61, 63. The pipe members 61*a*, 63*a* are heated from the inner surface by radiation from the halogen lamps 61*b*, 63*b* which serve as heat generating sources. The front surface heating roller 61 forms a fixing nip with the nip rear side roller 64, to be described below, by contacting the front surface of the fixing belt 62 such that the fixing belt 62 is sandwiched therebetween. The fixing belt 62 is heated from the front surface at this fixing nip by means of thermal conduction from the pipe member 61*b*. The rear surface heating roller 63 heats the rear surface of the fixing belt 62 at the position where the fixing belt 62 is stretched over the rear surface heating roller 63 by means of thermal conduction from the pipe member 63*b*.

The nip rear side roller 64 comprises a metallic core 64*b* and a thick elastic layer 64*a* formed from rubber or the like which covers the metallic core 64*b*. The thick elastic layer 64*a* is subjected to flexible elastic deformation by a pressing force from the front surface heating roller 61* via the fixing belt 62, and thus acts to increase the magnitude of the fixing nip in the circumferential direction of the belt.

A toner image is transcribed onto each side of a sheet of transfer paper P serving as a recording medium by double-sided transfer means not shown in the drawing, whereupon the transfer paper P is conveyed toward the fixing means 60 from the lower section of the drawing by the double-sided transfer means. Once the tip end of the transfer paper P has impinged on a region of the entire circumferential direction of the fixing belt 62 between the location that is stretched by the rear surface heating roller 63 and the fixing nip, the transfer paper P is conveyed toward the fixing nip while gradually becoming adhered to the fixing belt 62. Upon reaching the fixing nip, one surface side of the transfer paper P is adhered tightly to the fixing belt 62 which has been raised in temperature by the rear surface heating roller 63, and thus heated, while the other surface side is adhered tightly to the front surface heating roller 61 and heated. Hence heat is applied from both sides at the fixing nip. By means of such heating from both sides, the toner images on the two sides of the transfer paper P are respectively subjected to heat and pressure, and thus fixed onto their respective sides.

Having passed through the fixing nip, the transfer paper P is conveyed to a discharge path, not shown in the drawing, in conjunction with the surface motion of the fixing belt 62 and front surface heating roller 61, and then discharged outside of the machine. The small amount of residual toner (offset toner) that remains adhered to the surface of the fixing belt 62 after the transfer paper P has passed through the fixing nip during fixing is removed from the front surface of the belt electrostatically by the cleaning roller 65 to which a cleaning bias has been applied.

In this type of image forming apparatus combining the fixing device 60 and the one-pass system, the transfer paper P can be guided toward the fixing nip without scratching the toner image by having the fixing belt 62 contact the transfer paper P while performing a surface motion. As a result, image disturbance caused when an unfixed toner image suffers abrasion can be suppressed. Furthermore, the fixing belt 62 differs from the spur described in the aforementioned Japanese Unexamined Patent Application Publication H10-142869 in that even when toner staining occurs due to offset or the like, cleaning can be performed easily using known means such as the cleaning roller 65 shown in the drawing. Hence situations in which a subsequent sheet of the transfer paper P is stained by toner adhered to a guiding member such as a spur or the fixing belt 62 can be prevented easily.

However, it became clear during the dedicated research of the inventor that in the fixing device 60 shown in FIG. 1, the rear surface heating roller 63, which is disposed in the immediate vicinity of the double-sided transfer means, not shown in the drawing, produces various adverse effects as a result of heating the double-sided transfer means. More specifically, when means which transcribe a toner image onto transfer paper from an intermediate transfer belt are used as the double-sided transfer means, for example, the dimensions of the intermediate transfer belt and the stretching roller which stretches the belt are slightly altered by the heat from the rear surface side heating roller 63. These alterations lead to a slight variation in the speed of the surface motion of the intermediate transfer belt, thus causing image disturbance.

A constitution such as the following may be employed as a method for suppressing such adverse effects caused when the double-sided transfer means are heated unintentionally by the fixing means. In this method, the rear surface of the fixing belt 62 is heated by providing a heat source on the nip rear side roller 64 and using a simple stretching roller not provided with a heat source as the rear surface heating roller 63 shown in the drawing. In so doing, the heat source in the fixing means is removed from the double-sided transfer means, and hence heat conduction from the fixing means to the double-sided transfer means can be suppressed.

As described above, however, the nip rear side roller 64 acts to increase the magnitude of the fixing nip by means of elastic deformation of the thick elastic layer 64*a*, and hence if a heat source is provided on the lower side of the thick elastic layer 64*a*, the size of the fixing device 60 increases. Moreover, since the thermal conductivity of the thick elastic layer 64*a* is typically poorer than that of a metallic material, a great deal of heat accumulates therein, leading to a deterioration in energy efficiency.

Three embodiments, namely first, second, and third embodiments, of the present invention will now be described in detail with reference to the drawings. It is to be noted that the reference numerals used in each embodiment are independent of the reference numerals of the other embodiments, i.e., the same reference numerals do not always designate the same structural elements.

First Embodiment

An electrophotographic printer (to be referred to simply as "printer" hereinafter) serving as the image forming apparatus to which this embodiment is applied will now be described.

First, the basic constitution of a printer 100 will be described.

Figure 2:
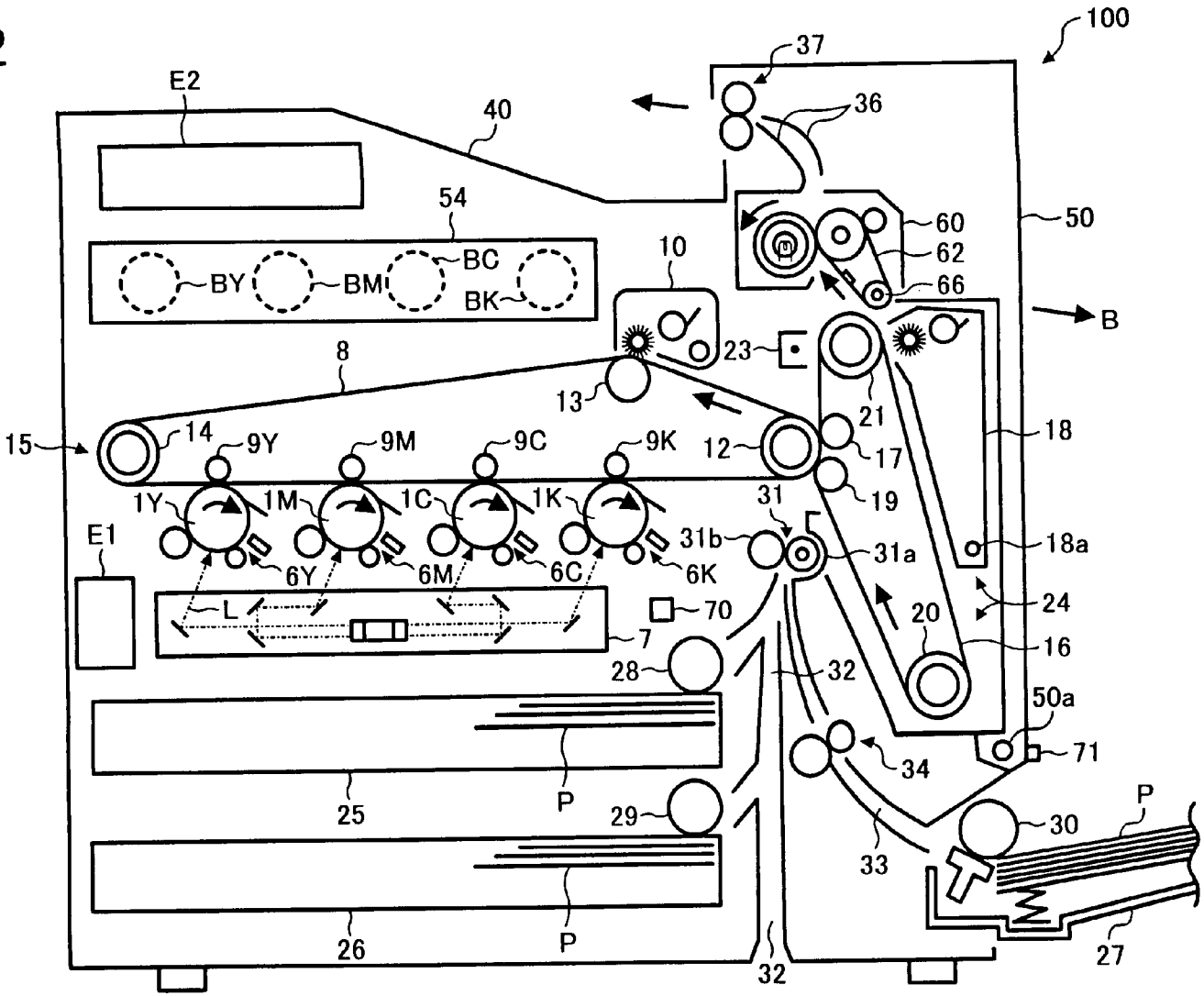
FIG. 2 is a diagram showing the schematic constitution of a printer serving as an image forming apparatus according to a first embodiment of the present invention.

FIG. 2 shows the schematic constitution of the printer 100 from a front surface direction. As shown in the drawing, the printer 100 comprises four process cartridges 6Y, M, C, K for generating toner images in yellow, magenta, cyan, and black (to be indicated by Y, M, C, K hereinafter). These process cartridges 6Y, M, C, K use toner of the different colors Y, M, C, K as an image forming substance, but are otherwise constituted identically, and are exchanged at the end of their lifetimes.

Figure 3:
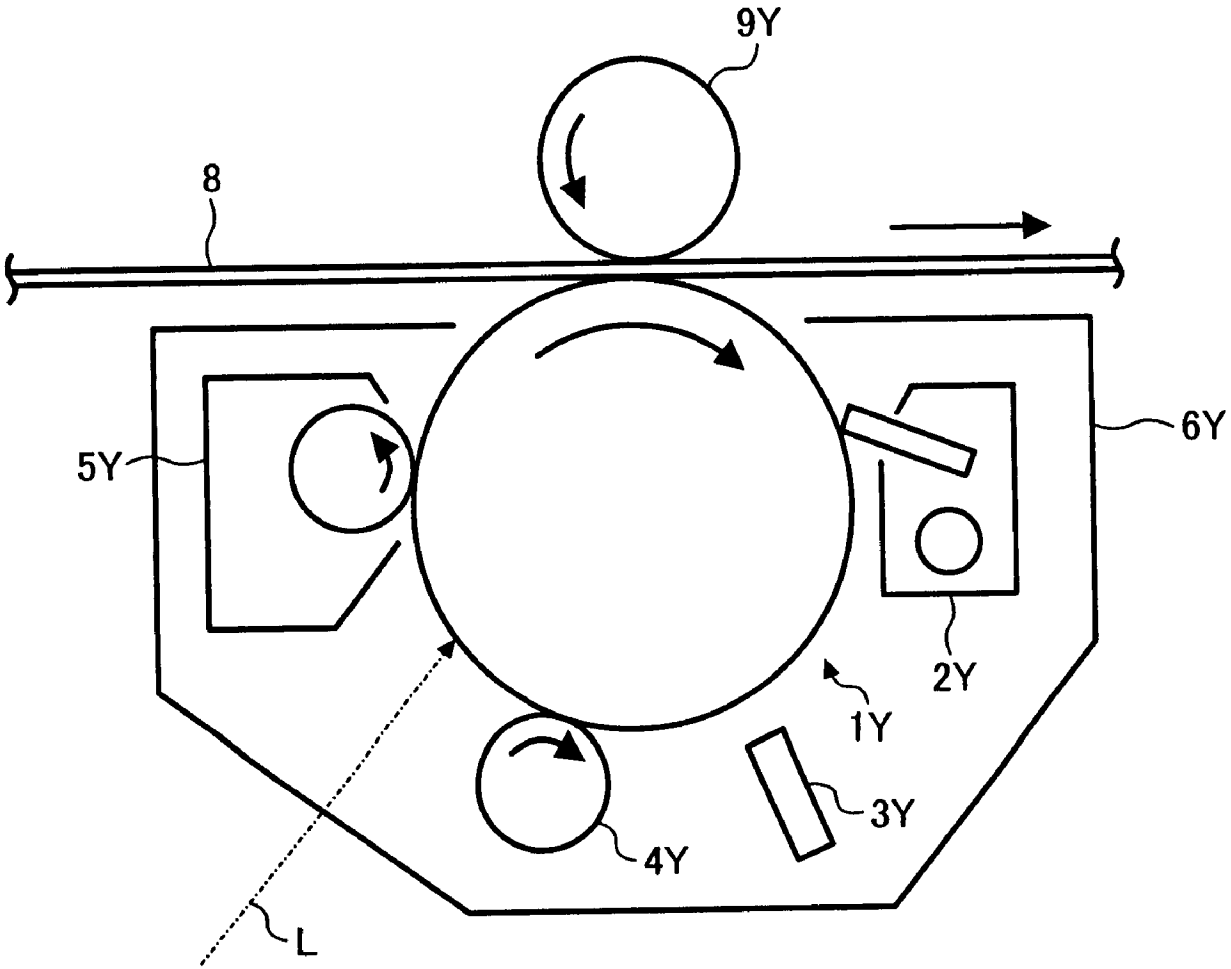
FIG. 3 is a diagram showing the constitution of a Y processing unit of the printer.

As shown in FIG. 3, using the process cartridge 6Y for generating a Y toner image as an example, the process cartridge 6Y comprises a drum-form photosensitive body 1Y serving as an image carrier, a drum cleaning device 2Y, an antistatic device 3Y, a charging device 4Y, a developing device 5Y, and soon. The photosensitive body 1Y comprises an aluminum cylinder with a diameter of between 30 and 100 [mm], coated with a surface layer formed from an organic semiconductor which serves as a photoconductive substance. The aluminum cylinder may be coated with an amorphous silicon surface layer. Also, the photosensitive body 1Y may take a belt form rather than a drum form. The charging device 4Y uniformly charges the surface of the photosensitive body 1Y which is rotated in the clockwise direction of the drawing by driving means not shown in the drawing. The surface of the uniformly charged photosensitive body 1Y is then subjected to exposure scanning using laser light L emitted from an exposure device 7 to be described below, and thus carries a Y electrostatic latent image. This Y electrostatic latent image is developed into a Y toner image by the developing device 5Y which uses Y toner.

The process cartridge 6Y constituted as described above implements an image forming process together with the exposure device 7 to form a toner image on the surface of the photosensitive body 1Y serving as an image carrier. Accordingly, in the printer 100, each process cartridge 6Y, M, C, K functions in combination with the exposure device 7 as visible image forming means for forming a toner image on the surface of an image carrier.

The Y toner image that is developed on the photosensitive body 1Y is subjected to a primary transfer onto a first intermediate transfer belt 8 to be described below. The drum cleaning device 2Y removes toner remaining on the surface of the photosensitive body 1Y after the primary transfer process is complete. The antistatic device 3Y neutralizes the residual electric charge of the photosensitive body 1Y following cleaning. The surface of the photosensitive body 1Y is initialized by this neutralization, and thus prepared for the next image forming process. M, C, and K toner images are formed similarly on the photosensitive bodies 1M, C, K in the other process cartridges 6M, C, K, whereupon the toner images are subjected to the primary transfer onto the first intermediate transfer belt 8. It is to be noted that the developing devices (5Y and so on) may use either a two-component developer containing a toner and a magnetic carrier, or toner particles alone.

As shown in FIG. 2, the exposure device 7 is disposed below the process cartridges 6Y, M, C, K in the drawing, and an image data processing device E1 is disposed to the left thereof in the drawing. The image data processing device E1 generates an exposure scanning control signal based on an image information signal transmitted from a personal computer or the like, and transmits this exposure scanning control signal to the exposure device 7. The exposure device 7, which serves as latent image forming means, irradiates the photosensitive bodies 1Y, M, C, K in the respective process cartridges 6Y, M, C, K with laser light L which is emitted on the basis of the exposure scanning control signal. Thus Y, M, C, and K electrostatic latent images are formed on the photosensitive bodies 1Y, M, C, K that have been exposed to this irradiation.

The exposure device 7 irradiates the photosensitive bodies with the laser light L emitted from a light source via a plurality of optical lenses and mirrors while scanning the photosensitive bodies with a polygon mirror that is driven to rotate by a motor. Instead of the exposure device 7 constituted in this manner, however, exposure means which emit LED light from an LED array may be employed. Further, a sealing member not shown in the drawing is provided on the housing of the exposure device 7 to prevent contamination of the internal components caused by toner falling from the photosensitive bodies 1Y, M, C, K disposed thereabove.

A first paper cassette 25 having a first feed roller 28 and a second paper cassette 26 having a second feed roller 29 are disposed below the exposure device 7 in the drawing so as to be arranged in series in the vertical direction. These cassettes store in their respective interiors the transfer paper P serving as a recording medium in stacks consisting of a plurality of sheets of transfer paper piled one on top of the other. A manual feed tray 27 having a manual feed roller 30 is provided to the right of the second paper cassette 26 in the drawing so as to protrude from the side face of the housing of the main body of the printer 100 rather than within the housing. A stack of transfer paper is placed on the manual feed tray 27.

A feeding path 32 having a pair of resist rollers 31 and a guiding path 33 which converges with the feeding path 32 are disposed between the two paper cassettes 25, 26 and the manual feed tray 27. The guiding path 33 comprises a pair of conveyance rollers 34. The first feed roller 28 and second feed roller 29 contact the top sheet of transfer paper P of the stacks of transfer paper stored in the first paper cassette 25 and second paper cassette 26 respectively. The first feed roller 28 and second feed roller 29 are driven to rotate by driving means not shown in the drawing, and thus feed the top sheet of transfer paper P toward the feeding path 32. The fed transfer paper P is sandwiched between the first resist roller 31*a* and second resist roller 31*b* of the resist roller pair 31 disposed near the end of the feeding path 32. The pair of resist rollers 31 is driven to rotate in a forward direction in order to trap the transfer paper P, and once the transfer paper P has been trapped between the rollers, the two rollers immediately stop rotating. Rotation is resumed at an appropriate timing, whereby the transfer paper P is fed toward a secondary transfer nip to be described below. Thus the pair of resist rollers 31 functions as a pair of timing rollers.

The manual feed roller 30 contacts the top sheet of transfer paper P on the stack of transfer paper placed on the manual feed tray 27. The manual feed roller 30 is then driven to rotate by driving means not shown in the drawing, and thus feeds the top sheet of transfer paper P toward the guiding path 33. The fed transfer paper P passes between the rollers of the pair of conveyance rollers 34, which are caused to rotate in a forward direction while contacting each other by driving means not shown in the drawing, and thus reaches the vicinity of the end of the feeding path 32. The transfer paper P is then sandwiched between the first resist roller 31*a* and second resist roller 31*b*.

The Y, M, C, and K electrostatic latent images formed on the photosensitive bodies 1Y, M, C, K are obtained in a transfer process performed by the double-sided transfer means. The double-sided transfer means comprise a first transfer unit 15 and a second transfer unit 24.

The first transfer unit 15 is disposed above the process cartridges 6Y, M, C, K in the drawing, and comprises the first intermediate transfer belt 8, four primary transfer rollers 9Y, M, C, K, a first cleaning device 10, and so on. The first transfer unit 15 also comprises a secondary transfer backup roller 12, a first cleaning backup roller 13, a tension roller 14, and soon. The first intermediate transfer belt 8, which serves as a first intermediate transfer body, is stretched across the three rollers, and is caused to perform an endless motion in the anti-clockwise direction of the drawing by driving at least one of the rollers to rotate. The endlessly moving first intermediate transfer belt 8 is sandwiched between the four primary transfer rollers 9Y, M, C, K serving as transfer bias members and the photosensitive bodies 1Y, M, C, K, and thus the four primary transfer rollers 9Y, M, C, K each form a primary transfer nip. A primary transfer bias having a reverse polarity to the toner (plus, for example) is then applied to the rear surface (the inner peripheral surface of the loop) of the first intermediate transfer belt 8 by a power source not shown in the drawing. The three rollers described above other than the four primary transfer rollers 9Y, M, C, K are all electrically grounded.

The first intermediate transfer belt 8 gradually passes between the Y, M, C, K primary transfer nips as it moves endlessly. At each of the primary transfer nips, the Y, M, C, K toner images on the photosensitive bodies 1Y, M, C, K receive nip pressure and the effect of the primary transfer bias, and are thus subjected to a composite primary transfer. As a result, a toner image combining four colors (to be referred to as a four-color toner image hereinafter) is formed on the first intermediate transfer belt 8. The secondary transfer backup roller 12 over which the first intermediate transfer belt 8 is stretched is disposed so as to intrude on a second intermediate transfer belt 16 to be described below. This intruding position enables the first intermediate transfer belt 8 and second intermediate transfer belt 16 to form a secondary transfer nip at which the first intermediate transfer belt 8 and second intermediate transfer belt 16 contact each other over a wide area in their respective circumferential directions. At this secondary transfer nip, the respective surfaces of the first intermediate transfer belt 8 and second intermediate transfer belt 16 contact each other as the belts move in the same direction. The four-color toner image, which is a visible image formed on the first intermediate transfer belt 8, is subjected to a secondary transfer onto the second intermediate transfer belt 16 or the transfer paper P at the secondary transfer nip.

It should be noted that instead of the four primary transfer rollers 9Y, M, C, K of the bias application system, a charger system in which electricity is discharged from an electrode may be employed. Further, the first intermediate transfer belt 8 is an endless belt having rubber as a base substance and regulated to an electric resistance value which is suitable for performing electrostatic transfer of the toner images from the photosensitive bodies 1Y, M, C, K. A two-layer constitution comprising a resin film layer (a polyimide layer, for example) and a rubber layer (a urethane rubber layer, for example), or a multi-layer constitution comprising further layers may be employed in the first intermediate transfer belt 8. The surface hardness of the first intermediate transfer belt 8 is preferably no more than 65 [degrees], and in this printer 100, the first intermediate transfer belt 8 has a JIS-A hardness of 50 [degrees].

Residual toner not subjected to the secondary transfer onto the second intermediate transfer belt 16 or transfer paper P remains adhered to the first intermediate transfer belt 8 after the transfer paper P passes through the secondary transfer nip. This toner is cleaned away by the first cleaning device 10. More specifically, the first intermediate transfer belt 8 is sandwiched between the first cleaning device 10 disposed so as to contact the outside (front surface) of the loop, and the first cleaning backup roller 13 disposed on the inside of the loop. The residual toner on the front surface is collected in the first cleaning device 10 mechanically or electrostatically, and thus the first intermediate transfer belt 8 is cleaned.

The second transfer unit 24 of the double-sided transfer means is disposed to the right of the first transfer unit 15 in the drawing, and comprises the second intermediate transfer belt 16, a second cleaning device 18, a transfer charger 23, and so on. The second transfer unit 24 also comprises a secondary transfer roller 17, a nip enlarging roller 19, a tension roller 20, a backup roller 21, and so on. The second intermediate transfer belt 16 is stretched across these four rollers, and is caused to perform an endless motion in the clockwise direction of the drawing by driving at least one of the rollers to rotate. The secondary transfer backup roller 12 of the first transfer unit 15 intrudes on a bridge part of the second intermediate transfer belt 16 between the secondary transfer roller 17 and the nip enlarging roller 19 to form the secondary transfer nip. The secondary transfer roller 17, which serves as a transfer bias member, is a metallic roller or a roller with a metallic core covered with a conductive rubber layer, and is supplied with a secondary transfer bias having a reverse polarity to the toner (plus polarity, for example) by a power source not shown in the drawing. All of the other rollers in the second transfer unit 24 are grounded.

The pair of resist rollers 31 described above feed the transfer paper P sandwiched between the rollers toward the secondary transfer nip at a timing which enables the transfer paper P to be adhered to the four-color toner image subjected to the primary transfer onto the first intermediate transfer belt 8. Note, however, that when the four-color toner image is a first toner image to be transcribed onto a first side of the transfer paper P (the side facing upward on a stacking portion 40 to be described below), the transfer paper P is not fed. Hence, at this time the first toner image on the first intermediate transfer belt 8 receives the nip pressure of the secondary transfer nip and the effect of the secondary transfer bias, and is thus subjected to a secondary transfer onto the second intermediate transfer belt 16. Conversely, when the four-color toner image on the first intermediate transfer belt 8 is a second toner image to be transcribed onto a second side of the transfer paper P (the side which faces downward on the stacking portion 40), the pair of resist rollers 31 feed the transfer paper P in synchronization with the second toner image. As a result, the second toner image is subjected to a secondary transfer onto the second side of the transfer paper P (the side which faces downward on the stacking portion 40 to be described below) at the secondary transfer nip to produce a full color image combined with the white of the transfer paper P. At this time, the first toner image that was transcribed onto the second intermediate transfer belt 16 in advance is adhered to the first side of the transfer paper P which has been fed to the secondary transfer nip. Note, however, that the first toner image is attracted to the belt side by the action of the secondary transfer bias, and hence although the first toner image becomes adhered to the first side of the transfer paper P, secondary transfer onto the first side of the transfer paper P is not performed.

In the first transfer unit 15, the secondary transfer backup roller 12 stretches the first intermediate transfer belt 8 in such a form that the movement direction thereof is substantially reversed. The part of the first intermediate transfer belt which is being reversed in movement direction contacts the second intermediate transfer belt 16 to form the secondary transfer nip. Hence at the outlet from the secondary transfer nip, the first intermediate transfer belt 8 is removed from the transfer paper P such that the transfer paper P is carried and conveyed on the surface of the second intermediate transfer belt 16 alone. In the secondary transfer unit 24, the transfer paper P is conveyed to a tertiary transfer portion with the endless motion of the second intermediate transfer belt 16. In the tertiary transfer portion of the second transfer unit 24, the transfer charger 23 is disposed so as to face the part of the second intermediate transfer belt 16 that is stretched by the backup roller 21 with a predetermined gap therebetween. The transfer charger 23 applies a charge having a reverse polarity to the toner (plus polarity, for example) to the second side of the transfer paper P on the second intermediate transfer belt 16. As a result, the first toner image that is sandwiched between the first side of the transfer paper P and the second intermediate transfer belt 16 is subjected to a tertiary transfer onto the first side of the transfer paper P to produce a full color image.

Note that the second intermediate transfer belt 16 is an endless belt having resin (polyimide, for example) with a thickness of approximately 50 to 600 [μm] as a base substance, and is regulated to an electric resistance value which is suitable for performing the secondary transfer of the toner image from the first intermediate transfer belt 8.

As described above, the double-sided transfer means comprising the two transfer units 15, 24 perform a first stage transfer on the transfer paper P to transcribe the second toner image onto the second side at the secondary transfer nip, and then perform a second stage transfer to transcribe the first toner image onto the first side at the tertiary transfer portion. Note that instead of the rollers 9, 17, an object having a different form, such as a brush, may be used as the member to which the primary transfer bias and secondary transfer bias are applied. Furthermore, instead of the electrostatic transfer system whereby a transfer bias is applied to a member, a non-contact discharge method may be employed.

In the second transfer unit 24, the transfer paper P completes the double-sided transfer process with the tertiary transfer, and is then separated from the second intermediate transfer belt 16 and conveyed to the fixing device 60 to be described below. Meanwhile, the second intermediate transfer belt 16, having passed through the tertiary transfer portion, is sandwiched between the backup roller 21 and the second cleaning device 18 so that residual toner on the surface can be cleaned away mechanically or electrostatically. If the second cleaning device 18 contacts the second intermediate transfer belt 16 at all times, then the first toner image that was subjected to the secondary transfer onto the second intermediate transfer belt 16 will also be cleaned. Hence the second cleaning device 18 is designed to contact and separate from the second intermediate transfer belt 16 by having a rocking mechanism, not shown in the drawing, rock the second cleaning device 18 in the direction of the arrow in the drawing about a rocking shaft 18*a*. The second cleaning device 18 is removed from the second intermediate transfer belt 16 at least while the first toner image passes through the cleaning position, and thus cleaning of the first toner image is avoided.

The fixing device 60, serving as fixing means, is disposed above the second transfer unit 24 in the drawing. Once a full color image constituted by toner images has been transcribed onto both sides of the transfer paper P by the double-sided transfer means, the transfer paper P is conveyed to the fixing device 60, where fixing processing of the full color image is implemented. The fixing device 60 implements a fixing process in which the toner images transcribed onto the two sides of the transfer paper P serving as a recording medium are adhered to the two sides of the transfer paper P.

Once fixing processing has been implemented on the full color images on both sides, the movement direction of the transfer paper P is reversed along a reverse guiding member 36, whereupon the transfer paper P is discharged outside through a pair of discharge rollers 37. The transfer paper P is then stacked onto the stacking portion 40 formed on the upper surface of the printer main body housing.

Thus in the printer 100, the transfer paper P is conveyed downstream from the secondary transfer nip in the movement direction of the belt, whereupon transfer processing is implemented on the transfer paper P to transcribe toner images onto both sides of the transfer paper P using the double-sided transfer means. Thus image formation can be performed on both sides of the transfer paper P using a one-pass system. Since the transfer paper P does not contact the photosensitive bodies 1Y, M, C, K serving as image carriers directly, the amount of paper particles becoming adhered to the photosensitive bodies can be suppressed.

It is to be noted that the system used in the printer 100, whereby a plurality of image carriers such as photosensitive bodies are arranged in series and visible images formed respectively thereby are transferred sequentially to form a composite image such as a multi-color image, is known as a tandem system. In an alternative system, a composite image is formed by repeating a composite transfer process whereby a visible image is formed on a single image carrier and transcribed onto an intermediate transfer body, and then another visible image is formed on the image carrier and transferred onto the intermediate transfer body. In this system, the processes of forming and transferring a visible image must be performed repeatedly, whereas in the tandem system, a plurality of visible images to be transferred sequentially are formed substantially simultaneously on image carriers corresponding to the respective visible images, and hence the time required for image formation can be reduced greatly.

As described above, the first toner image is formed ahead of the second toner image. Then, following the secondary transfer from the first intermediate transfer belt 8 onto the second intermediate transfer belt 16 at the secondary transfer nip, the tertiary transfer is performed onto the first side of the transfer paper at the tertiary transfer portion. The first side is the side of the transfer paper P which faces upward on the stacking portion 40. Hence, the transfer paper P is stacked sequentially on the stacking portion 40 such that the first toner image, which is formed in advance, faces upward, and the second toner image formed on the next sheet of transfer paper P lies on top of the first toner image of the previous sheet.

To ensure that the page numbers of the sheets of transfer paper P that are gradually stacked in this manner are stacked in order from the lowest page number, the printer 100 forms the image corresponding to the higher page number of a consecutive odd and even number in advance as the first toner image. For example, the image on the second page is formed as the first toner image ahead of the image on the first page. In so doing, a document having several pages that are outputted consecutively can be stacked on the stacking portion 40 in order from the lowest page number. Note, however, that when a single-sided print mode is executed to form an image on only the second side of the transfer paper P, images are formed in order from the lowest page number, and the secondary transfer is performed onto the second side of each sheet of transfer paper P. In so doing, the transfer paper P can be stacked on the stacking portion 40 in order from the lowest page number likewise in the single-sided print mode.

Each of the color toner images formed on the four photosensitive bodies 1Y, M, C, K as the second toner image is formed as a non-mirror image (to be referred to as a "normal image" hereinafter). This is because each of the formed color toner images changes to a mirror image and then to a normal image in the double transfer process, comprising the primary transfer and secondary transfer, to reach the transfer paper P. By forming the color toner images as normal images on the photosensitive bodies, they are also formed as normal images on the second side of the transfer paper P. In contrast, the color toner images formed as the first toner image are additionally subjected to the tertiary transfer, and hence undergo one more transfer process than the second toner image. Therefore, the color toner images of the first toner image are formed on the photosensitive bodies as mirror images. Accordingly, with each transfer, the first toner image changes to a normal image, then to a mirror image, and then to a normal image, and thus can be formed as a normal image on the first side of the transfer paper P.

A bottle storage device 54 is disposed above the first transfer unit 15 in the drawing. Toner bottles BY, BM, BC, BK containing toner for refilling the developing machine inside each process cartridge 6Y, M, C, K are stored inside the bottle storage device 54.

Figure 4:
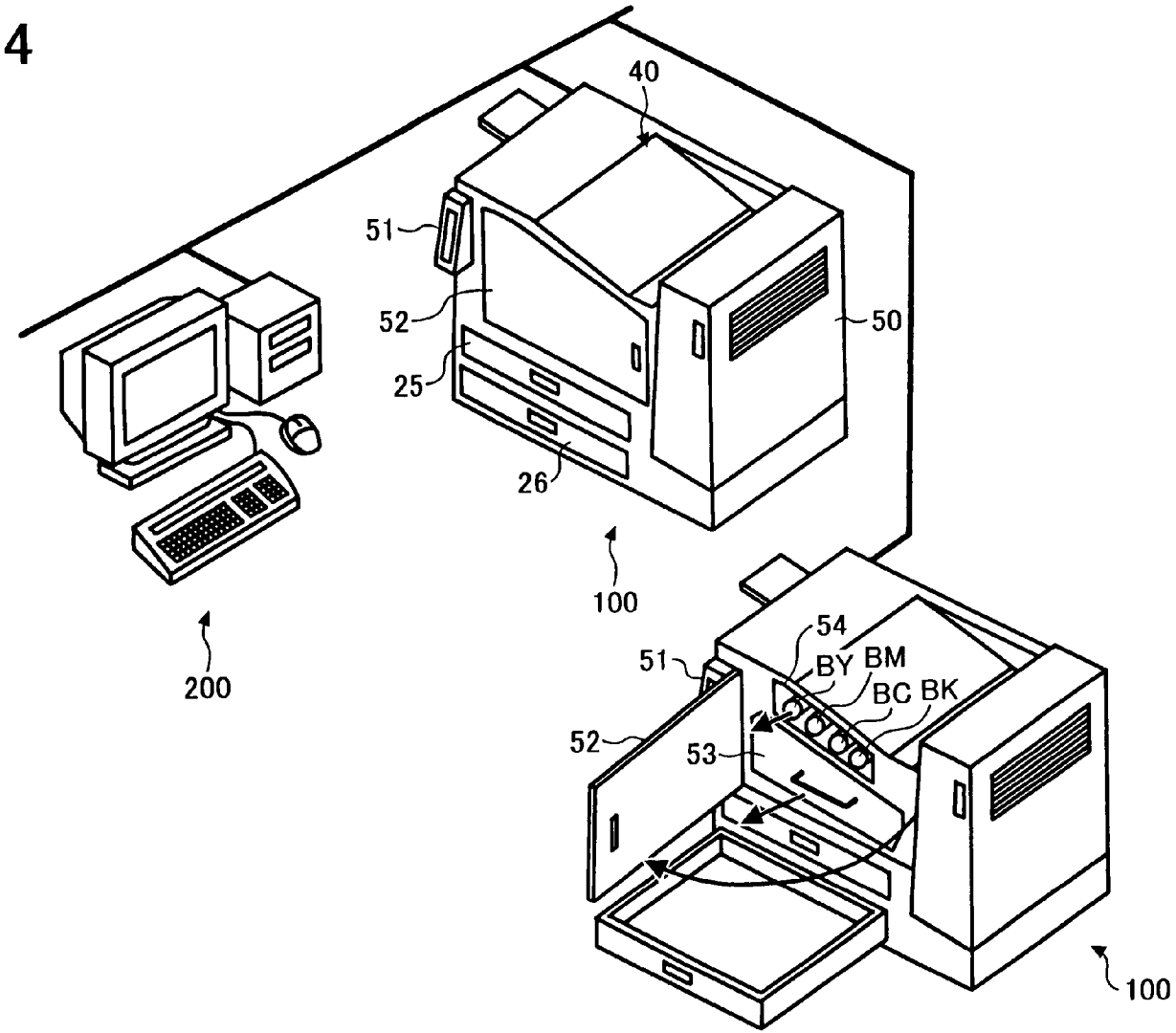
FIG. 4 is a perspective view showing the constitution of an image forming system comprising the printer and a personal computer.

As shown in FIG. 4, the printer 100 forms images on the basis of image information signals transmitted from a personal computer (to be referred to as "PC" hereinafter) 200 or the like. FIG. 4 shows an example of an image forming system in which the PC 200 and printer 100 are connected by a communication cable, although this connection may employ a wireless system. An operating display 51 constituted by a touch panel or the like is fixed to the left corner on the front surface of the printer main body. A user is able to input various parameters, such as image-creating process conditions or paper conditions, following a guide display that appears on the operating display 51. The user may switch between the aforementioned single-sided print mode and double-sided print mode by operating a mode switching button provided on the operating display 51. The type of paper (the paper cassette) may also be selected by performing an operation on the operating display 51. It should be noted, however, that mode switching and paper type selection may also be performed by transmitting a setting signal from the personal computer 200.

A front door 52 is provided on the front surface of the main body of the printer 100 so as to be free to open and close. When the front door 52 is opened, a supporting body 53 which supports the first transfer unit 15, not shown in the drawing, is widely exposed. This supporting body 53 is constituted to be slidable in the front/rear direction of the main body along a guide rail not shown in the drawing. By drawing the supporting body 53 from inside the main body toward the front surface side, the first transfer unit 15 is exposed. By exposing the first transfer unit 15 in this manner, a maintenance inspection can be performed on the first transfer unit 15 easily. The end faces of the toner bottles BY, BM, BC, BK in the bottle storage device 54 which is disposed above the supporting body 53 are also exposed when the front door 52 is opened. With their respective front faces exposed, the toner bottles BY, BM, BC, BK can be removed from and inserted into the bottle storage device 54 in the front/rear direction of the printer 100. When the front door 52 is opened, the toner bottles BY, BM, BC, BK can also be removed from and inserted into the main body in the front/rear direction thereof.

The upper surface of the main body on which the stacking portion 40 is formed does not serve as an upper door that can be opened and closed freely, enabling the toner bottles BY, BM, BC, BK to be inserted and removed in a vertical direction when such a door is opened. As a result, the toner bottles BY, BM, BC, BK can be inserted and removed even when an optional scanner device, not shown in the drawing, is disposed on top of the printer 100*a* to constitute a copier.

The first paper cassette 25 and second paper cassette 26 are disposed below the front door 52, and are constituted to be removable from the main body by means of a sliding motion in the front/rear direction. Opening the slide door 52 does not hinder removal of the first paper cassette 25 and second paper cassette 26 or input operations into the operating display 51.

Next, the distinguishing features of the printer 100 according to this embodiment will be described.

Figure 5:
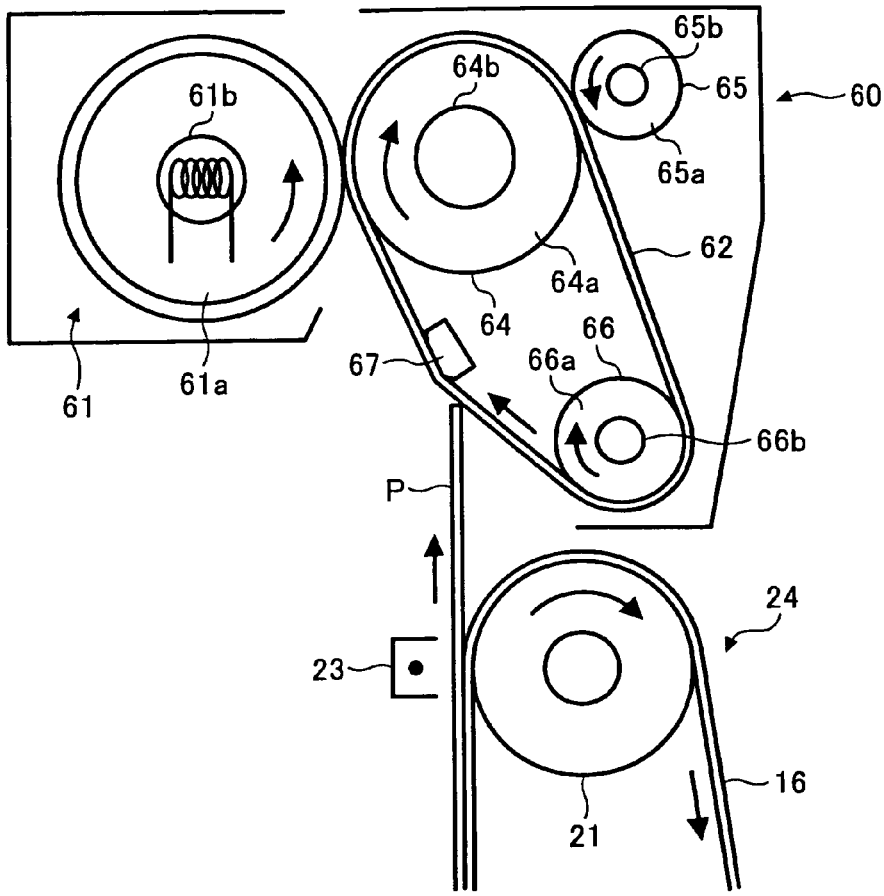
FIG. 5 is a diagram showing the constitution of the fixing device of the printer together with a part of the constitution of a second transfer unit.

FIG. 5 shows an enlargement of the constitution of the fixing device 60 together with a part of the constitution of the second transfer unit 24. As shown in the drawing, the fixing device 60 comprises a front surface heating roller 61, a fixing belt 62 constituted by an endless belt member, a lower side stretching roller 66, a nip rear side roller 64, a cleaning roller 65, a rear side heater 67, and so on.

The fixing belt 62 is stretched at a predetermined tension and supported from the rear side by the lower side stretching roller 66 and the nip rear side roller 64, which serve as stretching members. The fixing belt 62 is caused to perform an endless motion in the clockwise direction of the drawing by driving the nip rear side roller 64 to rotate in the clockwise direction of the drawing using driving means not shown in the drawing. A material having excellent heat-resistance and durability is preferably used as the material for the fixing belt 62. This is due to the fact that, for reasons to be described below, the fixing belt 62 is heated from both the front surface and rear surface to between approximately 140 and 180 [° C.]. Materials having excellent heat-resistance and durability include polyimide, polyetherimide, PES (polyethyer sulfide), PFA (tetrafluoroethylene perfluoroalkoxy vinyl ether copolymer resin), and so on.

The constitution of the fixing belt 62 may be either single-layer or multi-layer, but it is preferable that a material having an excellent toner release property be used on at least the front surface thereof in order to suppress partial offset of the first toner image from the first side of the transfer paper P. Suitable materials for the front surface include a coating layer having a thickness of approximately 10 [μm] in which a conductive material is introduced to a fluororesin such as PTFE (tetrafluoroethylene resin) or PFA, and so on. Fluoro rubber, silicone rubber, and so on may also be used. The thickness of the fixing belt 62 is preferably no more than 100 [μm], and more preferably no more than 40 [μm].

The front surface heating roller 61 comprises a metallic pipe member 61*a*, which is supported rotatably by supporting means not shown in the drawing, and a halogen lamp 61*b* disposed non-rotatably in the interior thereof. The pipe member 61*a* is heated from the inner surface by radiation from the halogen lamp 61*b*, which serves as a heat generating source. The front surface heating roller 61 forms a fixing nip with the nip rear side roller 64 to be described below by contacting the front surface of the fixing belt 62 such that the fixing belt 62 is sandwiched therebetween. The fixing belt 62 is heated from the front surface at this fixing nip by means of thermal conduction.

The fixing device 60 also comprises a lamp power source, a front surface temperature detection sensor, a front surface heating control circuit, and so on, none of which are shown in the drawing. The lamp power source supplies a voltage to the halogen lamp 61*b*. The front surface temperature detection sensor detects the temperature of the front surface of the fixing belt 62 immediately after passing through the fixing nip, and outputs a temperature signal corresponding to the detection result. The front surface heating control circuit ON/OFF controls the power supply from the lamp power source to the halogen lamp 61*b* on the basis of the temperature signal from the front surface temperature detection sensor. By means of this ON/OFF control, the temperature of the front surface of the fixing belt 62 immediately after passing through the fixing nip is controlled within a predetermined range (between 160 and 180° C., for example).

The nip rear side roller 64 comprises a metallic core 64*b* and a thick elastic layer 64*a* formed from rubber or the like which covers the metallic core 64*b*. The thick elastic layer 64*a* is subjected to flexible elastic deformation by a pressing force from the front surface heating roller 61 via the fixing belt 62, and thus acts to increase the magnitude of the fixing nip in the circumferential direction of the belt.

The lower side stretching roller 66 comprises a metallic core 66*b* and an elastic layer 66*a* constituted by rubber or the like which covers the metallic core 66*b*. The lower side stretching roller 66 is rotated in conjunction with the endless motion of the fixing belt 62 in the clockwise direction of the drawing.

The rear surface heater 67 constitutes a part of rear surface heating means of the fixing device 60. These rear surface heating means heat the fixing belt 62, which serves as a belt member, from the rear surface side (the inner surface of the loop) side. As well as the rear surface heater 67, the rear surface heating means comprise a rear surface heating power source, not shown in the drawing, for supplying a voltage to the rear surface heater 67, a rear surface temperature detection sensor, not shown in the drawing, for detecting the rear surface temperature of the fixing belt 62, a rear surface heating control circuit for ON/OFF controlling the power source on the basis of the detection result of the rear surface temperature detection sensor, and so on. The rear surface heater 67 is disposed so as to contact a region of the entire rear surface of the fixing belt 62 in the circumferential direction, this region extending from the point where the fixing belt 62 passes the stretching position of the lower side stretching roller 66, which is disposed nearest to the second transfer unit 24 serving as a part of the above-described double-sided transfer means, to the point where the fixing belt 62 reaches the fixing nip. This region is heated by means of contact thermal conduction from a resistance heating element, not shown in the drawing, which is disposed in the interior of the rear surface heater 67.

The rear surface temperature detection sensor, not shown in the drawing, is disposed to be capable of detecting the rear surface temperature of the fixing belt 62 immediately after the fixing belt 62 passes the position of contact with the rear surface heater 67. The rear surface heating control circuit ON/OFF controls the power supply to the rear surface heater 67 from the rear surface heating power source on the basis of a temperature signal from the rear surface temperature detection sensor. By means of this ON/OFF control, the temperature of the rear surface of the fixing belt 62 immediately after passing the rear surface heater 67 is controlled within a predetermined range (between 160 and 180° C., for example).

The transfer paper P, having full color images transcribed onto both sides by the double-sided transfer means, is conveyed toward the fixing means 60 from the lower part of the drawing by the second intermediate transfer belt 16 of the second transfer unit 24. Once the tip end of the transfer paper P impinges on a region of the entire circumferential direction of the fixing belt 62 between the location that is stretched by the lower side stretching roller 66 and the fixing nip, the transfer paper P is conveyed toward the fixing nip while gradually becoming adhered to the fixing belt 62. Upon reaching the fixing nip, the first side of the transfer paper P is adhered tightly to the fixing belt 62 which has been raised in temperature by the rear surface heater 67, and thus heated, while the second side is adhered tightly to the front surface heating roller 61 and heated. Hence heat is applied from both sides at the fixing nip. By means of such heating from both sides, the full color images, not shown in the drawing, on the two sides of the transfer paper P are respectively subjected to heat and pressure, and thus fixed onto their respective sides.

The cleaning roller 65 comprises a metallic core 65*b* and an elastic layer 65*a* covering the metallic core 65*b*, and is disposed so as to rotate in the anti-clockwise direction of the drawing while contacting the front surface of the fixing belt 62 immediately after passing through the fixing nip. The elastic layer 65*a* has a rougher surface roughness Rz than that of the front surface of the fixing belt 62. The small amount of residual toner (offset toner and the like) adhered to the front surface of the fixing belt 62 after passing through the fixing nip is softened by the heating process, and is thus transferred from the front surface to the rougher surface of the cleaning roller 65. By means of this transfer, the toner adhered to the front surface of the fixing belt 62 is cleaned away. Note that the residual toner that is transferred to the surface of the cleaning roller 65 serving as cleaning means is removed by a cleaning blade, not shown in the drawing, which contacts the cleaning roller 65.

In the printer 100, the linear speed of the second intermediate transfer belt 16 in the second transfer unit 24 and the linear speed of the fixing belt 62 in the fixing device 60 are set to be equal.

In the printer 100 constituted as described above, the fixing belt 62 contacts the transfer paper P while performing a surface motion as the transfer paper P is conveyed toward the fixing device 60 by the second intermediate transfer belt 16 of the second transfer unit 24. The fixing belt 62 then guides the transfer paper P toward the fixing nip without scratching the first toner image on the first side of the transfer paper P. As a result, image disturbance caused by abrasion of the unfixed toner image can be suppressed.

The fixing belt 62 differs from the spur described in the aforementioned Japanese Unexamined Patent Application Publication H10-142869 in that even when toner staining occurs due to offset or the like, cleaning can be performed easily using known means such as the cleaning roller 65. Hence situations in which a subsequent sheet of transfer paper P is stained by toner adhered to a guiding member such as a spur or the fixing belt 62 can be prevented easily.

Furthermore, the rear surface heating means for heating the rear surface of the fixing belt 62 heat the belt member in a different position to the fixing nip rather than heating the fixing belt 62 at the rear side of the fixing nip. According to this constitution, there is no need to provide a heat source on the nip rear side roller 64 which serves as a nip rear side stretching member for supporting the rear surface of the belt member at the fixing nip. Hence a roller which forms a larger fixing nip by subjecting the thick elastic layer 64*a* to flexible elastic deformation may be used as the nip rear side roller 64. Moreover, the fixing device 60 is able to avoid the size increase and deterioration in energy efficiency that are caused when a member provided with a heat source is used as the nip rear side stretching member.

Further, by constituting the rear surface heating means so as to heat a rear surface region of the fixing belt 62 located after the position that is stretched by the lower side stretching roller 66, the following becomes possible. That is, the heat source of the fixing device 60 can be positioned further away from the second transfer unit 24, which serves as the double-sided transfer means, than in the case shown in FIG. 1, where the rear surface of the fixing belt 62 is heated at the aforementioned stretching position. As a result, the adverse effects on the image caused when the second transfer unit 24 is unintentionally heated by the fixing device 60 can be prevented.

Figure 6:
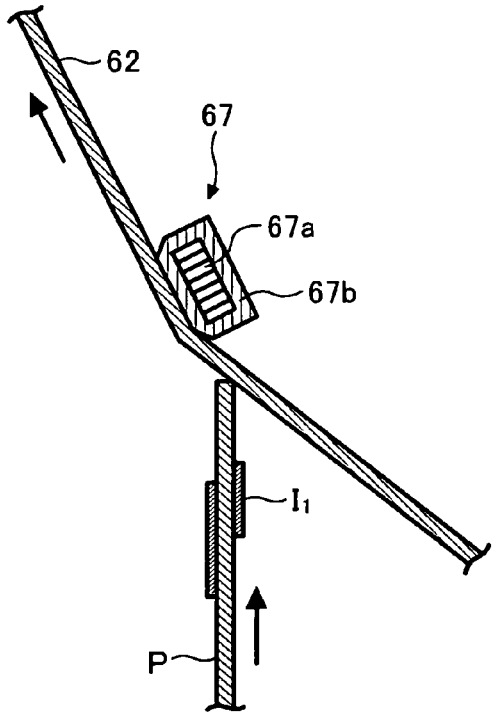
FIG. 6 is a sectional view showing the peripheral constitution of a rear surface heating element in the fixing device together with a sheet of transfer paper.

FIG. 6 shows an enlargement of the peripheral constitution of the rear surface heater 67 in the fixing device 60 together with the transfer paper P. As shown in the drawing, the rear surface heater 67 comprises a resistance heating element 67*a* constituted by Ag (gold)/Pd (palladium), $Ta_2N$, or the like, and a substrate 67*b* constituted by a material having high thermal conductivity and high electric resistivity, such as aluminum, which envelops the resistance heating element 67*a*. The resistance heating element 67*a* is formed with the material thereof molded into a striped form or a meandering belt form in the surface direction by screen deposition or the like. The resistance heating element 67*a* generates heat using power supplied by the rear surface heating power source described above, whereupon this heat is transferred to the rear surface of the fixing belt 62 by contact conduction via the substrate 67*b*. In other words, a contact heating system is employed whereby the rear surface heater 67 contacts the rear surface of the fixing belt 62. According to this constitution, the temperature of the fixing belt 62 can be raised using less energy than a case in which the rear surface of the fixing belt 62 is heated by radiation from a halogen lamp or the like. Moreover, the temperature of the belt rear surface can be raised more quickly than in a radiation system.

Figure 7:
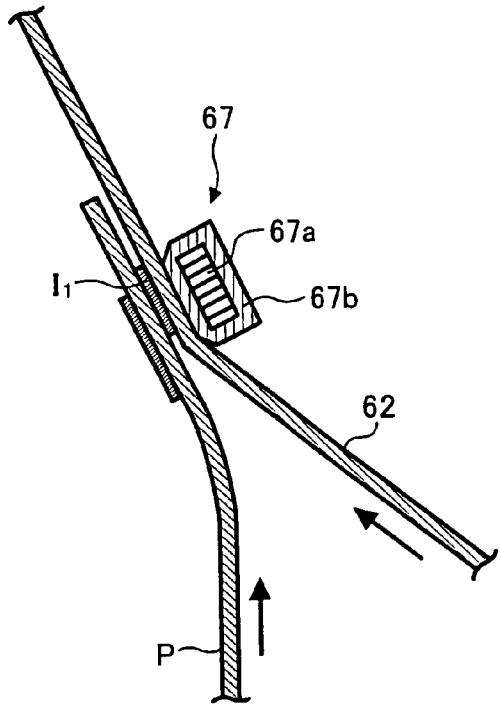
FIG. 7 is a sectional view illustrating a process whereby a first toner image transcribed onto a first side of the transfer paper is adhered to a fixing belt and then heated.

As shown in the drawing, the rear surface heater 67 is disposed so as to heat a region on the rear surface of the fixing belt located after the position in which the fixing belt contacts the transfer paper P conveyed from the second transfer unit (24 in FIG. 5) toward the fixing device (60 in FIG. 5). According to this constitution, as shown in FIG. 7, the fixing belt 62 is heated by the rear surface heater 67, which serves as a part of the rear surface heating means, after the tip end side of the transfer paper P is bent in accordance with the surface motion of the fixing belt 62, whereby a first toner image I1 on the first side of the transfer paper P is favorably adhered to the fixing belt 62. As a result, the first toner image I1 on the first side of the transfer paper P begins to soften through heating after being favorably adhered to the fixing belt 62.

Figure 8:
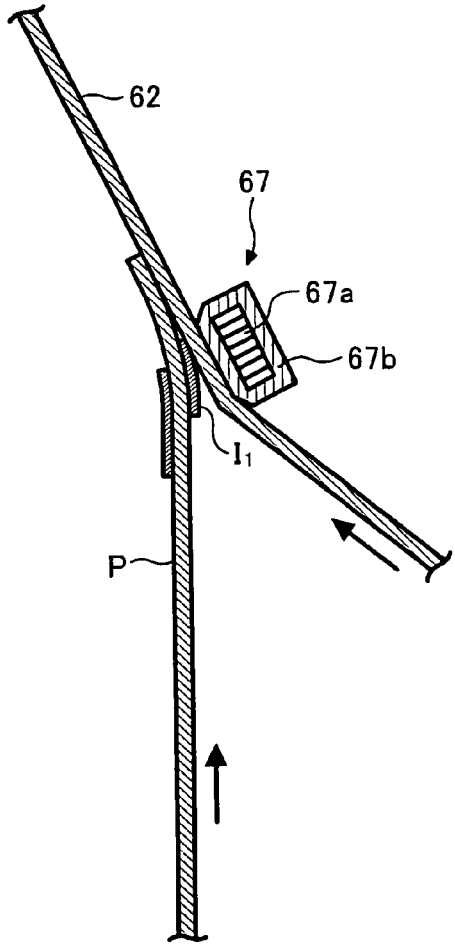
FIG. 8 is a sectional view illustrating a situation in which the first toner image transcribed onto the first side of the transfer paper is heated before being adhered to the fixing belt.

In FIG. 8, on the other hand, the rear surface heater 67 is disposed so as to heat a rear surface region of the fixing belt located before the position in which the fixing belt contacts the transfer paper P conveyed from the second transfer unit (24 in FIG. 5) toward the fixing device (60 in FIG. 5). In so doing, as shown in the drawing, the rear surface of the fixing belt 62 is heated before the first toner image I1 on the first side of the transfer paper P is sufficiently adhered to the front surface of the fixing belt 62. As a result, softening of the first toner image I1 is begun when the first toner image I1 is insufficiently adhered to the fixing belt 62, which may lead to disturbance of the first toner image I1 due to sagging and the like. Such disturbance is particularly likely to occur with the recent trend toward the use of toners with a high degree of circularity, such as polymerized toners, accompanying improvements in image quality.

Users of the printer 100 are instructed to use toners which satisfy all of the following conditions (a) to (d) as the Y, M, C, K toners used to form toner images.

(a) An average circularity of between 0.90 and 0.99.

(b) A shape factor SF-1 of between 120 and 180.

(c) A shape factor SF-2 of between 120 and 190.

(d) A particle size distribution (volume average particle diameter Dv/number average particle diameter Dn) of between 1.05 and 1.30.

As a method for instructing a user to use such a toner, a toner which satisfies all of the conditions (a) to (d) may be packaged and delivered together with the printer, for example. Alternatively, the product number or product name of the toner may be written on the printer main body or in the instruction manual, for example. As another example, the user may be informed of the product number or product name in the form of a letter, electronic data, or the like. Alternatively, the main body may be shipped as a set together with the aforementioned toner bottles BY, BC, BM, BK serving as toner storage means for storing the toner, for example. In the printer 100, all of these methods are employed, but it is sufficient to employ at least one of the methods.

The reason for prescribing a toner which satisfies the condition (a) will now be described. Namely, with toner having an average circularity of less than 0.90, or in other words toner which has more of an indeterminate form than a spherical form, the transfer quality deteriorates rapidly, and toner scattering during electrostatic transfer becomes far more likely. Further, when the average circularity is less than 0.90, it is difficult to form a high definition image having reproducibility of an appropriate concentration. When the average circularity exceeds 0.99, in a cleaning device which employs blade cleaning, cleaning defects occur in the cleaning subjects such as the photosensitive bodies and intermediate transfer belts, and hence images are more likely to become soiled. When an image with a comparatively low image area ratio is output, there is little residual toner, and hence cleaning defects rarely cause problems. However, in cases where an image with a high image area ratio, such as a color photograph, is output or an image remains on the photosensitive body without being transferred due to a paper feeding fault or the like, cleaning defects are particularly likely to occur.

Note that a more preferable average circularity range is between 0.93 and 0.97, and it is even more preferable that toner particles having a circularity of less than 0.94 comprise no more than 10% of the total.

The average circularity of the toner can be measured in the following manner. First, a suspension containing toner particles of the test subject toner is drawn through an imaging portion detection belt on a flat plate, whereby images of the particles are captured optically by a CCD camera. Then, a value obtained by dividing the circumference of an equivalent circle having an equal projected area by the circumference of the actual particle is determined for each individual particle image, and an average value thereof per ten thousand particles is calculated. This average value is the average circularity.

When measuring the average circularity in this manner, a flow-type particle image analyzer FPIA-2100 (manufactured by SYSMEX Corporation) or the like may be used, for example. When this device is used, between 0.1 and 0.5 ml of a surfactant, preferably alkylbenzene sulfonate, is added as a dispersing agent to between 100 and 150 [ml] of water in a container from which impure solids have been removed in advance, whereupon approximately 0.1 to 0.5 [g] of the test subject toner is added thereto. This suspension is then subjected to dispersion processing for approximately one to three minutes in an ultrasonic dispersing machine, whereby the concentration of the dispersed fluid is adjusted to between 3000 and 10,000 [particles/μl]. This fluid is then applied to the device described above to measure the shape and distribution of the toner.

Figure 9:
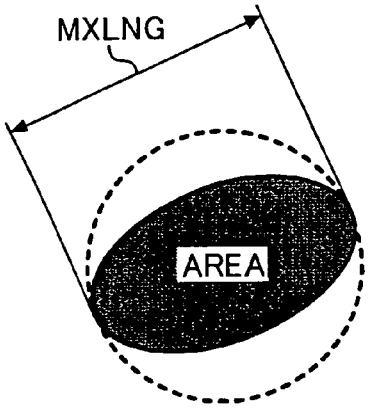
FIG. 9 is a pattern diagram illustrating a shape factor SF-1.

The reasons for prescribing a toner which satisfies the conditions (b) and (c) will now be described. The shape factor SF-1 and the shape factor SF-2 are one of the parameters expressing the shape of the toner, and in the field of particle technology, are used as a parameter for tightness. Here, the shape factor SF-1 is a value expressing the degree of roundness in a spherical substance such as a toner particle. As shown in FIG. 9, the shape factor SF-1 is a value obtained by dividing the square root of a length MXLNG of a maximum diameter location on an elliptical figure obtained by projecting a spherical substance onto a two-dimensional plane by the surface area AREA of the elliptical figure, and then multiplying this value by 100π/4. In short, the shape factor SF-1 can be expressed by the following equation (1). Note that a spherical substance having a shape factor SF-1 value of 100 is a perfect sphere, and the shape of the spherical substance becomes more indeterminate as the value of SF-1 increases.

$$\text{Shape factor SF-1}=\{(\text{MXLNG})^2/\text{AREA}\}\times(100\pi/4) \qquad \text{Eq. (1)}$$

Figure 10:
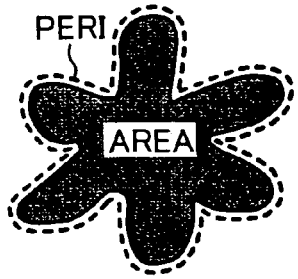
FIG. 10 is a pattern diagram illustrating a shape factor SF-2.

The shape factor SF-2 is a numerical value expressing the degree of unevenness on the surface of a spherical substance. As shown in FIG. 10, the shape factor SF-2 is a value obtained by dividing the square root of a perimeter PERI of a figure obtained by projecting the spherical substance onto a two-dimensional plane by the surface area AREA of the figure, and then multiplying this value by 100π/4. In short, the shape factor SF-2 can be expressed by the following equation (2). Note that a spherical substance having a shape factor SF-2 value of 100 has absolutely no unevenness on its surface. Unevenness on the surface of the spherical substance becomes more striking as the value of the shape factor SF-2 increases.

$$\text{Shape factor SF-2}=\{(\text{PERI})^2/\text{AREA}\}\times(100\pi/4) \qquad \text{Eq. (2)}$$

The inventor discovered through investigation that as the shape of the toner approaches a perfect sphere (as both SF-1 and SF-2 approach 100), the transfer efficiency increases. This is believed to be due to the fact that as the toner shape approaches a perfect sphere, the area of contact between a toner particle and an object which it touches (another toner particle, an image carrier, and so on) decreases, thus increasing the fluidity of the toner and weakening the adsorbability (mirroring capacity) thereof in relation to other objects. As a result, the toner is more easily influenced by the transfer electric field. According to research conducted by the inventor, the transfer efficiency begins to deteriorate rapidly when the shape factors SF-1 and SF-2 exceed 180 and 190 respectively.

It is to be noted, however, that as the shape of the toner approaches a perfect sphere, mechanical cleaning (blade cleaning or the like) becomes more difficult. This is believed to be due to the fact that as the fluidity of the toner increases, the toner becomes able to pass easily through slight gaps between the cleaning member and the cleaning subject. According to research conducted by the inventor, cleanability begins to deteriorate rapidly when the shape factors SF-1 and SF-2 fall below 120.

The shape factors SF-1 and SF-2 may be determined in the following manner. Using an FE-SEM (S-800), manufactured by Hitachi Ltd., 100 toner particles are selected at random, and images thereof are captured in sequence. The resulting image information is introduced into an image analyzer (LUSEX3), manufactured by Nireco Corporation, to determine MXLNG, AREA, and PERI. The shape factors SF-1, SF-2 are then calculated as an average value of 100 of the shape factors obtained according to the equations described above.

The reasons for prescribing a toner which satisfies the condition (d) will now be described. The particle size distribution (volume average particle diameter Dv/number average particle diameter Dn) is a parameter for expressing the particle size distribution of the toner. With a dry toner in which volume average particle diameter Dv/number average particle diameter Dn is between 1.05 and 1.30, or preferably between 1.10 and 1.25, the particle size distribution of the toner is narrow, producing various merits.

For example, when using a powder toner in which the volume average particle diameter Dv is between 4 and 8 [μm] and the volume average particle diameter Dv/number average particle diameter Dn is between 1.05 and 1.30, the following merits are produced. Namely, a phenomenon whereby toner particles having a particle diameter which is suited to the formation of electrostatic latent image patterns contribute to development ahead of other toner particles can be promoted easily, and hence images of various patterns can be formed with stability. Further, when employing a device constitution whereby residual toner on an image carrier such as a photosensitive body is collected and recycled, small toner particles, which are difficult to use in a transfer operation, can be recycled in large amounts. If a toner with a comparatively large particle size distribution is used in such a recycling operation, variation in the toner size from a refill of new toner to the next toner refill is great, thus adversely affecting the development performance.

If toner with a smaller volume average particle diameter Dv than that of the range described above is used as a two-component developer, then toner becomes adhered to the surface of the carrier during prolonged mixing in the developing device, causing the charging capacity of the carrier to deteriorate. When used as a single-component developer, toner filming on the developing roller and toner adhesion to a member such as a blade for thinning the toner layer become likely to occur. Conversely, when the volume average particle diameter Dv is greater than the above range, it becomes difficult to obtain high-resolution, high-quality images, and variation in the particle diameter of the toner often increases when the toner within the developer is balanced.

The particle size distribution of the toner may be measured using a measurement device which works on a Coulter counter method, for example the Coulter Counter TA-II or the Coulter Multisizer II (both manufactured by Beckman Coulter Inc.). Specifically, first between 0.1 and 5 ml of a surfactant (preferably alkylbenzene sulfonate) is added as a dispersing agent to between 100 and 150 [ml] of an electrolytic aqueous solution. As the electrolytic aqueous solution, an aqueous 1% by weight NaCl solution of first-grade sodium chloride, for example ISOTON-II (manufactured by Beckman Coulter Inc.) may be used. Then, between 2 and 20 mg of a measurement sample are added to the obtained solution. The resulting solution is then subjected to dispersing processing for about 1–3 minutes in an ultrasonic dispersing machine, whereupon the measurement device described above measures the volume of the toner and the number of toner particles using a 100 μm aperture, and thus calculates the volume distribution and number distribution thereof. The volume average particle diameter Dv and number average particle diameter Dn of the toner may be determined from the obtained distributions.

Note that thirteen channels are used, namely: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm, and hence toner having toner particles with a particle diameter of no less than 2.00 μm and less than 40.30 μm is used as a subject. Note that both Dv and Dn are averages per ten thousand.

Figure 11:
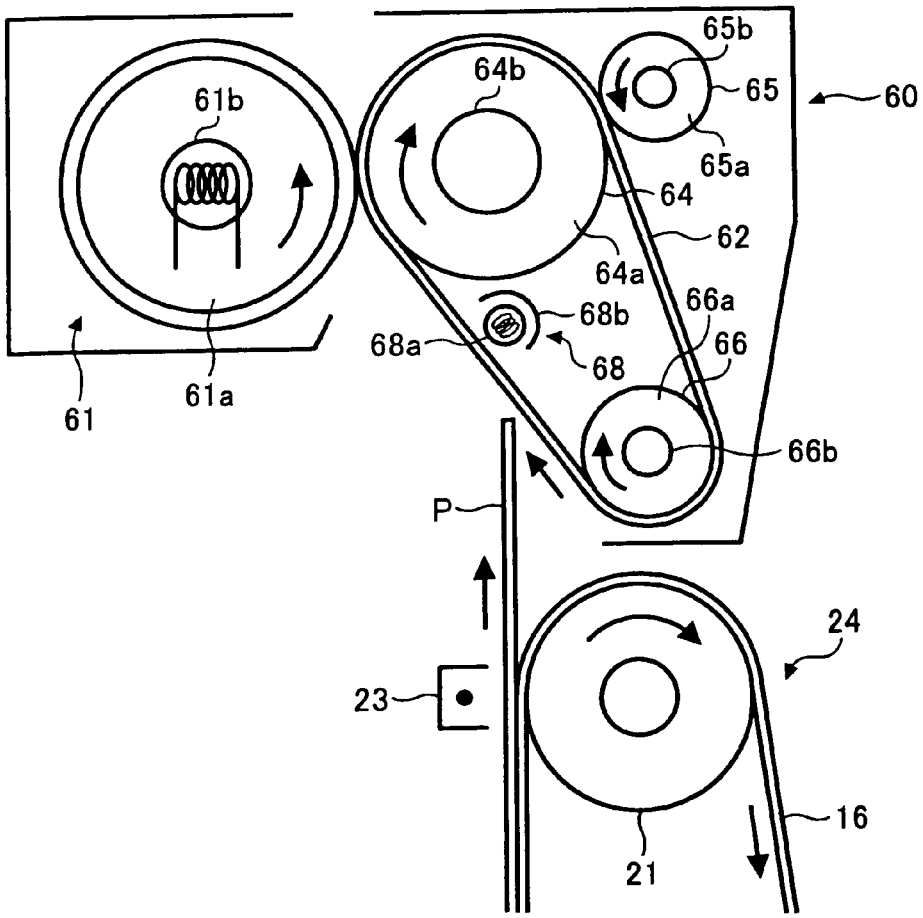
FIG. 11 is a diagram showing the constitution of a fixing device according to a first modification of the first embodiment together with a part of the constitution of a second transfer unit.

FIG. 11 shows an enlargement of the fixing device 60 according to a first modification of the printer 100 together with a part of the constitution of the second transfer unit 24. The fixing device 60 of the first modification uses rear surface heating means which heat the rear surface of the fixing belt 62 in a state of non-contact using a halogen lamp 68*a* serving as a light emitting heating element, rather than heating the rear surface of the fixing belt 62 by having the rear surface heater contact the rear surface. More specifically, the rear surface heating means comprise a rear surface heater 68 provided with the halogen lamp 68*a* and a reflector 68*b* for reflecting the light from the halogen lamp 68*a* toward the rear surface of the fixing belt 62. A rear surface heating power source, not shown in the drawing, for supplying the halogen lamp 68*a* with a voltage, a rear surface temperature detection sensor, not shown in the drawing, for detecting the rear surface temperature of the fixing belt 62, a rear surface heating control circuit for ON/OFF controlling the power source on the basis of the detection result of the rear surface temperature detection sensor, and so on are also provided in the rear surface heating means. Similarly to the rear surface heater 67 of the printer 100 according to the first embodiment, the rear surface heater 68 heats a region of the entire rear surface of the fixing belt 62 in the circumferential direction thereof which is located between the point where the fixing belt 62 passes a position in which it is stretched by the lower side stretching roller 66, and the point where the belt reaches the aforementioned fixing nip.

In this first modification, using the fixing device 60 having the constitution described above, the rear surface heating means heat the rear surface of the fixing belt 62 in a state of non-contact, and hence wear to the fixing belt 62 caused by the rear surface heater scratching the rear surface can be avoided.

Figure 12:
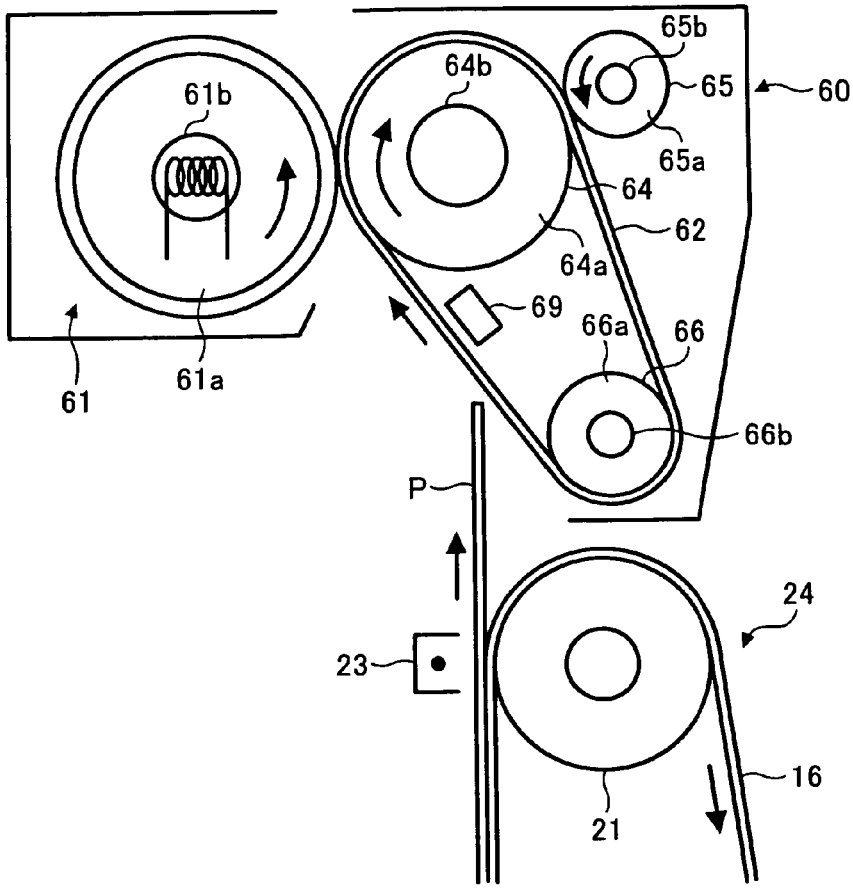
FIG. 12 is a diagram showing the constitution of a fixing device according to a second modification of the first embodiment together with a part of the constitution of a second transfer unit.

FIG. 12 shows an enlargement of the fixing device 60 according to a second modification of the printer 100, together with a part of the constitution of the second transfer unit 24. The fixing device 60 of this second modification uses rear surface heating means which heat the fixing belt 62 from the rear surface side using a magnetic field generated by magnetic field generating means 69. More specifically, the rear surface heating means comprise the magnetic field generating means 69 which are provided with a ferromagnetic body, a coil that is wrapped around the ferromagnetic body, and so on, none of which are shown in the drawing. The magnetic field generating means 69 are disposed so as to face, through a predetermined gap, a region of the entire rear surface of the fixing belt 62 in the circumferential direction thereof located between the point where the fixing belt 62 passes a position in which it is stretched by the lower side stretching roller 66, and the point where the belt reaches the aforementioned fixing nip. The rear surface heating means also comprise a rear surface heating power source, not shown in the drawing, for supplying the coil with a voltage, a rear surface temperature detection sensor for detecting the rear surface temperature of the fixing belt 62, a rear surface heating control circuit for ON/OFF controlling the power source on the basis of the detection result of the rear surface temperature detection sensor, and so on.

Figure 13:
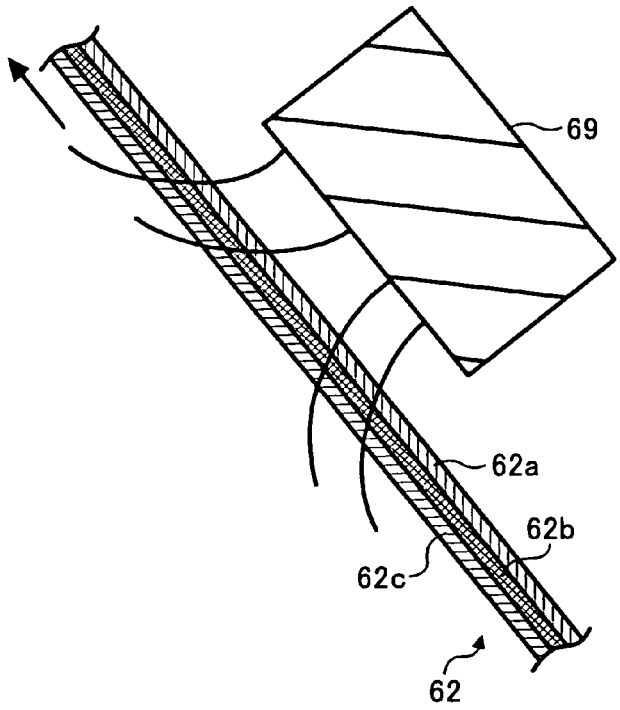
FIG. 13 is a sectional view showing magnetic field generating means and a fixing belt in the second modification.

Meanwhile, the fixing belt 62 has a three-layer constitution, as shown in FIG. 13. This three-layer constitution comprises a base material layer 62*a* provided on the rear surface, a heat-generating layer 62*b* which is coated onto the front side of the base material layer 62*a* and serves as a heat generator formed from a metallic material such as aluminum or copper, and a release promoting layer 62*c* coated onto the front surface side of the heat-generating layer 62*b* and formed from PTFE, PFA, or the like. When power is supplied from the rear surface heating power source to the coil of the magnetic field generating means 69, a magnetic field is generated between the magnetic field generating means 69 and the fixing belt 62. The heat-generating layer 62*b* of the fixing belt 62 generates heat by means of electromagnetic induction through the magnetic field. The fixing belt 62 is heated by the heat that is generated in the heat-generating layer 62*b* as a result of the electromagnetic induction through the magnetic field generated by the magnetic field generating means 69.

Likewise in the second modification constituted as described above, the fixing belt 62 can be heated from the rear surface side in a state of non-contact. Moreover, the temperature of the fixing belt 62 can be raised using less energy than when heating is performed using a radiation system, and the temperature of the belt rear surface can be raised more quickly. Hence, wear to the fixing belt 62 caused when the rear surface heater scratches the rear surface can be avoided, and in comparison with a case in which heating is performed using a radiation system, the temperature of the fixing belt 62 can be raised using less energy, and the temperature of the belt rear surface can be raised more quickly.

It is to be noted that although in the above-described first embodiment and each modification thereof, examples were described in which intermediate transfer belts which perform an endless motion while stretching a plurality of rollers are used as the first intermediate transfer body and second intermediate transfer body respectively, the first and second intermediate transfer bodies may take another form such as a roller or drum. However, using intermediate transfer belts has the following advantages. By stretching one of the belts into a shape whereby the belt is wound onto a part that is stretched by a stretching member of the other belt, as in the secondary fixing nip shown in FIG. 2, the secondary fixing nip can be formed with a considerable length. As a result, it is possible to secure a long time period during which the four-color toner image contacts the transfer paper P or second intermediate transfer belt 16, thus enabling an increase in the linear speed of the process and a reduction in the image forming time. Moreover, the two belts can be disposed in various stretched forms, enabling better layout design freedom within the main body than a case in which a roller or drum-form intermediate transfer body is used.

Also, examples were described in which drum-form photosensitive bodies are used as image carriers, but belt-form photosensitive bodies and other systems may be used. This embodiment may also be applied to an image forming apparatus using a liquid developer containing toner and a liquid carrier instead of a particulate toner.

Further, the printer 100 was described as employing electrostatic transfer for each of the primary transfer, secondary transfer, and tertiary transfer, but this embodiment may also be applied to an image forming apparatus which performs at least one of these transfer processes by heating transfer. Note that heating transfer is a system in which a transfer source such as the first intermediate transfer body or the like and a transfer destination such as the second intermediate transfer body or the like are adhered together through heating, thus softening the toner image, whereupon the two bodies are separated such that the toner image is transferred from the transfer source to the transfer destination.

The embodiment and modifications thereof described above have the following features.

(1) The cleaning roller 65 is provided in the fixing device 60 as cleaning means for cleaning the fixing belt 62 after passing through the fixing nip and before contacting the transfer paper P. Thus situations in which a subsequent sheet of the transfer paper P is stained by toner adhered to a guiding member such as a spur or the fixing belt 62 can be prevented easily.

(2) The rear surface heating means of the fixing device 60 are constituted to heat a region of the belt after contacting the transfer paper P, and hence, as described above, image disturbance caused when softening of the first toner image I1 on the transfer paper P is begun while the transfer paper P is insufficiently adhered to the fixing belt 62 can be suppressed.

(3) Means which cause the rear surface heater 67 to contact the rear surface of the fixing belt are used as the rear surface heating means, and hence the temperature of the fixing belt 62 can be raised using less energy and more quickly than a case in which the rear surface of the fixing belt 62 is heated using radiation.

(4) Means which heat the rear surface of the belt in a state of non-contact using the halogen lamp 68*a* as a light emitting heating element are used as the rear surface heating means, and hence wear to the fixing belt 62 caused by the rear surface heater scratching the rear surface can be avoided.

(5) Means which heat the rear surface of the fixing belt 62 by causing the heat-generating layer 62*b* of the fixing belt 62 to generate heat by electromagnetic conduction through a magnetic field generated by the magnetic field generating means 69 are used as the rear surface heating means, and hence wear to the fixing belt 62 caused when the rear surface heater scratches the rear surface can be avoided, and in comparison with a case in which heating is performed using a radiation system, the temperature of the fixing belt 62 can be raised using less energy, and the temperature of the belt rear surface can be raised more quickly.

(6) Toner having an average circularity of between 0.90 and 0.99 is prescribed for use as the toner for forming the toner images. As a result, high-quality images exhibiting little toner scattering can be formed at a stable electrostatic transfer ratio, thus suppressing cases of insufficient transfer.

(7) Toner having a shape factor SF-1 of between 120 and 180 is prescribed for use as the toner for forming the toner images, and hence high-quality images in which insufficient transfer and toner scattering are suppressed can be formed.

(8) Toner having a shape factor SF-2 of between 120 and 190 is prescribed for use as the toner for forming the toner images, and hence high-quality images in which insufficient transfer and toner scattering are even further suppressed can be formed.

(9) Toner having a value obtained by dividing the volume average particle diameter Dv by the number average particle diameter Dn of between 1.05 and 1.30 is prescribed for use as the toner for forming the toner images, and hence high-quality images developed with a stable developing performance can be formed.

Second Embodiment

An electrophotographic printer (to be referred to simply as "printer" hereinafter) serving as an image forming apparatus to which this embodiment is applied will now be described.

First, the basic constitution of this printer 300 will be described.

Figure 14:
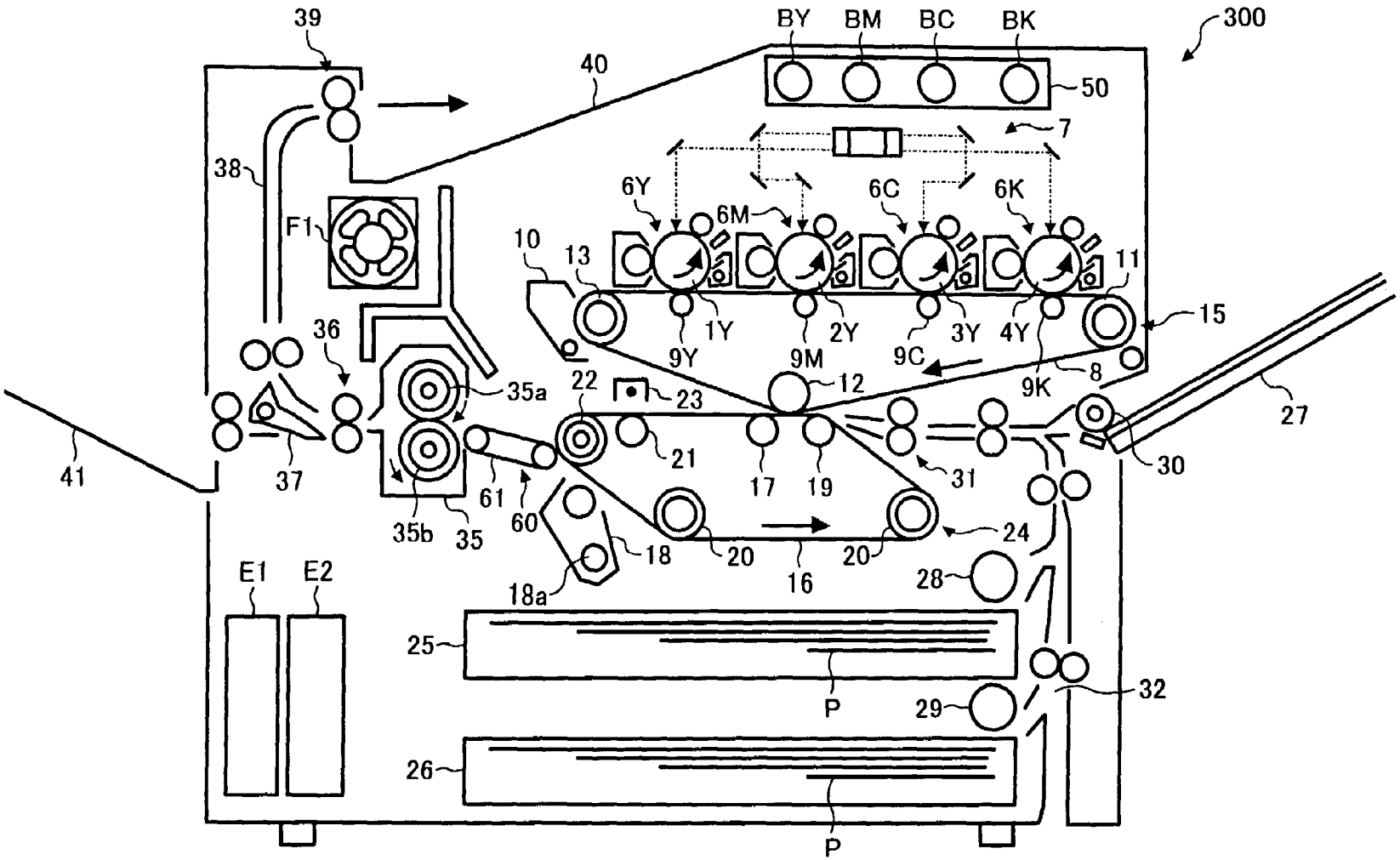
FIG. 14 is a diagram showing the schematic constitution of a printer serving as an image forming apparatus according to a second embodiment of the present invention.

FIG. 14 shows the schematic constitution of the printer 300 from a front surface direction. As shown in the drawing, the printer 300 comprises four process cartridges 6Y, M, C, K for generating toner images in yellow, magenta, cyan, and black (to be indicated as Y, M, C, K hereinafter). These process cartridges 6Y, M, C, K use toner of the different colors Y, M, C, K as image forming substances, but are otherwise constituted identically, and are exchanged at the end of their lifetimes.

Figure 15:
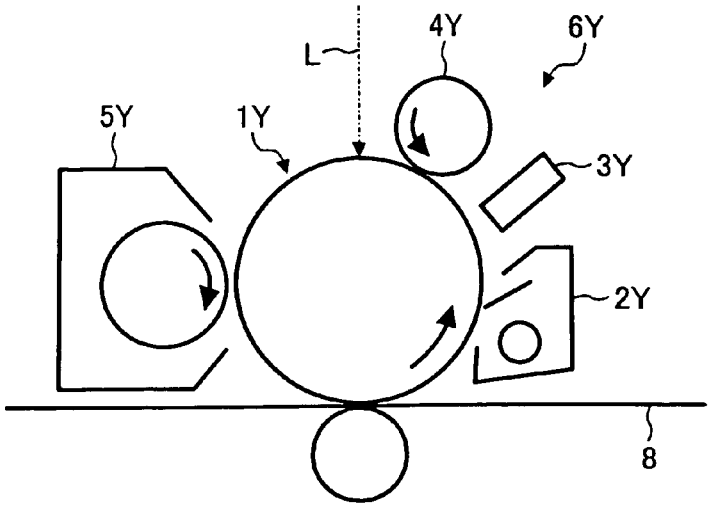
FIG. 15 is a diagram showing the constitution of a Y processing unit of the printer.

As shown in FIG. 15, using the process cartridge 6Y for generating a Y toner image as an example, the process cartridge 6Y comprises a drum-form photosensitive body 1Y serving as an image carrier, a drum cleaning device 2Y, an antistatic device 3Y, a charging device 4Y, a developing device 5Y, and so on. The photosensitive body 1Y comprises an aluminum cylinder with a diameter of between 30 and 100 [mm], coated with a surface layer formed from an organic semiconductor which serves as a photoconductive substance. The aluminum cylinder may be coated with an amorphous silicon surface layer. Also, the photosensitive body 1Y may take a belt form rather than a drum form. The charging device 4Y uniformly charges the surface of the photosensitive body 1Y which is rotated in the anti-clockwise direction of the drawing by driving means not shown in the drawing. The surface of the uniformly charged photosensitive body 1Y is then subjected to exposure scanning using laser light L emitted from an exposure device 7 to be described below, and thus carries a Y electrostatic latent image. This Y electrostatic latent image is developed into a Y toner image by the developing device 5Y which uses Y toner.

The process cartridge 6Y constituted as described above implements an image forming process together with the exposure device 7 to form a toner image on the surface of the photosensitive body 1Y serving as an image carrier. Accordingly, in the printer 300, each process cartridge 6Y, M, C, K functions in combination with the exposure device 7 as visible image forming means for forming a toner image on the surface of an image carrier.

The Y toner image that is developed on the photosensitive body 1Y is subjected to a primary transfer onto a first intermediate transfer belt 8 to be described below. The drum cleaning device 2Y removes toner remaining on the surface of the photosensitive body 1Y after the primary transfer process is complete. The antistatic device 3Y neutralizes the residual electric charge of the photosensitive body 1Y following cleaning. The surface of the photosensitive body 1Y is initialized by this neutralization, and thus prepared for the next image forming process. M, C, and K toner images are formed similarly on the photosensitive bodies 1M, C, K in the other process cartridges 6M, C, K, whereupon the toner images are subjected to the primary transfer onto the first intermediate transfer belt 8. It is to be noted that the developing devices (5Y and so on) may use either a two-component developer containing a toner and a magnetic carrier or toner particles alone.

As shown in FIG. 14, the exposure device 7 is disposed above the process cartridges 6Y, M, C, K in the drawing. An image data processing device E1 is disposed in the lower left of the drawing within the housing of the printer 300. The image data processing device E1 generates an exposure scanning control signal based on an image information signal transmitted from a personal computer or the like, and transmits this exposure scanning control signal to the exposure device 7. The exposure device 7, which serves as latent image forming means, irradiates the photosensitive bodies 1Y, M, C, K in the respective process cartridges 6Y, M, C, K with laser light L which is emitted on the basis of the exposure scanning control signal. Thus Y, M, C, and K electrostatic latent images are formed on the photosensitive bodies 1Y, M, C, K that have been exposed to this irradiation.

The exposure device 7 irradiates the photosensitive bodies with the laser light L emitted from a light source via a plurality of optical lenses and mirrors while scanning the photosensitive bodies with a polygon mirror that is driven to rotate by a motor. Instead of the exposure device 7 constituted in this manner, however, exposure means which emit LED light from an LED array may be employed.

A first paper cassette 25 having a first feed roller 28 and a second paper cassette 26 having a second feed roller 29 are disposed inside the housing of the printer 300 in the lower portion of the drawing so as to be arranged in series in the vertical direction. These cassettes store in their respective interiors transfer paper P serving as a recording medium in stacks consisting of a plurality of sheets of transfer paper piled one on top of the other. A manual feed tray 27 having a manual feed roller 30 is provided on the right-hand surface cover of the printer housing, and another stack of transfer paper is placed thereon.

A feeding path 32 having a pair of resist rollers 31 and a plurality of pairs of conveyance rollers is disposed between the two paper cassettes 25, 26 and the manual feed tray 27. The first feed roller 28 and second feed roller 29 contact the top sheet of transfer paper P of the stacks of transfer paper stored in the first paper cassette 25 and second paper cassette 26 respectively. The first feed roller 28 and second feed roller 29 are driven to rotate by driving means not shown in the drawing, and thus feed the top sheet of the transfer paper P toward the feeding path 32. The fed transfer paper P is sandwiched between the rollers of the resist roller pair 31 disposed near the end of the feeding path 32. The pair of resist rollers 31 is driven to rotate in a forward direction in order to trap the transfer paper P, and once the recording medium has been trapped between the rollers, the two rollers immediately stop rotating. Rotation is resumed at an appropriate timing, whereby the transfer paper P is fed toward a secondary transfer nip to be described below. Thus the pair of resist rollers 31 functions as a pair of timing rollers.

The manual feed roller 30 contacts the top sheet of transfer paper P on the stack of transfer paper placed on the manual feed tray 27. The manual feed roller 30 is then driven to rotate by driving means not shown in the drawing, and thus feeds the top sheet of the transfer paper P toward the feeding path 32. This fed transfer paper P is likewise conveyed toward the secondary transfer nip after being sandwiched between the rollers of the resist roller pair 31.

The Y, M, C, and K electrostatic latent images formed on the photosensitive bodies 1Y, M, C, K are obtained in a transfer process performed by double-sided transfer means. The double-sided transfer means comprise a first transfer unit 15 and a second transfer unit 24.

The first transfer unit 15 is disposed below the process cartridges 6Y, M, C, K in the drawing, and comprises the first intermediate transfer belt 8, four primary transfer rollers 9Y, M, C, K, a first cleaning device 10, and so on. The first transfer unit 15 also comprises a driving roller 11, a secondary transfer backup roller 12, a first cleaning backup roller 13, and so on. The first intermediate transfer belt 8, which serves as a first intermediate transfer body, is stretched across the seven rollers, and is caused to perform an endless motion in the clockwise direction of the drawing by driving the driving roller to rotate. The endlessly moving first intermediate transfer belt 8 is sandwiched between the four primary transfer rollers 9Y, M, C, K serving as transfer bias members and the photosensitive bodies 1Y, M, C, K, and thus the four primary transfer rollers 9Y, M, C, K each form a primary transfer nip. A primary transfer bias having a reverse polarity to the toner (plus, for example) is then applied by a power source not shown in the drawing. The three rollers described above other than the four primary transfer rollers 9Y, M, C, K are all electrically grounded.

The first intermediate transfer belt 8 gradually passes between the Y, M, C, K primary transfer nips as it moves endlessly. At each of the primary transfer nips, the Y, M, C, K toner images on the photosensitive bodies 1Y, M, C, K receive nip pressure and the effect of the primary transfer bias, and are thus subjected to a composite primary transfer onto the front surface (the outer surface of the loop) of the intermediate transfer belt 8. As a result, a toner image combining four colors (to be referred to as a four-color toner image hereinafter) is formed on the first intermediate transfer belt 8. The secondary transfer backup roller 12 over which the first intermediate transfer belt 8 is stretched is disposed so as to intrude on a second intermediate transfer belt 16 to be described below. This intruding position enables the first intermediate transfer belt 8 and second intermediate transfer belt 16 to form a secondary transfer nip at which the first intermediate transfer belt 8 and second intermediate transfer belt 16 contact each other over a wide area in their respective circumferential directions. At this secondary transfer nip, the respective surfaces of the first intermediate transfer belt 8 and second intermediate transfer belt 16 contact each other while moving in the same direction. The four-color toner image, which is a visible image formed on the first intermediate transfer belt 8, is subjected to a secondary transfer onto the second intermediate transfer belt 16 or the transfer paper P at the secondary transfer nip.

It should be noted that instead of the four primary transfer rollers 9Y, M, C, K of the bias application system, a charger system in which electricity is discharged from an electrode may be employed. Further, the first intermediate transfer belt 8 is an endless belt having rubber as a base substance and regulated to an electric resistance value which is suitable for performing electrostatic transfer of the toner images from the photosensitive bodies 1Y, M, C, K. A two-layer constitution comprising a resin film layer (a polyimide layer, for example) and a rubber layer (a urethane rubber layer, for example), or a multi-layer constitution comprising further layers may be employed in the first intermediate transfer belt 8. The surface hardness of the first intermediate transfer belt 8 is preferably no more than 65 [degrees], and in this printer 300, the first intermediate transfer belt 8 has a JIS-A hardness of 50 [degrees].

Residual toner not subjected to the secondary transfer onto the second intermediate transfer belt 16 or transfer paper P remains adhered to the first intermediate transfer belt 8 after passing through the secondary transfer nip. This toner is cleaned away by the first cleaning device 10. More specifically, the first intermediate transfer belt 8 is sandwiched between the first cleaning device 10, which is disposed so as to contact the front surface side thereof, and the first cleaning backup roller 13, which is disposed on the rear surface thereof. The residual toner on the front surface is removed by the first cleaning device 10 mechanically or electrostatically, and thus the first intermediate transfer belt 8 is cleaned.

The second transfer unit 24 of the double-sided transfer means is disposed below the first transfer unit 15 in the drawing, and comprises the second intermediate transfer belt 16, a second cleaning device 18, a tertiary transfer charger 23, and so on. The second transfer unit 24 also comprises a secondary transfer roller 17, a nip enlarging roller 19, two tension rollers 20, a tertiary transfer backup roller 21, a driving roller 22, and so on. The second intermediate transfer belt 16 is stretched across these six rollers, and is caused to perform an endless motion in the anti-clockwise direction of the drawing by driving the driving roller 22 to rotate.

The secondary transfer backup roller 12 of the first transfer unit 15 intrudes on a stretched part of the second intermediate transfer belt 16 between the secondary transfer roller 17 and the nip enlarging roller 19 to form the secondary transfer nip. The secondary transfer roller 17, which serves as a transfer bias member, is a metallic roller or a roller with a metallic core covered with a conductive rubber layer, and is supplied with a secondary transfer bias having a reverse polarity to the toner (plus polarity, for example) by a power source not shown in the drawing. All of the other rollers in the second transfer unit 24 are grounded.

The pair of resist rollers 31 described above feeds the transfer paper P sandwiched between the rollers toward the secondary transfer nip at a timing which enables the transfer paper P to be adhered to the four-color toner image subjected to the primary transfer onto the first intermediate transfer belt 8. Note, however, that when the four-color toner image is a first toner image to be transcribed onto a first side of the transfer paper P (the side facing upward on an upper face stacking portion 40 to be described below), the transfer paper P is not fed. Hence, at this time the first toner image on the first intermediate transfer belt 8 receives the nip pressure of the secondary transfer nip and the action of the secondary transfer bias, and is thus subjected to a secondary transfer onto the second intermediate transfer belt 16. Conversely, when the four-color toner image on the first intermediate transfer belt 8 is a second toner image to be transcribed onto a second side of the transfer paper P (the side which faces downward on the upper face stacking portion 40), the pair of resist rollers 31 feeds the transfer paper P in synchronization with the second toner image. As a result, the second toner image is subjected to a secondary transfer onto the second side of the transfer paper P at the secondary transfer nip to produce a full color image combined with the white of the transfer paper P. At this time, the first toner image that was transcribed onto the second intermediate transfer belt 16 in advance is adhered synchronously to the first side of the transfer paper P which has been fed into the secondary transfer nip. Note, however, that the first toner image is attracted to the second intermediate transfer belt 16 side by the action of the secondary transfer bias, and hence although the first toner image becomes adhered to the first side of the transfer paper P, it is not transcribed thereon.

In the first transfer unit 15, the secondary transfer backup roller 12 stretches the first intermediate transfer belt 8 so as to protrude downward in the drawing, and presses the first intermediate transfer belt 8 against the second intermediate transfer belt 16, thus forming the secondary transfer nip. At the outlet from the secondary transfer nip, the first intermediate transfer belt 8 is removed from the transfer paper P such that the transfer paper P is carried and conveyed on the surface of the second intermediate transfer belt 16 alone. In the secondary transfer unit 24, the transfer paper P is conveyed to a tertiary transfer portion with the endless motion of the second intermediate transfer belt 16. At this tertiary transfer portion, the transfer charger 23 faces the portion of the second intermediate transfer belt 16 that is stretched by the tertiary transfer backup roller 21 with a predetermined gap therebetween. A charge having a reverse polarity to the toner (plus polarity, for example) is then applied to the second side of the transfer paper P on the second intermediate transfer belt 16. As a result, the first toner image that is sandwiched between the first side of the transfer paper P and the second intermediate transfer belt 16 is subjected to a tertiary transfer onto the first side of the transfer paper P to produce a full color image.

Note that the second intermediate transfer belt 16 is an endless belt having resin (polyimide, for example) with a thickness of approximately 50 to 600 [μm] as a base substance, and is regulated to an electric resistance value which is suitable for performing the secondary transfer of the toner image from the first intermediate transfer belt 8.

As described above, the double-sided transfer means comprising the two transfer units 15, 24 perform a first stage transfer on the transfer paper P to transcribe the second toner image onto the second side at the secondary transfer nip, and then perform a second stage transfer to transcribe the first toner image onto the first side at the tertiary transfer portion. Note that instead of the rollers 9, 17, an object having a different form, such as a brush, may be used as the member to which the primary transfer bias and secondary transfer bias are applied. Furthermore, instead of the electrostatic transfer system whereby a transfer bias is applied to a member, a non-contact discharge method may be employed.

Meanwhile, the second intermediate transfer belt 16, having passed through the tertiary transfer portion, is sandwiched between the backup roller 21 and the second cleaning device 18 so that residual toner on the surface can be cleaned mechanically or electrostatically. If the second cleaning device 18 contacts the second intermediate transfer belt 16 at all times, then the first toner image subjected to the secondary transfer onto the second intermediate transfer belt 16 will also be cleaned. Hence the second cleaning device 18 is designed to contact and separate from the second intermediate transfer belt 16 by having a rocking mechanism, not shown in the drawing, rock the second cleaning device 18 in the direction of the arrow in the drawing about a rocking shaft 18*a*. The second cleaning device 18 is removed from the second intermediate transfer belt 16 at least while the first toner image passes through the cleaning position, and thus cleaning of the first toner image is avoided.

Having completed the double-sided transfer process with the tertiary transfer, the transfer paper P is conveyed through a conveyance unit 60 to a fixing device 35. The transfer paper P is then trapped in a fixing nip formed by two fixing rollers 35*a*, 35*b* which contact each other and are driven to rotate in a surface motion in the same direction at the contacting part. The fixing rollers 35*a, b* each envelop a heat source such as a halogen lamp, not shown in the drawing, and thus the transfer paper P trapped in the fixing nip is heated from both sides. As a result of this heating and the pressure of the nip, full color images are adhered to the two sides of the transfer paper P. Thus the fixing device 35 serving as fixing means implements a fixing process whereby the toner images transcribed onto the two sides of the transfer paper P, which serves as a recording medium, are fixed to each side.

After the full color images have been subjected to fixing processing onto both sides of the transfer paper P, the transfer paper P is passed between the rollers of a transit roller pair 36 to reach a position of contact with a dividing claw 37. The dividing claw 37 serves to switch a discharge path of the transfer paper P between a vertical discharge path and a horizontal discharge path. When the discharge path is set to the vertical discharge path by the dividing claw 37, the transfer paper P, having passed through the transit roller pair 36, moves along a reverse guide member 38 and is thus reversed. The transfer paper P is then discharged toward the upper face stacking portion 40 provided on the upper surface of the housing of the printer 300, and stacked. If, on the other hand, the discharge path is set to the horizontal discharge path by the dividing claw, the transfer paper P passes through the transit roller pair 36, and is then discharged and stacked on a discharge tray 41, which is disposed on the left side surface of the printer housing so as to be capable of opening and closing.

Thus in the printer 300, the transfer paper P is conveyed downstream from the secondary transfer nip in the movement direction of the belt, whereupon transfer processing is implemented on the transfer paper P to transcribe toner images onto both sides of the transfer paper P using the double-sided transfer means. Thus image formation can be performed on both sides of the transfer paper P using a one-pass system. Since the transfer paper P does not contact the photosensitive bodies 1Y, M, C, K serving as image carriers directly, the amount of paper particles becoming adhered to the photosensitive bodies can be suppressed.

It is to be noted that the system used in the printer 300, whereby a plurality of image carriers such as photosensitive bodies are arranged in series and visible images formed respectively thereby are transferred sequentially to form a composite image such as a multi-color image, is known as a tandem system. In an alternative system, a composite image is formed by repeating a composite transfer process whereby a visible image is formed on a single image carrier and transcribed onto an intermediate transfer body, and then another visible image is formed on the image carrier and transferred onto the intermediate transfer body. In this system, the processes of forming and transferring a visible image must be performed repeatedly, whereas in the tandem system, a plurality of visible images to be transferred sequentially are formed substantially simultaneously on image carriers corresponding to the respective visible images, and hence the time required for image formation can be reduced greatly.

As described above, the first toner image is formed ahead of the second toner image. Then, following the secondary transfer from the first intermediate transfer belt 8 onto the second intermediate transfer belt 16 at the secondary transfer nip, the tertiary transfer is performed onto the first side (the side facing upward on the upper face stacking portion 40) of the transfer paper at the tertiary transfer portion. Hence, the transfer paper P is stacked sequentially on the upper face stacking portion 40 such that the first toner image, which is formed in advance, faces upward, and the second toner image formed on the next sheet of transfer paper P lies on top of the first toner image of the previous sheet.

To ensure that the page numbers of the sheets of transfer paper P that are gradually stacked in this manner are stacked in order from the lowest page number, the printer 300 forms the image corresponding to the higher page number of a consecutive odd and even number in advance as the first toner image. For example, the image on the second page is formed as the first toner image ahead of the image on the first page. In so doing, a document having several pages that are outputted consecutively can be stacked on the upper face stacking portion 40 in order from the lowest page number. Note, however, that when a single-sided print mode is executed to form an image on only the second side of the transfer paper P, images are formed in order from the lowest page number, and the secondary transfer is performed onto the second side of each sheet of transfer paper P. In so doing, the transfer paper P can be stacked on the upper face stacking portion 40 in order from the lowest page number likewise in the single-sided print mode.

The color toner images formed on the four photosensitive bodies 1Y, M, C, K as the second toner image are formed as non-mirror images (to be referred to as "normal images" hereinafter). This is because each of the formed color toner images changes to a mirror image and then to a normal image in the double transfer process, comprising the primary transfer and secondary transfer, to reach the transfer paper P. Since the color toner images are formed as normal images on the photosensitive bodies, they are also formed as normal images on the second side of the transfer paper P. In contrast, the color toner images formed as the first toner image are additionally subjected to the tertiary transfer, and hence undergo one more transfer process than the second toner image. Therefore, the color toner images of the first toner image are formed on the photosensitive bodies as mirror images. Accordingly, with each transfer, the first toner image changes to a normal image, then to a mirror image, and then to a normal image, and thus can be formed as a normal image on the first side of the transfer paper P.

A bottle storage device 50 is disposed above the first transfer unit 15 in the drawing. Toner bottles BY, BM, BC, BK containing toner for refilling a developing machine 5Y, M, C, K inside each process cartridge 6Y, M, C, K are stored inside the bottle storage device 50.

Similarly to the embodiment described above, the printer 300 of this embodiment forms images on the basis of image information signals transmitted from a personal computer 200 or the like, as shown in FIG. 4. Since FIG. 4 and the description thereof apply likewise to this printer 300, duplicate description has been omitted.

Next, the distinguishing features of the printer 300 according to this embodiment will be described.

Figure 16:
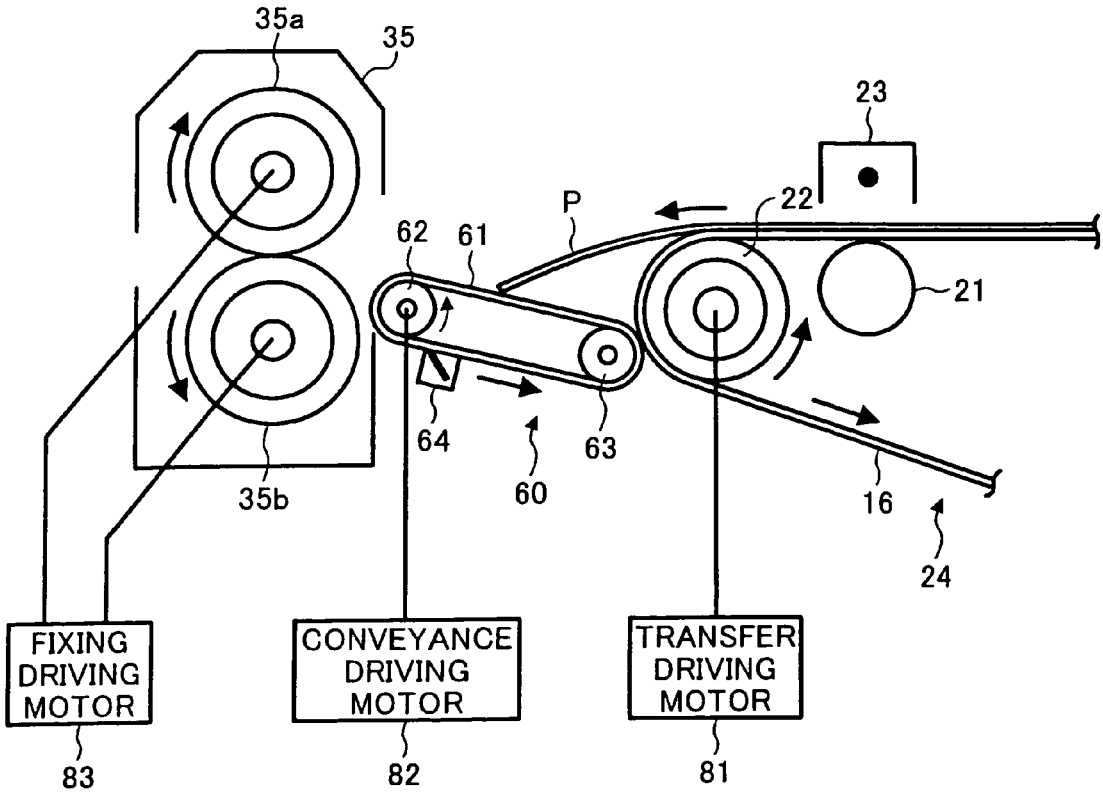
FIG. 16 is a diagram showing the constitution of a conveyance unit of the printer and the peripheral constitution thereof.

FIG. 16 shows an enlargement of the conveyance unit 60 and the peripheral constitution thereof. As shown in the drawing, the transfer paper P, having been subjected to the tertiary transfer of the first toner image onto the first side thereof by the tertiary transfer charger 23 in the second transfer unit 24, approaches the position at which the second intermediate transfer belt 16 is stretched by the driving roller 22 in accordance with the endless motion of the second intermediate transfer belt 16 in the anti-clockwise direction of the drawing. At this belt stretching position, the driving roller 22 stretches the second intermediate transfer belt 16 in such a form that the movement track of the belt is substantially reversed. Having approached the belt stretching position, the transfer paper P does not follow the dramatic change in the movement track of the belt, but instead separates from the second intermediate transfer belt 16 and protrudes in the leftward direction of the drawing. Thus the transfer paper P is passed from the second transfer unit 24 onto the conveyance unit 60 disposed on the left side of the drawing.

The conveyance unit 60 is caused to perform an endless motion in the anti-clockwise direction of the drawing by driving a conveyance driving roller 62 to rotate, while stretching an endless conveyor belt 61 using the conveyance driving roller 62 and a driven roller 63. The transfer paper P that is passed from the second transfer unit 24 onto the conveyor belt 61 is conveyed toward the fixing nip of the fixing device 35 in accordance with the endless motion of the conveyor belt 61. The conveyance unit 60 comprises a conveyance cleaning device 64 serving as cleaning means for cleaning the conveyor belt 61 after the transfer paper P is passed to the fixing device 35. The minute amounts of toner that are transferred onto the conveyor belt 61 from the first side of the transfer paper P during conveyance are cleaned away from the conveyor belt 61 by this conveyance cleaning device 64.

The driving roller 22 of the second transfer unit 24, the conveyance driving roller 62 of the conveyance unit 60, and the two fixing rollers 35*a, b* of the fixing device 35 are driven independently by respective driving sources. More specifically, the driving roller 22, conveyance driving roller 62, and two fixing rollers 35*a, b* are driven respectively by the driving force of a transfer driving motor 81, a conveyance driving motor 82, and a fixing driving motor 83, each of which serves as a driving source. Note that the transfer driving motor 81 also serves as the driving source for a driving roller 11 of the first transfer unit 15 as well as the driving roller 22 of the second transfer unit 24, although this is not shown in the drawings.

Figure 17:
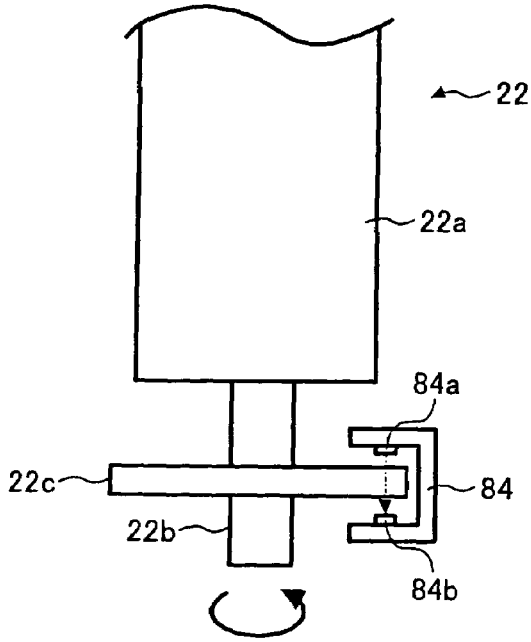
FIG. 17 is a plan view showing a part of a driving roller of a second transfer unit in the printer.

FIG. 17 shows a part of the driving roller 22 of the second transfer unit 24. The driving roller 22 comprises a roller portion 22*a*, and core shafts 22*b* protruding respectively from each end surface of the roller portion 22*a*. The driving roller 22 also comprises a detection subject disc 22*c* which is fixed to one of the core shafts 22*b*. A roller encoder 84 comprising a light-emitting portion 84*a* and a light-receiving portion 84*b* which face each other via the detection subject disc 22*c* is disposed in the vicinity of the driving roller 22. The detection subject disc 22*c* rotates together with the driving roller 22. The detection subject disc 22*c* has a plurality of openings, not shown in the drawing, arranged in series in its peripheral direction. When these openings pass a detection position, which is the position at which the light-emitting portion 84*a* and light-receiving portion 84*b* of the roller encoder 84 face each other, as the detection subject disc 22*c* rotates, light from the light-emitting portion 84*a* passes through the openings and is received in the light-receiving portion 84*b*. When the light-receiving portion 84*b* receives light from the light-emitting portion 84*a*, a light reception signal is output. It should be noted that the interval at which light is received in the light-receiving portion 84*b* is commensurate with the rotation speed of the test disc 22*c*, and accordingly the driving roller 22.

Irregular loads act on the endlessly moving second intermediate transfer belt 16, not shown in the drawing, due to the effect of belt vibration, nip pressure, contact and separation of the second cleaning device 18, abrasion with the toner, and so on. These irregular loads act on the transfer driving motor 81 through the second intermediate transfer belt 16, driving roller 22, a driving transfer system constituted by gears and the like, not shown in the drawing, and so on. As a result, variation occurs in the rotation speed of the transfer driving motor 81, and consequently in the surface motion of the driving roller 22 and second intermediate transfer belt 16.

Figure 18:
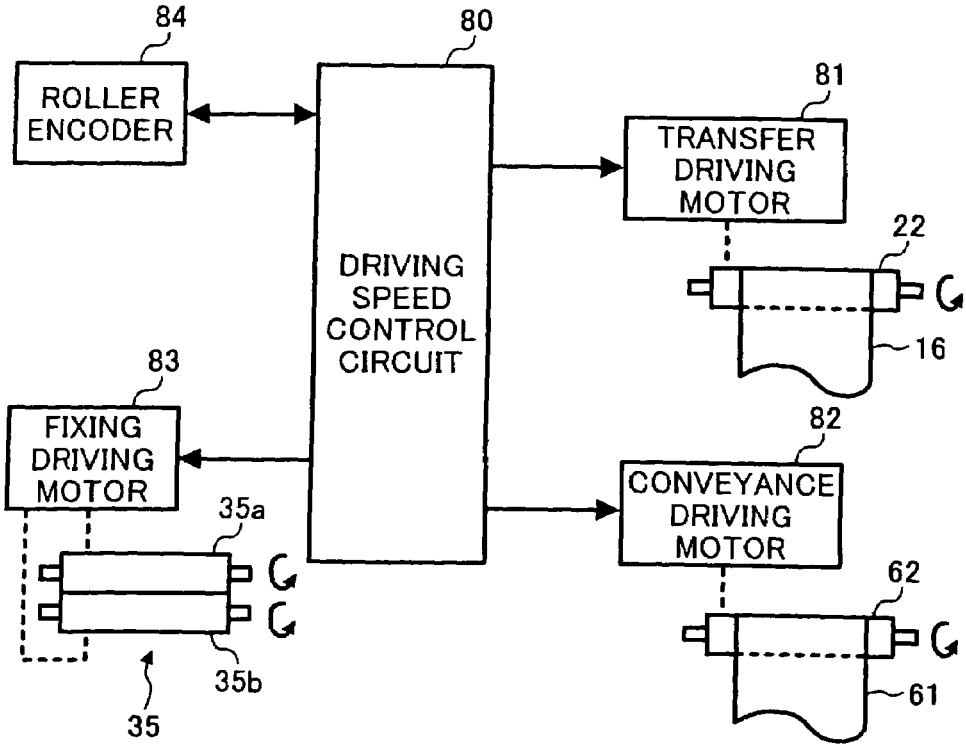
FIG. 18 is a block diagram showing a part of the constitution of an electric circuit in the printer.

A part of the constitution of an electric circuit of the printer 300 is shown in FIG. 18. The transfer driving motor 81, roller encoder 84, conveyance driving motor 82, and fixing driving motor 83 are each connected to a driving speed control circuit 80. The driving speed control circuit 80 learns the surface motion speed of the driving roller 22, and hence the second intermediate transfer belt 16, on the basis of the detection interval of the light-receiving signals output from the light-receiving portion, not shown in the drawing, of the roller encoder 84. The rotation of the motors is then subjected to feedback so that variations in the surface motion speed are reflected in the rotation speed of the conveyance driving motor 82 and fixing driving motor 83. By means of this feedback, the conveyance speed, which is the endless motion speed of the conveyor belt 61 in the conveyance unit 60, and the fixing motion speed, which is the rotation speed of the two fixing rollers 35*a, b* in the fixing device 35, are respectively controlled in the following manner. In other words, the conveyance speed and fixing motion speed are controlled to the same value as the feed speed, which is the endless motion speed of the second intermediate transfer belt 16.

Typically, the feed speed at which the transfer paper P is fed from the second transfer unit 24 to the conveyance unit 60 by the second intermediate transfer belt 16 is equal to the endless motion speed of the second intermediate transfer belt 16. Hence in the printer 300, feed speed detection means for detecting the feed speed of the transfer paper P from the double-sided transfer means to the conveyance means are constituted by the aforementioned detection subject disc 22*c*, roller encoder 84, driving speed control circuit 80, and so on. The driving speed control circuit 80 functions as conveyance speed control means for controlling the conveyance speed of the conveyor belt 61, which serves as a conveyance portion of the conveyance means, on the basis of the feed speed detection results. The driving speed control circuit 80 also functions as fixing motion speed control means for controlling the fixing motion speed of the two fixing rollers 35*a, b*, serving as surface motion bodies, on the basis of the feed speed detection results.

In the printer 300 constituted as described above, the conveyor belt 61, which serves as the conveyance portion of the conveyance unit 60 serving as conveyance means, holds and conveys the transfer paper P conveyed from the second intermediate transfer belt 16 while self-propelling in conjunction with the second intermediate transfer belt 16. Thus the conveyor belt 61 guides the transfer paper P toward the aforementioned fixing nip while suppressing abrasion against the first toner image on the first side of the transfer paper P. As a result, image disturbance caused when the unfixed toner image is scratched can be suppressed as the transfer paper P is conveyed from the second transfer unit 24, which is a part of the double-sided transfer means, to the fixing device 35 serving as fixing means.

The conveyor belt 61 is used as the conveyance portion of the conveyance unit 60 rather than a spur formed with a plurality of protrusions, and hence cleaning can be performed easily using known cleaning means such as the conveyance cleaning unit 64 described above. As a result, image disturbance caused when toner adhered to the conveyor belt 61, which also functions as a guiding portion for guiding the transfer paper P from the second intermediate transfer belt 16 toward the fixing nip of the fixing device 35, is transferred to a subsequent sheet of paper can be suppressed easily.

In FIG. 14 described above, the driving roller 22 of the second transfer unit 24 and the part of the second intermediate transfer belt 16 that is stretched thereby function as a feed portion for feeding the transfer paper P toward the conveyor belt 61, which serves as the conveyance portion of the conveyance unit 60. As shown in the drawing, in the printer 300 this feed portion is positioned further upward in the vertical direction than the rear end of the conveyor belt 61 and at the front side of the conveyance direction. According to this constitution, as shown in FIG. 16, the part of the transfer paper P which protrudes from the feed portion bends under its own weight, and hence can be passed onto the conveyor belt 61 with certainty.

Also in the printer 300, the conveyance speed of the conveyance unit 60 and the fixing motion speed of the fixing device 35 are respectively controlled to the same value as the feed speed of the second transfer unit 24. Hence image disturbance caused when the first toner image suffers abrasion due to a difference between the feed speed and conveyance speed and image disturbance caused when the first toner image suffers abrasion due to a difference between the conveyance speed and fixing motion speed can both be avoided. Image disturbance caused when the first toner image suffers abrasion due to a difference between the conveyance speed and fixing motion speed can also be avoided. It is to be noted that the feed speed, conveyance speed, and fixing motion speed can all be controlled to the same speed by detecting one of the speeds and controlling the other speeds on the basis of the detection result.

However, if the feed speed, or in other words the endless motion speed of the second intermediate transfer belt 16 in the second transfer unit 24, varies greatly, the toner image on the first intermediate transfer belt 8 suffers abrasion due to the difference in the linear speed of the two belts at the fixing nip. This may cause great image disturbance. To avoid such abrasion of the toner image, not only the feed speed, but also the endless motion speed of the first intermediate transfer belt 8, the linear speed of each photosensitive body (1Y, M, C, K), the optical fabrication speed (to be referred to collectively as the "image forming system speed" hereinafter), and so on must be altered. As a result, the constitutions and control required to alter the image forming system speed become complicated. On the other hand, the toner image does not suffer abrasion at the primary nip and secondary nip even when the conveyance speed and fixing motion speed are altered respectively.

Hence image disturbance caused when one of the feed speed, conveyance speed, and fixing motion speed is different from the other speeds can be avoided without the need for complicated constitutions and control to alter all of the components of the image forming system speed uniformly.

As described above using FIG. 14, means which transcribe the first toner image formed on the photosensitive bodies 1Y, M, C, K serving as image carriers onto the first side of the transfer paper P via the first intermediate transfer belt 8 serving as a first intermediate transfer body and the second intermediate transfer belt 16 serving as a second intermediate transfer body are used as the double-sided transfer means (a combination of the first transfer unit 15 and second transfer unit 24) in the printer 300. Then, the second toner image formed on the photosensitive bodies 1Y, M, C, K is transcribed onto the second side of the transfer paper P via the first intermediate transfer belt 8 alone. According to the double-sided transfer means constituted in this manner, toner images can be formed on both sides of the transfer paper P without providing a single-purpose image carrier for forming the first toner image to be transcribed onto the first side of the transfer paper P and a single-purpose image carrier for forming the second toner image to be transcribed onto the second side of the transfer paper P separately.

The conveyor belt 61 of the conveyance unit 60 serves to guide the transfer paper P toward the fixing nip, and hence is disposed in the vicinity of the fixing device 35. As a result, the conveyor belt 61 tends to receive heat from the two fixing rollers 35*a, b*. Hence, in the printer 300, a belt formed from a heat-resistant material is used as the conveyor belt 61. Here, "heat-resistant material" refers to a material which does not degenerate at the maximum temperature to which it can be raised by heat from the fixing rollers 35*a, b*. In the printer 300, materials such as polyimide or polyamide, for example, correspond to heat-resistant materials. As the conveyance speed of the transfer paper P decreases, fixing becomes possible at a lower temperature, and hence the range of heat-resistant material types widens. Depending on the circumstances, the materials cited in the following may also function as heat-resistant materials.

Materials which may function as heat-resistant materials include polycarbonate, a fluororesin (ETFE, PVDF, etc.), methyl methacrylate resin, butyl methacrylate resin, ethyl acrylate resin, butyl acrylate resin, and so on. Such materials also include modified acrylic resin (silicone modified acrylic resin, vinyl chloride resin modified acrylic resin, acrylic/urethane resin, etc.), vinyl chloride resin, styrene-vinyl acetate copolymer, vinyl chloride-vinyl acetate copolymer, and so on.

Rosin modified maleic resin, phenolic resin, epoxy resin, polyester resin, polyester polyurethane resin, polyethylene, polypropylene, polybutadiene, polyvinylidene chloride, ionomer resin, and so on may also be used as heat-resistant materials.

Polyurethane resin, silicone resin, ketonic resin, ethylene-ethylacrylate copolymer, xylene resin, polyvinyl butyral resin, modified polyphenylene oxide resin, styrene-type resins (single-polymers or copolymers containing styrene or a styrene substituent) may also be used as heat-resistant materials.

These styrene-type resins include, for example, polystyrene, chloropolystyrene, poly-α-methylstyrene, styrene-butadiene copolymer, styrene-vinyl chloride copolymer, styrene-vinyl acetate copolymer, styrene-maleic acid copolymer, and so on. They also include styrene-acrylate copolymers (styrene-methyl acrylate copolymer, styrene-octyl acrylate copolymer, styrene-butyl acrylate copolymer, styrene-octyl acrylate copolymer, styrene-phenyl acrylate copolymer), and so on, and also include styrene-methacrylate copolymers (styrene-methyl methacrylate copolymer, styrene-ethyl methacrylate copolymer, styrene-phenyl methacrylate copolymer), and so on. These styrene-type resins further include styrene-α-chloro acrylate copolymers, styrene-acrylonitrile-acrylate copolymers, and so on. As long as the material functions as a heat-resistant material, the materials listed above may be used alone or in combinations of a plurality thereof.

Likewise in the printer of this embodiment, the user is instructed to use a toner which satisfies all of the conditions (a) to (d) of the first embodiment, described above with reference to FIGS. 9 and 10, as the Y, M, C, K toners used to form toner images. Note that FIGS. 9 and 10 and the description thereof apply similarly to the second embodiment, and hence duplicate description has been omitted.

Figure 19:
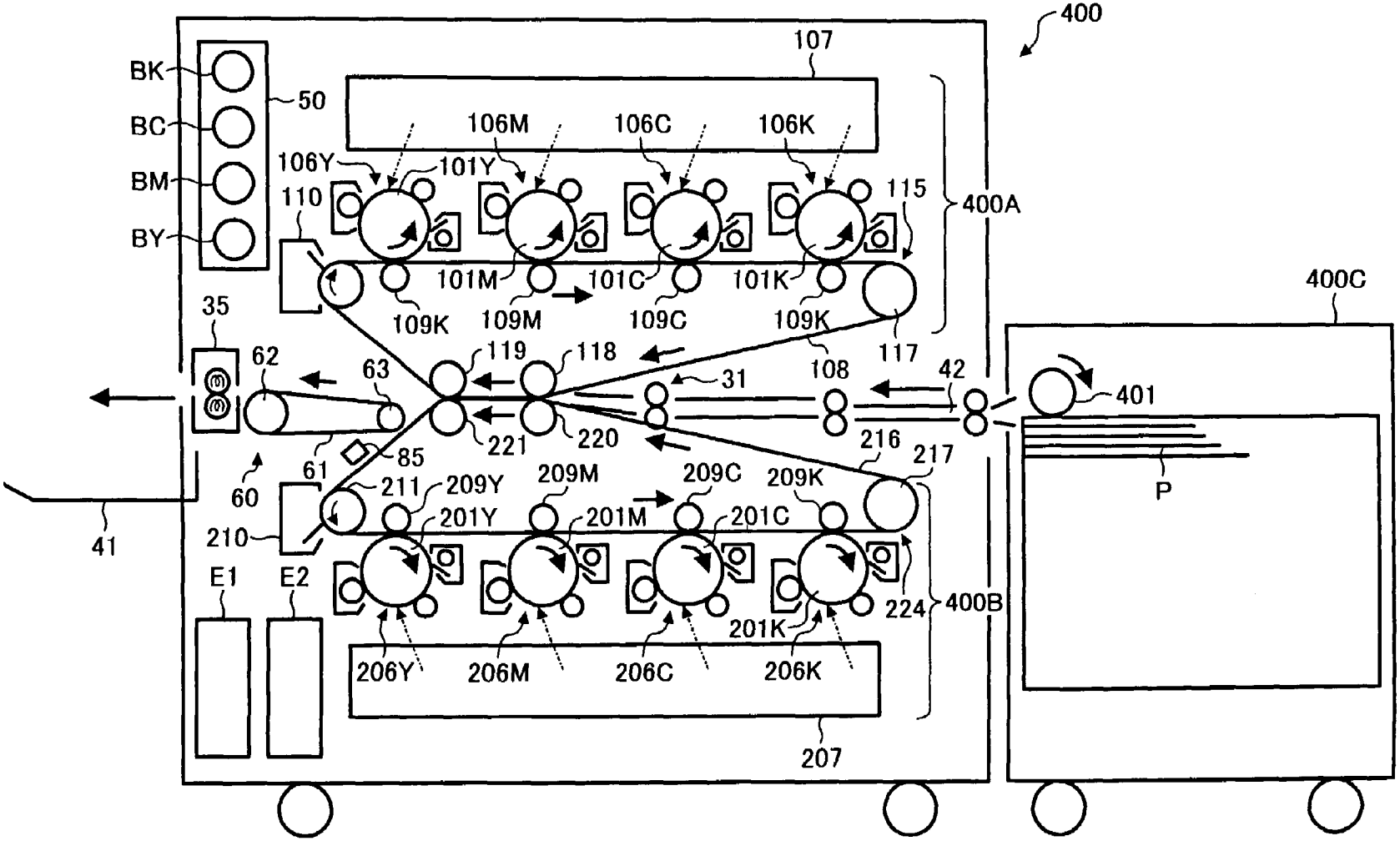
FIG. 19 is a diagram showing the schematic constitution of a printer in a modification of the second embodiment.

The schematic constitution of a modification of the printer 300 according to the second embodiment is shown in FIG. 19. This printer 400 comprises a first image forming unit 400A provided with a first exposure device 107, four first photosensitive bodies 101Y, 101M, 101C, 101K serving as first image carriers, a first transfer unit 115, and so on. The printer 400 also comprises a second image forming unit 400B provided with a second exposure device 207, four second photosensitive bodies 201Y, 201M, 201C, 201K serving as second image carriers, a second transfer unit 224, and so on. The two image forming units are disposed in a point-symmetrical layout with a secondary transfer nip, which is formed by contact between a first intermediate transfer belt 108 of the first transfer unit 115 and a second intermediate transfer belt 216 of the second transfer unit 224, serving as a boundary. Specifically, the first image forming unit 400A is disposed above the second image forming unit 400B, and is laid out with the exposure device 107, the four first photosensitive bodies 101Y, M, C, K, and the first transfer unit 115 positioned in sequence from the top. Conversely, the second image forming unit 400B* is laid out with the second transfer unit 224, the four second photosensitive bodies 201Y, M, C, K, and the second exposure device 207 positioned in sequence from the top.

The printer 400 is constituted with a printer portion for printing images onto the transfer paper P and a feed portion 400C for supplying the transfer paper P to the printer portion formed as separate bodies. The feed portion 400C feeds the transfer paper P toward a feeding path 42 of the printer portion by driving a feed roller 401, which presses against the top sheet of transfer paper P on a stack of transfer paper stored in the interior of the feed portion 400C, to rotate at a predetermined timing. The fed transfer paper P passes through a plurality of conveyance roller pairs, and is thus sandwiched between the rollers of a resist roller pair 31 disposed near the end of the feeding path 42. The transfer paper P is then fed toward a secondary transfer nip in synchronization with a first toner image on the first intermediate transfer belt 108 of the first transfer unit 115 and a second toner image on the second intermediate transfer belt 216 of the second transfer unit 224.

First Y, M, C, K toner images are formed respectively on the four first photosensitive bodies 101Y, M, C, K of the first image forming unit 400A. These toner images are subjected to a composite primary transfer onto the first intermediate transfer belt 108 at each of the primary transfer nips at which the first photosensitive bodies 101Y, M, C, K contact the first intermediate transfer belt 108. The toner images are then conveyed to the secondary transfer nip, where they are all subjected to a secondary transfer onto a first side of the transfer paper P. Note that in the printer 400, the side of the transfer paper P that faces upward in the drawing inside the feed portion 400C is the first side of the transfer paper P.

Meanwhile, second Y, M, C, K toner images are formed respectively on the four second photosensitive bodies 201Y, M, C, K of the second image forming unit 400B. These toner images are subjected to a composite primary transfer onto the second intermediate transfer belt 216 at each of the primary transfer nips at which the second photosensitive bodies 201Y, M, C, K contact the second intermediate transfer belt 216, and then conveyed to the secondary transfer nip, where they are all subjected to a secondary transfer onto a second side of the transfer paper P.

The printer 400 according to the modification described above differs from the printer 300 according to the second embodiment in that one-pass double-sided transfer can be realized up to the secondary transfer, rather than subjecting both the first Y, M, C, K toner images and second Y, M, C, K toner images to a tertiary transfer. Moreover, the first Y, M, C, K toner images and second Y, M, C, K toner images can be formed in parallel, rather than forming the second Y, M, C, K toner images after the first Y, M, C, K toner images, and hence the image forming speed can be increased dramatically.

Upon discharge from the secondary transfer nip, the transfer paper P is passed over to a conveyance unit 60 disposed on the left side of the secondary transfer nip in the drawing, and then conveyed to a fixing device 35. Fixing processing is then implemented on the full color images on both sides of the transfer paper P, whereupon the transfer paper P is discharged onto a discharge tray 41 provided on the front surface cover of the printer housing.

Figure 20:
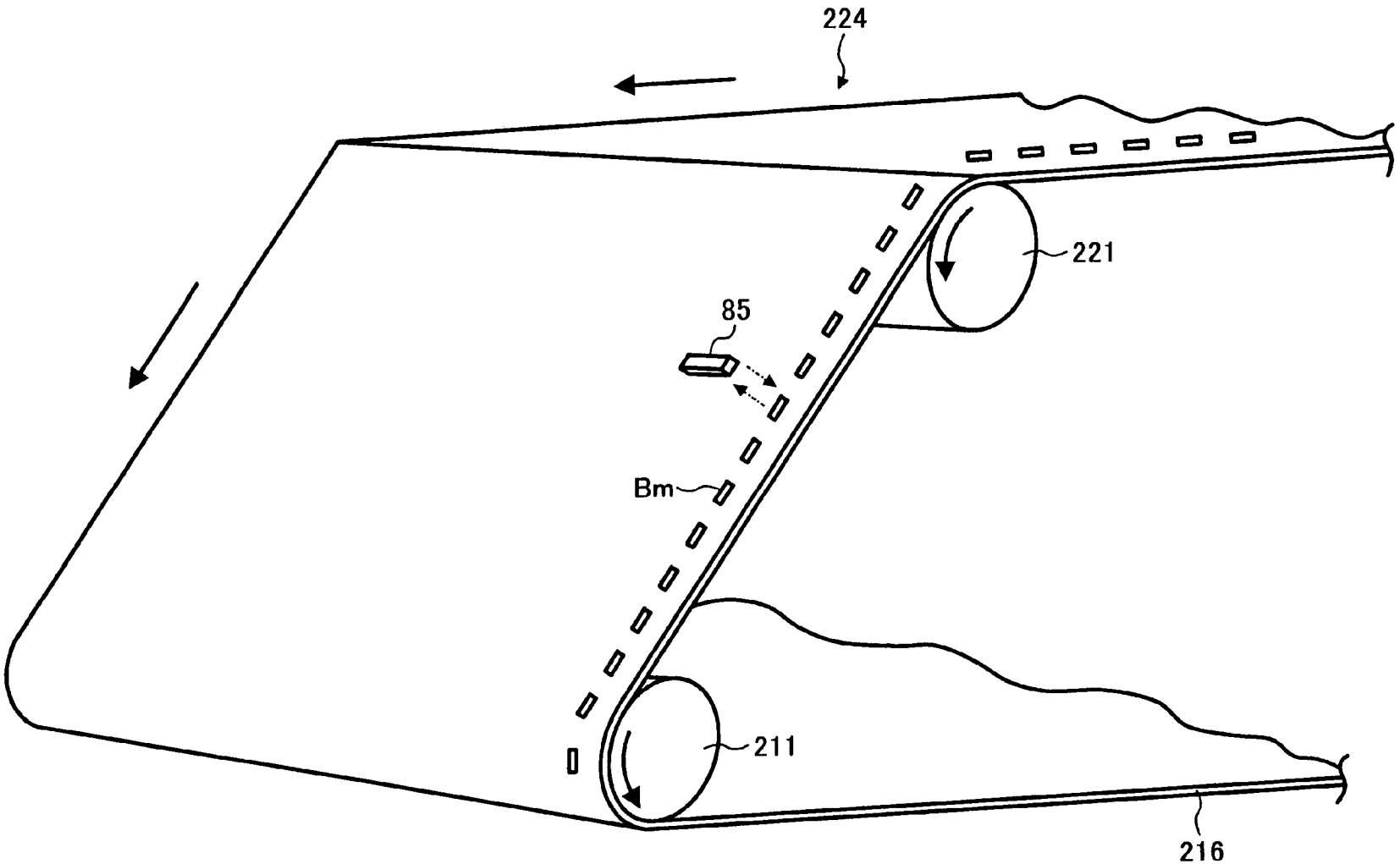
FIG. 20 is a perspective view showing a part of the constitution of a second transfer unit in the printer.

A belt mark detection sensor 85 constituted by a reflection-type photosensor is provided below the conveyance unit 60 in the drawing. This belt mark detection sensor 85 detects a belt mark, not shown in the drawing, provided on the front surface of the second intermediate transfer belt 216 in the second transfer unit 224, and outputs a detection signal. More specifically, as shown in FIG. 20, the second intermediate transfer belt 216 comprises a plurality of belt marks Bm disposed near one end of the front surface thereof at a predetermined pitch over the entire periphery of the belt in the circumferential direction. The belt marks Bm are formed from a material with a better light-reflecting property than the surface material of the second intermediate transfer belt 216, such as a metal.

The belt mark detection sensor 85 comprises a light-emitting element and a light-receiving element, not shown in the drawing. Light emitted from the light-emitting element is aimed near the aforementioned one end of the endlessly moving second intermediate transfer belt 216. When the region of light emitted from the light-emitting element passes through the belt mark Bm, the light is reflected on the surface of the mark, as shown in the drawing, and received in the light-receiving element of the belt mark detection sensor 85. Having received the reflected light, the light-receiving element outputs a light reception signal.

As described above, the plurality of belt marks Bm are disposed at a predetermined pitch in the circumferential direction of the belt, and hence the interval at which light is received in the light-receiving element (the mark detection interval) corresponds to the endless motion speed of the second intermediate transfer belt 216.

Figure 21:
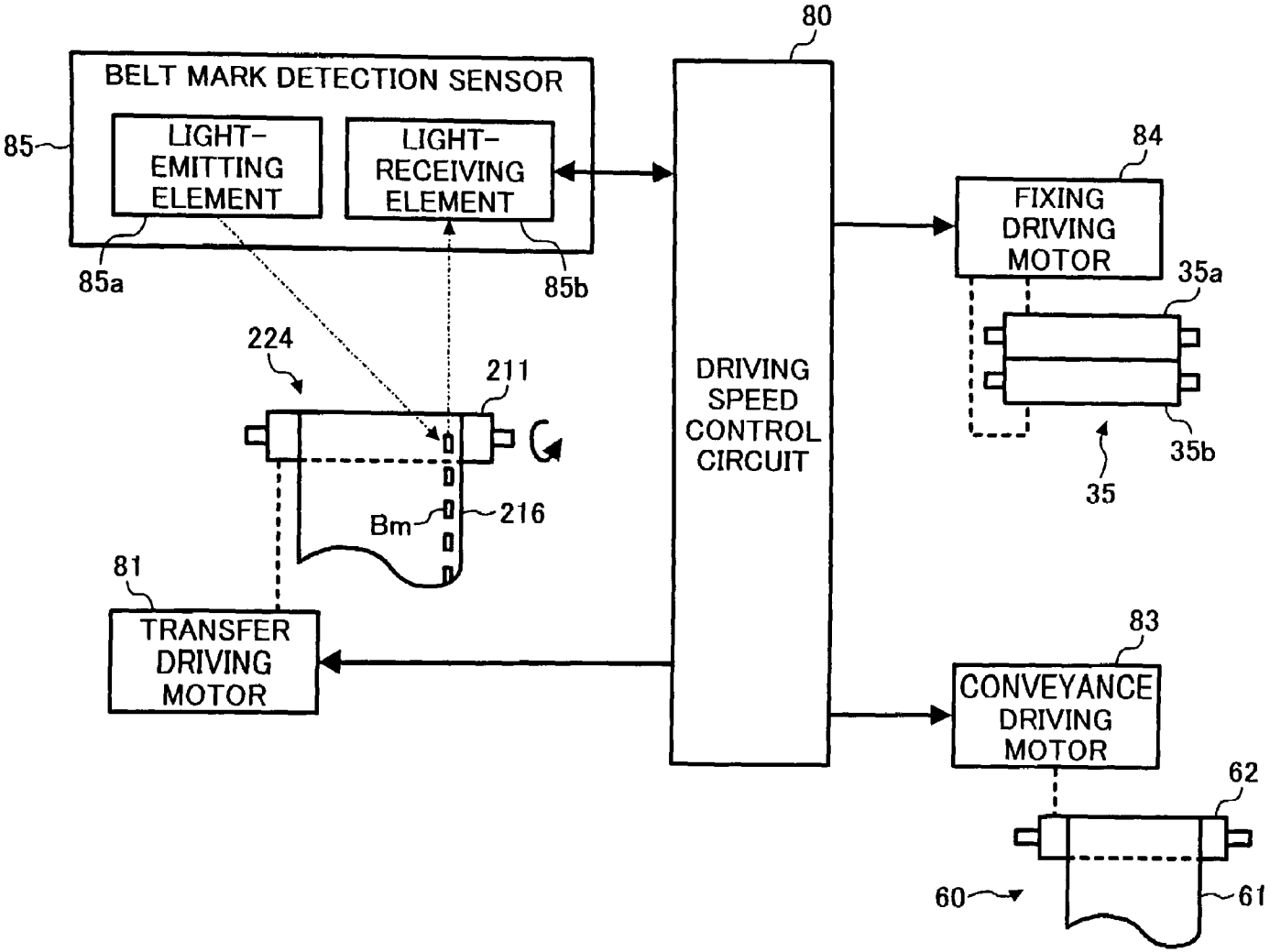
FIG. 21 is a block diagram showing a part of the constitution of an electric circuit in the printer.

A part of the constitution of an electric circuit in the printer 400 according to this modification is shown in FIG. 21. As shown in the drawing, a transfer driving motor 81 serves as a driving source for a first driving roller 111 which drives the first intermediate transfer belt 108 in the transfer unit 115, and a second driving roller 211 which drives the second intermediate transfer belt 216 in the second transfer unit 224. A conveyance driving motor 83 serves as a driving source for a conveyance driving roller 62 which drives a conveyor belt 61 of the conveyance unit 60. A fixing driving motor 84 serves as a driving source for two fixing rollers 65*a, b* of the fixing device 35. A driving speed control circuit 80 learns the endless motion speed of the second intermediate transfer belt 216 on the basis of the interval at which light reception signals are transmitted from the light-receiving element 85*b* of the belt mark detection sensor 85 which detects the belt marks Bm on the second intermediate transfer belt 216. The rotation of the motors is then subjected to feedback so that variations in the speed are reflected in the rotation speed of the conveyance driving motor 83 and fixing driving motor 84. By means of this feedback, the conveyance speed of the conveyance unit 60 and the fixing motion speed of the fixing device 35 are controlled to the same value as the feed speed, which is the endless motion speed of the first intermediate transfer belt 108 and second intermediate transfer belt 216.

It should be noted that in the printer 400, the outlet from the secondary transfer nip, at which the first intermediate transfer belt 108 and second intermediate transfer belt 216 contact, serves as a feed portion for feeding the transfer paper P to the conveyance unit 60.

In the printer 400 according to the modification described above, a combination of the belt mark detection sensor 85, which detects the feed speed of the transfer paper P indirectly by detecting the surface motion speed of the second intermediate transfer belt 216, and the driving speed control circuit 80 is used as feed speed detection means. By using such feed speed detection means, the feed speed of the transfer paper P can be detected accurately even when the second driving roller 211 and second intermediate transfer belt 216 slip such that the linear speeds of the two differ. As a result, image disturbance caused by an inaccurate detection of the feed speed of the transfer paper P due to a difference in the linear speeds of the second driving roller 211 and second intermediate transfer belt 216 can be avoided. Note that in the printer 400, the surface motion speeds of the first intermediate transfer belt 108 and second intermediate transfer belt 216 are equal. Accordingly, the belt marks Bm may be provided on the first intermediate transfer belt 108 instead of the second intermediate transfer belt 216, and the belt mark detection sensor 85 may be disposed so as to detect the belt marks Bm on the first intermediate transfer belt 108.

Figure 22:
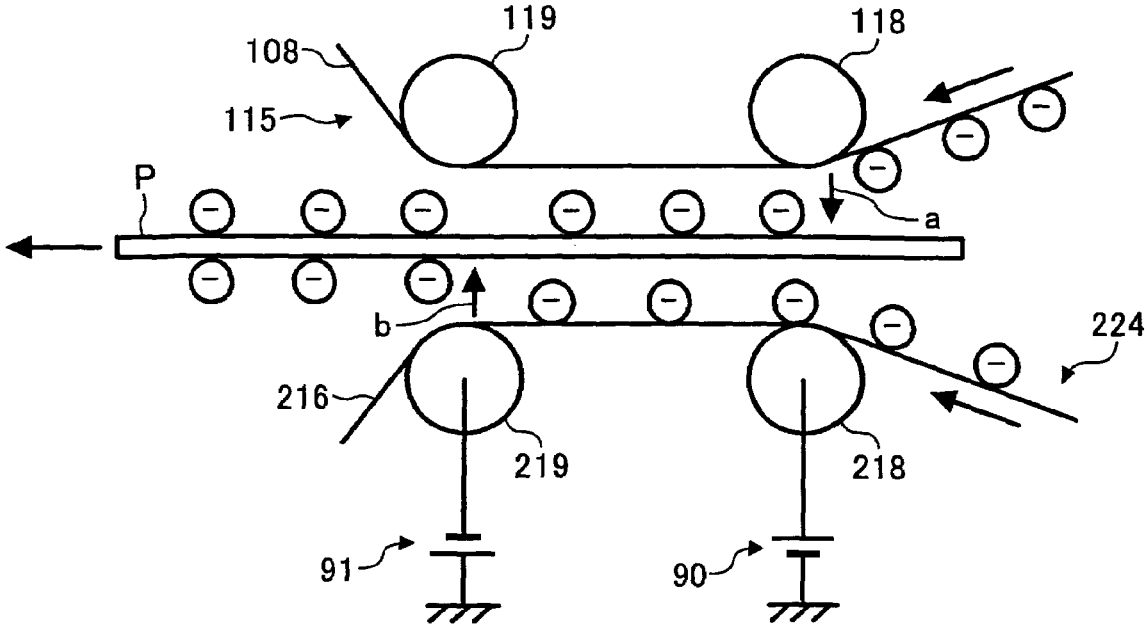
FIG. 22 is a diagram showing the constitution of the periphery of a secondary transfer nip in the printer.

The constitution of the periphery of the secondary transfer nip in the printer 400 according to this modification is shown as an enlargement in FIG. 22. As shown in the drawing, on the first transfer unit 115 side of the secondary transfer nip, a nip upper side first roller 118 and a nip upper side second roller 119 stretch the first intermediate transfer belt 108 while supporting the belt on the rear surface thereof. The nip upper side first roller 118 is positioned on the upstream side of the nip upper side second roller 119 in the movement direction of the belt. Meanwhile, on the second transfer unit 224 side of the secondary transfer nip, a nip lower side first roller 218 and a nip lower side second roller 219 stretch the second intermediate transfer belt 216 while supporting the belt on the rear surface thereof. The nip lower side first roller 218 is positioned on the upstream side of the nip lower side second roller 219 in the movement direction of the belt.

Note that in the drawing, for the sake of convenience, the first intermediate transfer belt 108 and second intermediate transfer belt 216 are shown separated at the secondary transfer nip, but in actuality contact each other. The stretched part of the first intermediate transfer belt 108 from the nip upper side first roller 118 to the nip upper side second roller 119 contacts the stretched part of the second intermediate transfer belt 216 from the nip lower side first roller 218 to the nip lower side second roller 219.

The region in which the nip upper side first roller 118 of the first transfer unit 115 and the nip lower side first roller 218 of the second transfer unit 224 face each other at the secondary transfer nip serves as a secondary transfer portion for transcribing the first toner image onto the first intermediate transfer belt 108. At this secondary transfer portion, a positive secondary transfer bias, which has a reverse polarity to the toner, is applied to the nip lower side first roller 218, which contacts the rear surface of the second intermediate transfer belt 216, by a power source 90. The nip upper side first roller 118, which contacts the rear surface of the first intermediate transfer belt 108, is also installed electrically. At the secondary transfer portion described above, the first toner image on the first intermediate transfer belt 108 is electrostatically attracted to the nip lower side first roller 218 through the transfer paper P and second intermediate transfer belt 216, and hence is subjected to the secondary transfer onto the first side (the side facing upward in the drawing) of the transfer paper P. This is a conventional electrostatic transfer method that is in general use.

It is to be noted that hereinafter, the system of transcribing toner images by electrostatically attracting the toner images toward a type of transfer bias member (the nip lower side first roller 218 in the illustrated example) will be referred to as an "electrostatic attraction transfer system".

Incidentally, it has conventionally been considered extremely difficult to electrostatically transfer two toner images of the same polarity onto opposite sides of a recording medium such as transfer paper at the same transfer nip. When the two toner images of the same polarity face each other through the recording medium at the transfer nip, the electric field for electrostatically moving one of the toner images toward the recording medium causes the other toner image to move electrostatically in the opposite direction from the recording medium. As a result, only one of the two toner images is electrostatically transferred. Hence conventionally, a system of forming the two toner images using toners of opposite polarities has been employed when toner images are to be electrostatically transferred onto both sides of a recording medium at the same transfer nip. This is due to the fact that when the toner images have opposite polarities, the respective toner images can be eletrostatically transferred toward the recording medium.

With this system, however, image forming portions (photosensitive bodies, an exposure device, and so on) which use toners of opposite polarities must be provided, and moreover, the toners of opposite polarities have to be set accurately into their individual image forming portions, the respective image forming portions have to be set with members which match the polarity thereof, and so on. As a result, maintenance becomes extremely difficult.

However, the present inventor has discovered that by implementing an "electrostatic extrusion transfer system" following the "electrostatic attraction transfer system", electrostatic transfer can be performed on the opposing sides of a recording medium at the same transfer nip even when the toner images have the same polarity. The "electrostatic extrusion transfer system" is a system in which toner images are extruded electrostatically from a transfer bias member side toward the recording medium.

More specifically, as shown in the drawing, the region in which the nip upper side second roller 119 in the first transfer unit 115 faces the nip lower side second roller 219 in the second transfer unit 224 serves as a secondary transfer portion for transcribing the second toner image onto the second intermediate transfer belt 216. At this secondary transfer portion, a negative secondary transfer bias, which has the same polarity as the toner, is applied to the nip lower side second roller 219, which contacts the rear surface of the second intermediate transfer belt 216, by a power source 91. The nip upper side second roller 119, which contacts the rear surface of the first intermediate transfer belt 108, is also installed electrically.

At the secondary transfer portion described above, the second toner image on the second intermediate transfer belt 216 is extruded electrostatically from the nip lower side second roller 219 side through the second intermediate transfer belt 216 and subjected to secondary transfer onto the second side (the side facing downward in the drawing) of the transfer paper P. Strangely, it was learned that at this time, although electrostatic force from the first side of the transfer paper P to the first intermediate transfer belt 108 acts on the first toner image that has already been subjected to secondary transfer onto the first side, the first toner image is not reverse-transcribed onto the first intermediate transfer belt 108. However, when the "electrostatic attraction transfer system" is implemented after the "electrostatic extrusion transfer system" at the same transfer nip, a toner image that has already been transferred in the "electrostatic extrusion transfer system" is reverse-transcribed during implementation of the "electrostatic attraction transfer system".

Hence the "electrostatic attraction transfer system" must be performed before the "electrostatic extrusion transfer system". In other words, from among the process for transcribing the first toner image onto the first side of the transfer paper P and the process for transcribing the second toner image onto the second side of the transfer paper P, the process which employs the "electrostatic attraction transfer system" for electrostatically attracting a toner image toward a transfer bias member is to be implemented first. The process which employs the "electrostatic extrusion transfer system" for electrostatically removing a toner image from the transfer bias member is to be implemented thereafter. By means of this constitution, toner images can be transcribed electrostatically onto both sides of the transfer paper P at the same transfer nip without using two types of toner having different polarities.

Figure 23:
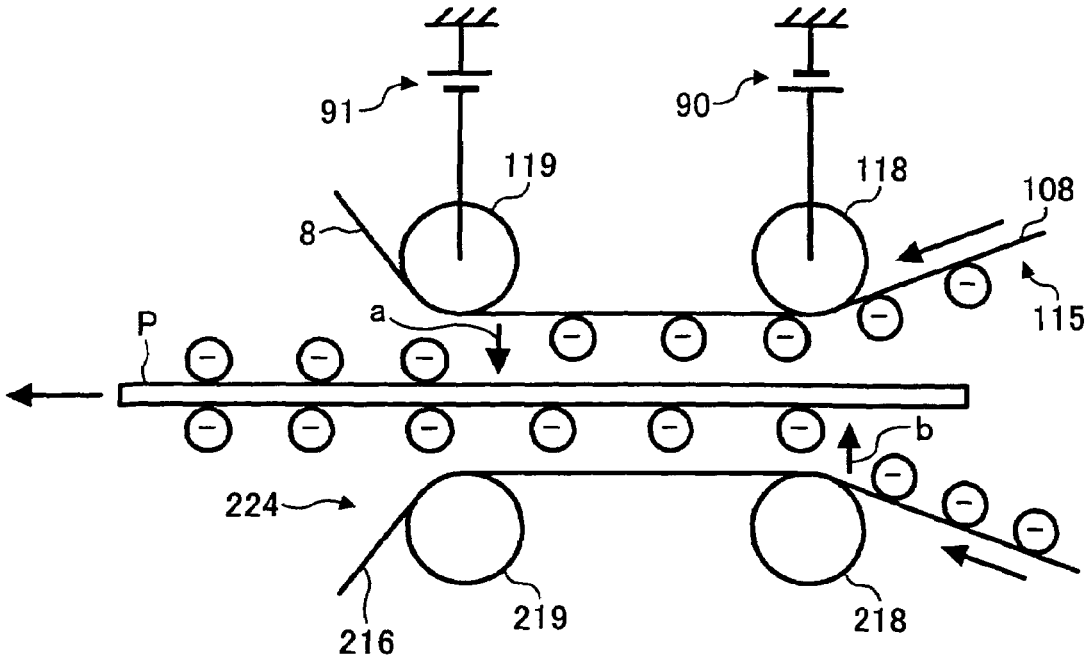
FIG. 23 is a diagram showing a constitution in which a nip upper side first roller and a nip upper side second roller of a first transfer unit in the printer function as a transfer bias members.

FIG. 23 shows an example in which the nip upper side first roller 118 and nip upper side second roller 119 of the first transfer unit 115 function as transfer bias members rather than the nip lower side first roller 218 and nip lower side second roller 219 of the second transfer unit 224. By applying a positive transfer bias having a reverse polarity to the toner to the nip upper side first roller 118 as shown in the drawing, the second toner image on the second intermediate transfer belt 216 can be subjected to "electrostatic attraction transfer" onto the second side of the transfer paper P. In the drawing, the region in which the nip upper side first roller 118 faces the nip lower side first roller 218 serves as the secondary transfer portion for the second toner image. Conversely, by applying a negative transfer bias having the same polarity as the toner to the nip upper side second roller 119, the first toner image on the first intermediate transfer belt 108 can be subjected to "electrostatic extrusion transfer" onto the first side of the transfer paper P. In the drawing, the region in which the nip upper side second roller 119 faces the nip lower side second roller 219 serves as the secondary transfer portion for the first toner image.

In the printer 400 of this modification, the double-sided transfer means comprising the first transfer unit 115 and second transfer unit 224 use the first intermediate transfer belt 108 and second intermediate transfer belt 216 as a first intermediate transfer body and a second intermediate transfer body respectively. According to this constitution, a long transfer nip (secondary transfer nip) can be formed by modifying the stretched form of the respective belts as shown in the drawing, such that the belts contact each other over a large distance in the movement direction thereof.

Also in the double-sided transfer means, the front end of the feeding path 42, which serves as recording medium supply means for supplying the transfer paper P, in the transfer paper supply direction (on the resist roller pair 31 side) and the rear end of the conveyance unit 60 in the transfer paper conveyance direction (the driven roller 63 side) are positioned in the region where the first intermediate transfer belt 108 and second intermediate transfer belt 216 face each other. According to this constitution, the feeding path 42 and conveyance unit 60 are disposed so as to intrude on the double-sided transfer means as shown in the drawing, and hence a compact layout can be realized.

It is to be noted that although in the second embodiment and the modification thereof described above, examples were described in which intermediate transfer belts which perform an endless motion while being stretched by a plurality of rollers are used as the first intermediate transfer body and second intermediate transfer body respectively, the first and second intermediate transfer bodies may take another form such as a roller or drum, similarly to the first embodiment and the modifications thereof described above.

Likewise, examples were described in which drum-form photosensitive bodies are used as image carriers, but belt-form photosensitive bodies and other systems may be used. This embodiment may also be applied to an image forming apparatus using a liquid developer containing toner and a liquid carrier instead of a particulate toner. Further, a printer employing electrostatic transfer for each of the primary transfer, secondary transfer, and tertiary transfer was described, but this embodiment may also be applied to an image forming apparatus which performs at least one of these transfer processes by heating transfer.

The above-described second embodiment and modification thereof have the following features.

(1) By providing the feed speed detection means for detecting the feed speed of the transfer paper P from the double-sided transfer means to the conveyance unit 60, which serves as conveyance means, and the driving speed control circuit 80 serving as conveyance speed control means for controlling the conveyance speed of the conveyor belt 61, which serves as a conveyance portion, on the basis of the detection results of the feed speed detection means, the self-propelling speed (endless motion speed) of the conveyor belt 61, i.e. the conveyance speed, can be controlled on the basis of the feed speed, and hence abrasion between the transfer paper P and conveyor belt 61 can be reliably suppressed. As a result, image disturbance caused when the unfixed first toner image suffers abrasion can be reliably suppressed.

(2) The driving speed control unit 80 is constituted to control the conveyance speed of the conveyance unit 60 to the same speed as the feed speed of the transfer paper P through the second transfer unit 24, 224, and hence toner image abrasion caused by a difference between the conveyance speed and feed speed can be avoided.

(3) The conveyor belt 61, which is the conveyance portion of the conveyance unit 60, is driven by a different driving source (the conveyance driving motor 83) to the transfer driving motor 81, which serves as the driving source of the double-sided transfer means, and hence the conveyance speed can be regulated to the same speed as the feed speed easily, without providing a complicated mechanism such as a pulley to control the respective speeds individually using the same driving source.

(4) A device which performs fixing processing by trapping the transfer paper P in the fixing nip formed by contact between the two fixing rollers 35*a, b*, which perform a surface motion and thus serve as surface motion bodies, is used as the fixing device 35 serving as fixing means. Moreover, the driving speed control circuit 80 is provided as fixing motion speed control means for controlling the fixing motion speed, which is the movement speed of the fixing rollers 35*a, b*, on the basis of the detection result of the feed speed detection means (80+82 or 80+85). Hence toner images can be fixed securely on both sides of the transfer paper P by heating the transfer paper P from both sides at the fixing nip. Further, in addition to avoiding abrasion of the toner image caused by a difference between the feed speed and conveyance speed, abrasion of the toner image caused by a difference between the feed speed and the fixing motion speed can also be avoided.

(5) The driving speed control circuit 80 serving as fixing motion speed control means is constituted to control the fixing motion speed to the same speed as the feed speed, and hence toner image disturbance caused by a difference between the conveyance speed and fixing motion speed can be avoided by controlling all of the feed speed, conveyance speed, and fixing motion speed to the same value.

(6) The two fixing rollers 35*a, b* serving as surface motion bodies are driven by a different driving source (the fixing driving motor 84) to the transfer driving motor 81, which serves as the driving source of the double-sided transfer means, and hence the fixing motion speed can be regulated to the same speed as the feed speed easily, without providing a complicated mechanism such as a pulley to control the respective speeds individually using the same driving source.

(7) Means which feed the transfer paper P to the conveyance unit 60 in accordance with the surface motion of the second intermediate transfer belt 216 serving as an intermediate transfer body are used as the double-sided transfer means. Moreover, a combination of the roller encoder 82, which detects the feed speed of the transfer paper P indirectly by detecting the driving speed of the driving roller 11, which serves as driving force applying means for applying a driving force to the second intermediate transfer belt 216, and the driving speed control circuit 80 is used as the feed speed detection means. Hence the second intermediate transfer belt 216* can be caused to function as a feed portion for the transfer paper P without providing a special mechanism for feeding the transfer paper P from the double-sided transfer means to the conveyance unit 60. Furthermore, the feed speed of the transfer paper P can be learned with a certain degree of precision without using a special device provided with the belt marks Bm shown in FIG. 20 as the second intermediate transfer belt 216.

(8) Means which feed the transfer paper P to the conveyance unit 60 in accordance with the surface motion of the first intermediate transfer belt 108 and second intermediate transfer belt 216 serving as intermediate transfer bodies are used as the double-sided transfer means. Moreover, a combination of the driving speed control circuit 80, which detects the feed speed of the transfer paper P indirectly by detecting the surface motion speed of the second intermediate transfer belt 216, and the belt mark detection sensor 85 is used as the feed speed detection means. Hence, the feed speed of the transfer paper P can be detected accurately even when the second driving roller 211 and second intermediate transfer belt 216 slip such that the linear speeds of the two differ, enabling image disturbance caused when the feed speed of the transfer paper P is detected inaccurately due to a difference in the linear speeds of the two to be avoided.

(9) The conveyor belt 61 serving as a conveyance portion supports and carries the transfer paper P from the lower side in the direction of gravity, and hence the transfer paper P can be held on the surface of the conveyance portion (conveyor belt 61) easily without providing special means such as electrostatic adsorption means for holding the transfer paper P on the conveyance portion against gravitational force.

(10) A device which conveys the transfer paper P to the surface of the endlessly moving conveyor belt 61 while carrying the transfer paper P is used as the conveyance portion of the conveyance unit 60, and hence an operation to pass the transfer paper P from the double-sided transfer means to the fixing device 35 can be performed easily in the conveyance portion (on the conveyor belt 61) without providing a reciprocal motion mechanism which causes the conveyance portion to perform a reciprocal motion between the double-sided transfer means and fixing device 35.

(11) A heat-resistant material such as polyimide or polyamide is used to form the conveyor belt 61, and hence various defects caused when the conveyor belt 61 is deformed by heat from the fixing device 35 can be eliminated.

(12) As shown in FIG. 14, the feed portion constituted by a combination of the driving roller 22 of the second transfer unit 24 and the part of the second intermediate transfer belt 16 that is stretched thereby is positioned further upward in the vertical direction than the rear end of the conveyor belt 61 and at the front side of the conveyance direction. According to this constitution, as shown in FIG. 16, the part of the transfer paper P which protrudes from the feed portion bends under its own weight, and hence can be passed onto the conveyor belt 61 with certainty.

(13) Means which transcribe the first toner image formed on the photosensitive bodies 1Y, M, C, K onto the first side of the transfer paper P through the first intermediate transfer belt 8 and second intermediate transfer belt 16, and transcribe the second toner image formed on the photosensitive bodies onto the second side of the transfer paper P through the first intermediate transfer belt 8, are used as the double-sided transfer means. Hence, toner images can be formed on both sides of the transfer paper P without providing a single-purpose image carrier for forming the first toner image to be transcribed onto the first side of the transfer paper P and a single-purpose image carrier for forming the second toner image to be transcribed onto the second side of the transfer paper P separately.

(14) The first photosensitive bodies 101Y, M, C, K and second photosensitive bodies 201Y, M, C, K are provided as image carriers. The double-sided transfer means are constituted to transcribe the first toner image formed on the first photosensitive bodies 101Y, M, C, K onto the first side of the transfer paper P through the first intermediate transfer belt 108, and transcribe the second toner image formed on the second photosensitive bodies 201Y, M, C, K onto the second side of the transfer paper P through the second intermediate transfer belt 216. Hence, a one-pass double-sided transfer operation can be realized up to the secondary transfer, rather than subjecting the first Y, M, C, K toner images and second Y, M, C, K toner images to a tertiary transfer. Moreover, the first Y, M, C, K toner images and second Y, M, C, K toner images can be formed in parallel, rather than forming the second Y, M, C, K toner images after the first Y, M, C, K toner images, and hence the image forming speed can be increased dramatically.

(15) The following systems are employed respectively in the process for transcribing the first toner image onto the first side of the transfer paper P from the first intermediate transfer belt 108 and the process for transcribing the second toner image onto the second side of the transfer paper P from the second intermediate transfer belt 216. In the former process, which is implemented first, an "electrostatic attraction transfer system" is employed to electrostatically attract the first toner image toward the nip lower side first roller 218 serving as a transfer bias member. In the latter process, which is implemented second, an "electrostatic extrusion transfer system" is employed to electrostatically remove the second toner image from the nip lower side second roller 219 serving as a transfer bias member. By employing this constitution, as described above, toner images can be transcribed onto both sides of the transfer paper P easily at the same transfer nip (the secondary transfer nip) without having to set toners of opposite polarities accurately to their respective individual image forming portions or having to set the respective image forming portions with members which match the corresponding polarity, thereby causing a dramatic deterioration in maintainability.

(16) The endlessly moving first intermediate transfer belt 108 and second intermediate transfer belt 216 are used as the first intermediate transfer body and second intermediate transfer body respectively. Moreover, the front end of the feeding path 42 serving as recording medium supply means and the rear end of the conveyance unit 60 serving as conveyance means are each positioned in the region where the first intermediate transfer belt 108 and second intermediate transfer belt 216 face each other. According to this constitution, the feeding path 42 and conveyance unit 60 are disposed so as to intrude on the double-sided transfer means as shown in the drawing, and hence a compact layout can be realized.

(17) A toner having an average circularity of between 0.90 and 0.99 is prescribed for use as the toner for forming the toner images. As a result, high-quality images exhibiting little toner scattering can be formed at a stable electrostatic transfer ratio, thus suppressing cases of insufficient transfer. Further, toner having a shape factor SF-1 of between 120 and 180 is prescribed for use as the toner for forming the toner images, and hence high-quality images in which insufficient transfer and toner scattering are suppressed can be formed. Further, toner having a shape factor SF-2 of between 120 and 190 is prescribed for use as the toner for forming the toner images, and hence high-quality images in which insufficient transfer and toner scattering are even further suppressed can be formed. MOreover, toner having a value obtained by dividing the volume average particle diameter Dv by the number average particle diameter Dn of between 1.05 and 1.30 is prescribed for use as the toner for forming the toner images, and hence high-quality images developed with a stable developing performance can be formed.

Third Embodiment

Figure 24:
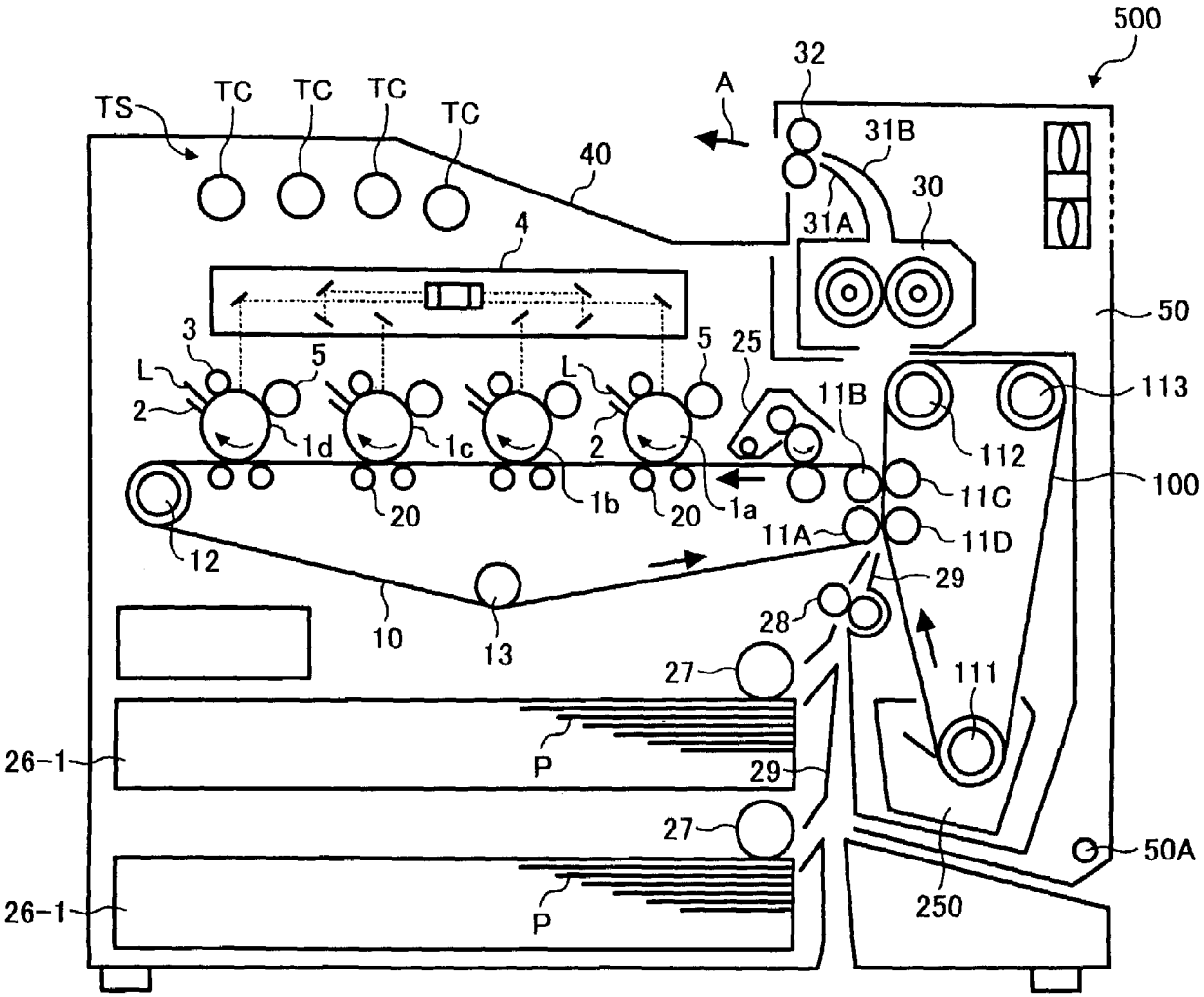
FIG. 24 is a diagram showing the schematic constitution of a printer serving as an image forming apparatus according to a third embodiment of the present invention.

The schematic constitution of a printer serving as an image forming device according to this embodiment, which is capable of forming images on both sides of a sheet of paper serving as a recording medium substantially simultaneously is shown in FIG. 24. As shown in the drawing, in this printer 500 an antistatic device L, a cleaning device 2, a charging device 3, and a developing device 5 are disposed respectively around photosensitive bodies 1 serving as first image carriers which are supported rotatably and rotate in the direction of the arrow. A space for entering optical information emitted from the exposure device 4 is secured between the charging device 3 and developing device 5. The image-forming components provided on the periphery of the respective photosensitive bodies 1*a*, 1*b*, 1*c*, 1*d* are all constituted identically, and only the color material (toner) used in the developing devices 5 differs.

Each photosensitive body 1 is provided with an organic semiconductor layer, which serves as a photoconductive substance, on a cylindrical surface thereof formed from aluminum and having a diameter of approximately 30–100 mm. Apart of the photosensitive body contacts an intermediate transfer belt 10 which serves as a second image carrier. The intermediate transfer belt 10 is supported and stretched by rotating rollers 11A, 11B, 12, 13 so as to be capable of movement in the direction of the arrow, and on the rear side thereof (the inside of the loop), first transfer means 20 are disposed in the vicinity of the photosensitive bodies 1. Second transfer means 11A are disposed so as to contact a second intermediate transfer belt 100, which serves as a third image carrier, via the intermediate transfer belt 10.

The first intermediate transfer belt (second image carrier) 10 has resin as a base substance and a thickness of between 50 and 1500 μm. The belt has a resistance value which allows toner to be transferred from the photosensitive bodies 1, for example a surface resistance (Ω/□) within the range of $10^5$ to $10^{12}$Ω. A two-layer constitution comprising a resin film and a rubber layer may also be employed, for example using a polyimide layer and a urethane rubber layer.

The first transfer means 20 press the first intermediate transfer belt 10 against the photosensitive bodies 1 using a pressing force mechanism not shown in the drawing, thus forming a transfer nip. A cleaning device 25 for the first intermediate transfer belt 10 is disposed on the outside of the belt loop of the first intermediate transfer belt 10. The cleaning device 25 wipes away unnecessary residual toner from the surface of the first intermediate transfer belt 10 following transfer therefrom (secondary transfer).

The exposure device 4 uses a known laser system to irradiate the photosensitive body surfaces, which have been uniformly charged, with optical information serving as latent images and corresponding to the formation of a full color image. An exposure device constituted by an LED array and imaging means may also be employed.

The second intermediate transfer belt (third image carrier) 100 disposed on the right of FIG. 24 is supported and stretched by rotating rollers 111, 112, 113 so as to be capable of movement in the direction of the arrow, and third transfer means 11C are disposed on the rear side thereof (the inside of the loop). A cleaning device 250 for the second intermediate transfer belt 100 is disposed on the outside of the belt loop. The cleaning device 250 wipes away unnecessary residual toner from the surface of the belt following the transfer of toner onto a sheet of paper. The third transfer means 11C, a roller 11D, and the rollers 11A (doubling as the second transfer means), 11B enable the first intermediate transfer belt 10 to contact the second intermediate transfer belt 100, thus forming a predetermined transfer nip.

Figure 25:
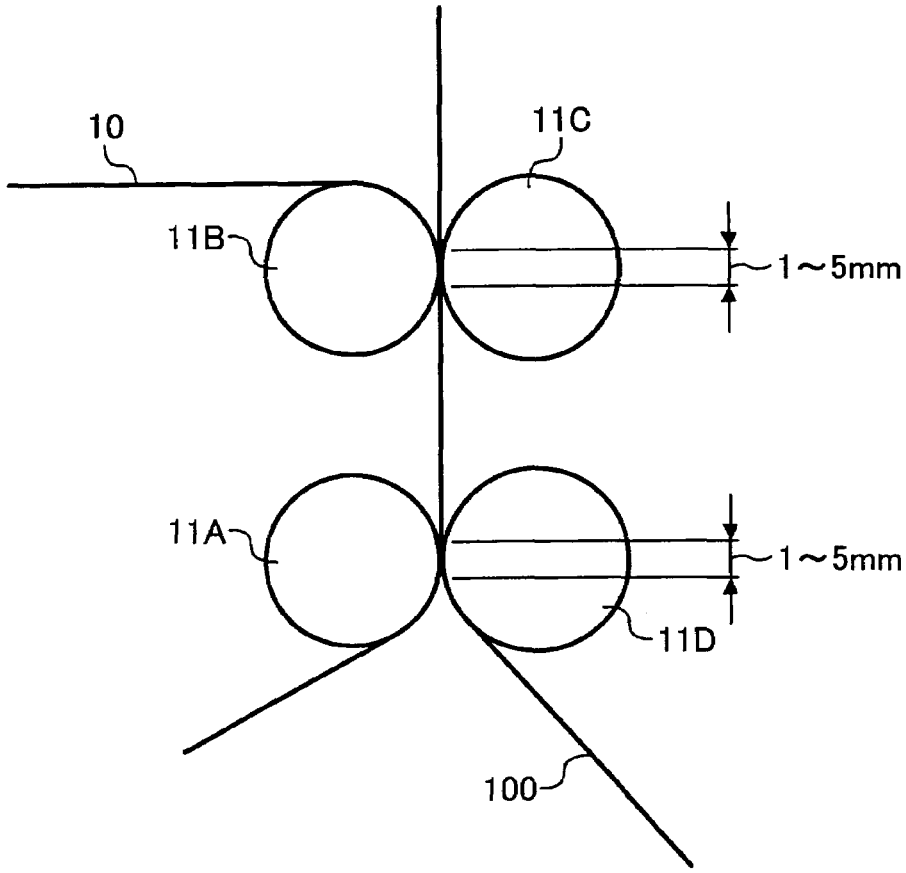
FIG. 25 is a conceptual diagram showing a nip between a first intermediate transfer belt and a second intermediate transfer belt of the printer.
Figure 26:
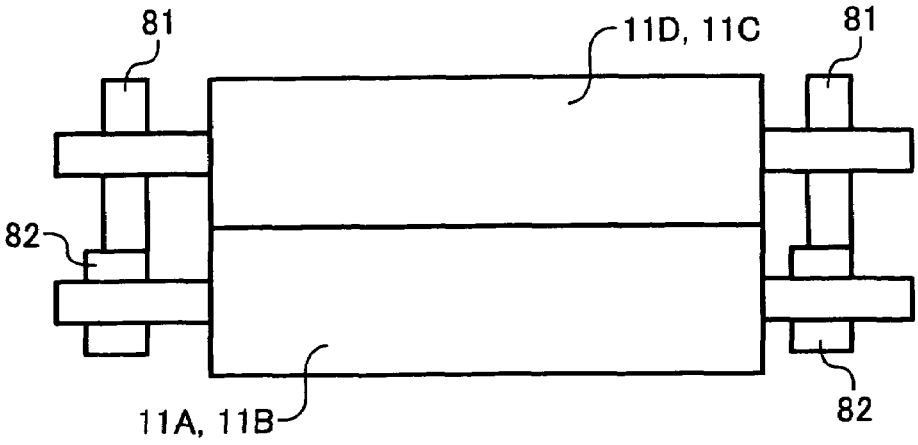
FIG. 26 is a diagram showing a constitution for securing the nip.

The transfer nip for the secondary transfer is formed by having the backup roller 11D which faces the second transfer means 11A press the second intermediate transfer belt 100 against the first intermediate transfer belt 10 using a pressing force mechanism not shown in the drawing. As shown in FIG. 25, the width of the transfer nip is preferably between 1 and 5 mm, and the nip width is secured using a method of abutting a nip width securing member. As shown in FIG. 26, the nip width securing member is constituted by a roller A81 annexed to the second transfer means 11A and a roller B82 annexed to the backup roller 11D. By abutting the rollers A81, B82, an appropriate nip is secured, thereby preventing creases in the paper that occur when the nip width is too great and transfer defects that occur when the nip width is too small. In this embodiment, the resin rollers A81 and B82 are used as the nip width securing member, but the nip width securing member may be constituted by bearings.

Figure 27A:
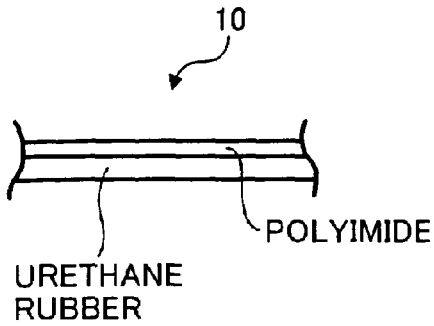
FIGS. 27A and 27B are diagrams showing the sectional constitution of the first intermediate transfer belt and second intermediate transfer belt of the printer.

The second transfer means 11A and the backup roller 11D are conductive rollers. In this embodiment, a conductive rubber roller is used as the second transfer means 11A, and a metallic roller is used as the backup roller 11D. If metallic rollers are used for both of the conductive rollers, the nip is secured by providing the first intermediate transfer belt 10 with a two-layer constitution having rubber as a base substance, as shown in FIG. 27A.

Figure 27B:
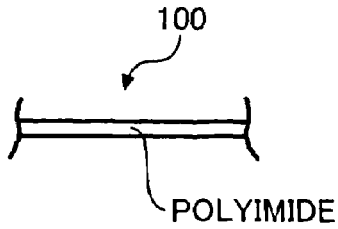

As shown in FIG. 27B, the second intermediate transfer belt 100 is a resin film having a base substance thickness of between 50 and 600 μm. The belt has a resistance value which allows toner to be transferred from the first intermediate transfer belt 10, for example a surface resistance (Ω/□) within the range of $10^5$ to $10^{12}$Ω. The surface roughness is 1μ (Rz), and is formed from polyimide, for example. The third transfer means 11C are constituted identically to the second transfer means 11A.

The paper P is stored in feeding devices (paper cassettes) 26-1, 26-2 in the lower portion of FIG. 24. The paper is conveyed one sheet at a time from the uppermost sheet by a feed roller 27 through a plurality of guides 29 to a pair of resist rollers 28. A fixing heating device 30, a pair of discharge guides 31A, 31B, a pair of discharge rollers 32, and a discharge stacking portion 40 are provided in the upper portion of the drawing.

A storage portion TS for storing refill toner is provided above the first intermediate transfer belt 10 and below the discharge stacking portion 40. Toner is provided in four colors, magenta, cyan, yellow, and black, in the form of cartridges TC. The developing device of the corresponding color is refilled appropriately with toner using a powder pump or the like.

A frame 50, which is a part of the main body, is constituted to be rotatable and openable about an opening/closing spindle 50A, and hence the feeding path for the paper P opens widely, enabling easy processing of paper jams.

Next, an operation for obtaining images on both sides of a sheet of paper will be described.

First, image formation is performed by the photosensitive bodies (first image carriers) 1. By means of an operation of the exposure device 4, light from an LD light source not shown in the drawing passes through an optical component not shown in the drawing to reach the photosensitive body 1*a* of the photosensitive bodies 1, which have been uniformly charged by the charging device 3, and thus a latent image corresponding to the written information (information corresponding to the color) is formed. The latent image on the photosensitive body 1*a* is developed by the developing device 5, whereupon a clear toner image is formed and carried on the surface of the photosensitive body 1*a*. This toner image is transcribed onto the surface of the first intermediate transfer belt 10, which moves in synchronization with the photosensitive body 1*a*, by the first transfer means 20. The surface of the photosensitive body 1*a* is then cleaned of residual toner by the cleaning device 2 and neutralized by the antistatic device L in preparation for the next operating cycle.

The first intermediate transfer belt 10 carries the toner image transcribed onto the surface thereof in the direction of the arrow (anti-clockwise). A latent image corresponding to a different color is written onto the photosensitive body 1*b*, whereupon this latent image is developed by toner of the corresponding color to form a clear image. This image is superposed onto the clear image of the previous color that is being carried on the first intermediate transfer belt 10*, and eventually, four colors are superposed. At this time, the second intermediate transfer belt 100 moves synchronously in the direction of the arrow (clockwise), and by the action of the second transfer means 11A, the image formed on the surface of the first intermediate transfer belt 10 is transcribed onto the surface of the second intermediate transfer belt 100.

Image formation progresses as the second and third image carriers (first intermediate transfer belt and second intermediate transfer belt) move while images are formed on the four photosensitive bodies (first image carriers) in a so-called tandem format, and hence the time required for image formation can be shortened. When the first intermediate transfer belt 10 has moved to a predetermined location, the toner image to be created on the other side of the paper is formed on the photosensitive bodies 1 by the process described above, whereupon paper feeding begins.

When the feed roller 27 rotates in an anti-clockwise direction, the upper most sheet of paper P is extracted from the feeding device (paper cassette) 26 and conveyed to the resist roller pair 28. The paper P is conveyed through the resist roller pair 28 and sandwiched between the first intermediate transfer belt 10 and second intermediate transfer belt 100, where the toner image on the surface of the first intermediate transfer belt 10 is transcribed onto one side of the paper by the second transfer means 11A.

The paper is then conveyed further upward, where the toner image on the surface of the second intermediate transfer belt 100 is transcribed onto the other side of the paper by the third transfer means 11C. During transfer, the paper is conveyed at an appropriate timing such that the image is in the correct position.

Figure 28:
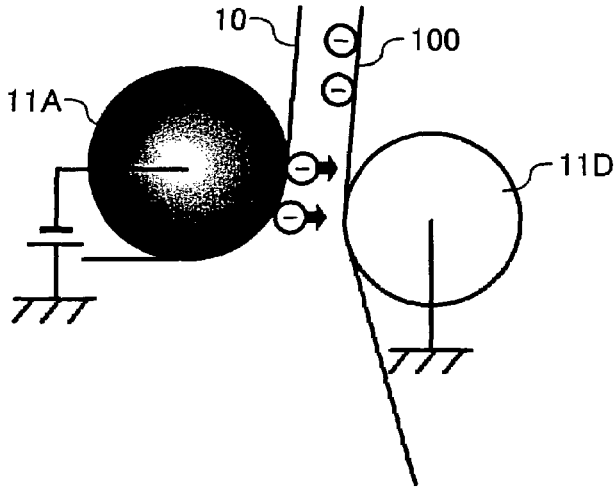
FIG. 28 is a model diagram showing transfer from the first intermediate transfer belt to a sheet of paper.
Figure 29:
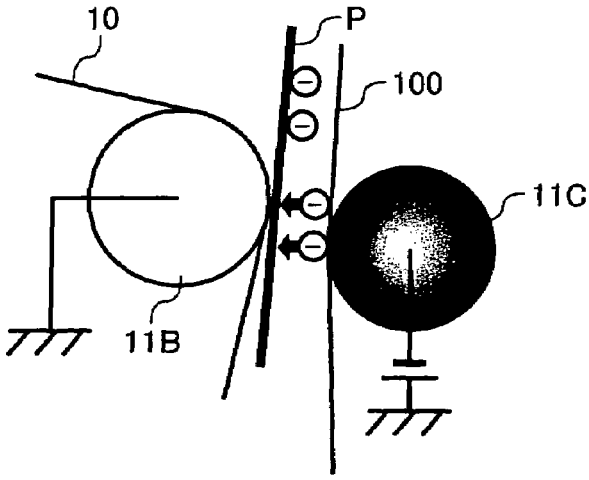
FIG. 29 is a model diagram showing transfer from the second intermediate transfer belt to a sheet of paper.

In this embodiment, the polarity of the toner used to form images on the photosensitive bodies 1 is minus. By applying a plus charge to the first transfer means 20, the toner formed as images on the photosensitive bodies 1 is transcribed onto the first intermediate transfer belt 10. By applying a minus charge to the second transfer means 11A, the toner formed as an image on the first intermediate transfer belt 10 is extruded from the first intermediate transfer belt and transcribed onto the second intermediate transfer belt 100. The toner on the surface of the first intermediate transfer belt is also transcribed onto one side of the paper (see FIG. 28). By applying a charge with a minus polarity from the third transfer means 11C, the minus polarity toner on the surface of the second intermediate transfer belt 100 is repulsed, and thus transcribed onto the other side of the paper (see FIG. 29). This type of transfer system using repulsive force is not affected by the thickness of the paper, and hence high-quality images are obtained regardless of the paper type.

The paper P with toner images transcribed onto both sides in the step described above is conveyed to the fixing heating device 30, where the toner images on (both sides of) the paper are fused and fixed, and then passes through the guide pair 31 to be discharged to the discharge stacking portion 40 on the upper portion of the main body frame by the discharge roller pair 32.

As shown in FIG. 24, when the discharge portion 40 is provided, the paper P is placed on the discharge stacking portion 40 such that the side (page) of the paper having the image that is transcribed latterly of the double-sided image, or in other words the side onto which an image is transcribed directly from the first intermediate transfer belt 10, is the lower side. Hence in order to stack the pages consecutively, the image on the second page is created first such that the corresponding toner image is carried on the second intermediate transfer belt 100, whereas the image on the first page is transcribed directly onto the paper from the first intermediate transfer belt 10.

The image that is transcribed onto the paper from the first intermediate transfer belt 10 is formed as a normal image on the surface of the photosensitive body, whereas the toner image that is transcribed onto the paper from the second intermediate transfer belt 100 is exposed as a reverse image (mirror image) on the surface of the photosensitive body. This image formation procedure for obtaining consecutive pages may be realized using a known technique of storing image data in memory, and the exposure method of switching between normal and reverse (mirror) images may also be realized by a known image processing technique.

Following transfer onto the paper from the second intermediate transfer belt 100, residual unnecessary toner and paper particles are removed from the surface of the second intermediate transfer belt using a cleaning device 250 comprising in its interior a known brush roller, recovery roller, blade, or similar.

Next, an operation performed to obtain an image on one side of a sheet of paper will be described. The method of obtaining one-sided images is twofold, but here, the process of transcribing toner onto the second intermediate transfer belt 100 is omitted, and a case in which toner is transcribed onto the paper from the first intermediate transfer belt 10 will be described.

The toner images formed on the surface of the photosensitive bodies 1 are gradually transcribed onto the first intermediate transfer belt 10, and then onto the paper P. In FIG. 24, the paper P is conveyed between the first intermediate transfer belt 10 and second intermediate transfer belt 100 synchronously so as to be aligned with the toner image formed on the first intermediate transfer belt 10, whereupon the toner is transcribed onto the paper P from the first intermediate transfer belt 10 by the second transfer means 11A.

The third transfer means do not operate, and hence the paper P moves together with the second intermediate transfer belt 100 to be conveyed to a region of the fixing heating device 30, where the toner is fixed. The paper is then removed from the second intermediate transfer belt 100 and discharged in the direction of the arrow A through the guide pair 31A, 31B and the discharge roller pair 32. The paper P is placed on the discharge stacking portion 40 with the image side face down. According to such a constitution, when the paper P is extracted from the discharge stacking portion 40, the pages on which material is printed are stacked in order even when a multi-page document is processed in order from the first page.

An example in which a color image is formed using toner of a plurality of colors was described in this embodiment, but it goes without saying that the same technical concept may be applied to the formation of a monochrome image.

According to the constitution of the embodiment described above, a second image carrier and a third image carrier are pressed together to secure between the second image carrier and third image carrier a nip which is suitable for subjecting paper serving as a recording medium to repulsive force electrostatic transfer simultaneously onto both sides of the paper, and as a result, a high-quality double-sided print can be obtained with no reduction in transfer efficiency and regardless of the paper type.

Various modifications will become possible for those skilled in the art after receiving the teachings of the present disclosure without departing from the scope thereof.

What is claimed is:

1. An image forming apparatus comprising:

an image carrier for carrying a toner image;

visible image forming means for forming a toner image on the surface of said image carrier;

double-sided transfer means for transcribing said toner image from said image carrier onto both sides of a recording medium;

fixing means for fixing said toner image onto both sides of said recording medium after said recording medium passes through said double-sided transfer means; and conveyance means for passing said recording medium received from said double-sided transfer means to said fixing means by conveying said recording medium while carrying said recording medium on a self-propelled conveyance portion, wherein a feed portion of said double-sided transfer means for feeding said recording medium toward said conveyance portion is positioned further upward in the vertical direction than a rear end of said conveyance portion.

2. The image forming apparatus as claimed in claim 1, further comprising feed speed detection means for detecting the feed speed of said recording medium from said double-sided transfer means to said conveyance means, and conveyance speed control means for controlling the conveyance speed of said conveyance portion on the basis of the detection result of said feed speed detection means.

3. The image forming apparatus as claimed in claim 2, wherein said conveyance speed control means are constituted to control said conveyance speed to the same speed as said feed speed.

4. The image forming apparatus as claimed in claim 2, wherein said conveyance portion is driven by a different driving source to the driving source of said double-sided transfer means.

5. The image forming apparatus as claimed in claim 2, wherein means which perform fixing processing by sandwiching said recording medium in a fixing nip, which is formed by contact between two surface motion bodies which perform a surface motion, are used as said fixing means, said image forming apparatus further comprising fixing motion speed control means for controlling a fixing motion speed, which is the surface motion speed of said two surface motion bodies, on the basis of the detection result of said feed speed detection means.

6. The image forming apparatus as claimed in claim 5, wherein said fixing motion speed control means are constituted to control said fixing motion speed to the same speed as said feed speed.

7. The image forming apparatus as claimed in claim 5, wherein said two surface motion bodies are driven by a different driving source to the driving source of said double-sided transfer means.

8. The image forming apparatus as claimed in claim 7, wherein said conveyance portion and said two surface motion bodies are respectively driven by different driving sources to the driving source of said double-sided transfer means.

9. The image forming apparatus as claimed in claim 2, wherein means which feed said recording medium to said conveyance means in accordance with a surface motion of an intermediate transfer body are used as said double-sided transfer means, and means which detect said feed speed of said recording medium indirectly by detecting the driving speed of driving force applying means which apply a driving force to said intermediate transfer body are used as said feed speed detection means.

10. The image forming apparatus as claimed in claim 2, wherein means which feed said recording medium to said conveyance means in accordance with a surface motion of an intermediate transfer body are used as said double-sided transfer means, and means which detect said feed speed of said recording medium indirectly by detecting the surface motion speed of said intermediate transfer body are used as said feed speed detection means.

11. The image forming apparatus as claimed in claim 2, wherein said recording medium is supported and carried on said conveyance portion from the lower side as seen in the direction of gravity.

12. The image forming apparatus as claimed in claim 2, wherein a device which conveys said recording medium while carrying said recording medium on the surface of a conveyor belt that performs an endless motion is used as said conveyance portion.

13. The image forming apparatus as claimed in claim 12, wherein a belt constituted by a heat-resistant material is used as said conveyor belt.

14. The image forming apparatus as claimed in claim 2, wherein means which transcribe a first toner image formed on said image carrier onto a first side of said recording medium via a first intermediate transfer body and a second intermediate transfer body, and transcribe a second toner image formed on said image carrier onto a second side of said recording medium via said first intermediate transfer body are used as said double-sided transfer means.

15. The image forming apparatus as claimed in claim 2, wherein means comprising a first image carrier and a second image carrier as said image carrier, which transcribe a first toner image formed on said first image carrier onto a first side of said recording medium via a first intermediate transfer body, and transcribe a second toner image formed on said second image carrier onto a second side of said recording medium via a second intermediate transfer body are used as said double-sided transfer means.

16. The image forming apparatus as claimed in claim 2, wherein means which, from among a process for transcribing said first toner image onto said first side and a process for transcribing said second toner image onto said second side, perform the process to be implemented first by transcribing the toner image onto said recording medium using a system whereby said toner image is electrostatically attracted toward a transfer bias member, and perform the process to be implemented second by transcribing a toner image onto said recording medium using a system whereby said toner image is electrostatically distanced from said transfer bias member, are used as said double-sided transfer means.

17. The image forming apparatus as claimed in claim 2, wherein a first intermediate transfer belt and a second intermediate transfer belt, each of which performs an endless motion, are used as a first intermediate transfer body and a second intermediate transfer body respectively, and a front end of recording medium supply means, which supply said recording medium to said double-sided transfer means, in the recording medium supply direction and a rear end of said conveyance means in the recording medium conveyance direction are positioned respectively in a region where said first intermediate transfer belt faces said second intermediate transfer belt.

18. The image forming apparatus as claimed in claim 2, comprising toner storage means for storing the toner that is used in the formation of said toner image, said toner storage means storing toner which satisfies conditions that an average circularity is between 0.90 and 0.99, a shape factor SF-1 is between 120 and 180, a shape factor SF-2 is between 120 and 190, and a particle size distribution is between 1.05 and 1.30.

19. The image forming apparatus as claimed in claim 2, wherein toner satisfying the conditions that an average circularity is between 0.90 and 0.99, a shape factor SF-1 is between 120 and 180, a shape factor SF-2 is between 120 and 190, and a particle size distribution is between 1.05 and 1.30, is prescribed for use as the toner used in the formation of said toner image.

20. The image forming apparatus according to claim 1, wherein the conveyance means is passing the recording medium to the fixing means without an additional means pressing the recording medium onto the conveyance means.

21. An image forming method, comprising:

forming a toner image on an image carrier;

transcribing said toner image formed on said image carrier onto both sides of a recording medium using double-sided transfer means;

fixing said toner image onto both sides of said recording medium after said transcribing; and passing said recording medium received from said double-sided transfer means to a fixing means by conveying said recording medium to the fixing means on a self-propelled conveyance portion wherein a feed portion of said double-sided transfer means for feeding said recording medium toward said conveyance portion is positioned further upward in the vertical direction than a rear end of said conveyance portion and at the front side of the conveyance direction.

22. The image forming method according to claim 21, wherein the passing the recording medium to the fixing means is performed without pressing the recording medium onto the conveyance portion.

23. An image forming apparatus comprising:

an image carrier for carrying a toner image;

visible image forming mechanism configured to form a toner image on the surface of said image carrier;

double-sided transfer mechanism configured to transcribe said toner image from said image carrier onto both sides of a recording medium;

fixing mechanism configured to fix said toner image onto both sides of said recording medium after said recording medium passes through said double-sided transfer mechanism;

conveyance mechanism configured to pass said recording medium received from said double-sided transfer mechanism to said fixing mechanism by conveying said recording medium while carrying said recording medium on a self-propelled conveyance portion;

wherein a feed portion of said double-sided transfer mechanism for feeding said recording medium towards said conveyance portion is positioned further upward in the vertical direction than a rear end of said conveyance portion and at the front side of the conveyance direction.

24. The image forming apparatus as claimed in claim 23, further comprising feed speed detection mechanism configured to detect the feed speed of said recording medium from said double-sided transfer mechanism to said conveyance mechanism, and conveyance speed control mechanism for controlling the conveyance speed of said conveyance portion on the basis of the detection result of said feed speed detection mechanism.

25. The image forming apparatus as claimed in claim 24, wherein said conveyance speed control mechanism is constituted to control said conveyance speed to the same speed as said feed speed.

26. The image forming apparatus as claimed in claim 24, wherein said conveyance portion is driven by a different driving source to the driving source of said double-sided transfer mechanism.

27. The image forming apparatus as claimed in claim 24, wherein a mechanism which performs fixing processing by sandwiching said recording medium in a fixing nip, which is formed by contact between two surface motion bodies which perform a surface motion, is used as said fixing mechanism, said image forming apparatus further comprising fixing motion speed control mechanism configured to control a fixing motion speed, which is the surface motion speed of said two surface motion bodies, on the basis of the detection result of said feed speed detection mechanism.

28. The image forming apparatus as claimed in claim 27, wherein said fixing motion speed control mechanism is constituted to control said fixing motion speed to the same speed as said feed speed.

29. The image forming apparatus as claimed in claim 27, wherein said two surface motion bodies are driven by a different driving source to the driving source of said double-sided transfer mechanism.

30. The image forming apparatus as claimed in claim 29, wherein said conveyance portion and said two surface motion bodies are respectively driven by different driving sources to the driving source of said double-sided transfer mechanism.

31. The image forming apparatus as claimed in claim 24, wherein a mechanism which feeds said recording medium to said conveyance mechanism in accordance with a surface motion of an intermediate transfer body is used as said double-sided transfer mechanism, and a mechanism which detects said feed speed of said recording medium indirectly by detecting the driving speed of driving force applying mechanism which applies a driving force to said intermediate transfer body is used as said feed speed detection mechanism.

32. The image forming apparatus as claimed in claim 24, wherein a mechanism which feeds said recording medium to said conveyance mechanism in accordance with a surface motion of an intermediate transfer body is used as said double-sided transfer mechanism, and a mechanism which detects said feed speed of said recording medium indirectly by detecting the surface motion speed of said intermediate transfer body is used as said feed speed detection mechanism.

33. The image forming apparatus as claimed in claim 24, wherein said recording medium is supported and carried on said conveyance portion from the lower side as seen in the direction of gravity.

34. The image forming apparatus as claimed in claim 24, wherein a device which conveys said recording medium while carrying said recording medium on the surface of a conveyor belt that performs an endless motion is used as said conveyance portion.

35. The image forming apparatus as claimed in claim 34, wherein a belt constituted by a heat-resistant material is used as said conveyor belt.

36. The image forming apparatus as claimed in claim 24, wherein a mechanism which transcribes a first toner image formed on said image carrier onto a first side of said recording medium via a first intermediate transfer body and a second intermediate transfer body, and transcribes a second toner image formed on said image carrier onto a second side of said recording medium via said first intermediate transfer body is used as said double-sided transfer mechanism.

37. The image forming apparatus as claimed in claim 24, wherein a mechanism comprising a first image carrier and a second image carrier as said image carrier, which transcribes a first toner image formed on said first image carrier onto a first side of said recording medium via a first intermediate transfer body, and transcribes a second toner image formed on said second image carrier onto a second side of said recording medium via a second intermediate transfer body is used as said double-sided transfer mechanism.

38. The image forming apparatus as claimed in claim 24, wherein a mechanism which, from among a process for transcribing said first toner image onto said first side and a process for transcribing said second toner image onto said second side, performs the process to be implemented first by transcribing the toner image onto said recording medium using a system whereby said toner image is electrostatically attracted toward a transfer bias member, and perform the process to be implemented second by transcribing a toner image onto said recording medium using a system whereby said toner image is electrostatically distanced from said transfer bias member, is used as said double-sided transfer mechanism.

39. The image forming apparatus as claimed in claim 24, wherein a first intermediate transfer belt and a second intermediate transfer belt, each of which performs an endless motion, are used as a first intermediate transfer body and a second intermediate transfer body respectively, and a front end of recording medium supply mechanism, which supplies said recording medium to said double-sided transfer mechanism, in the recording medium supply direction and a rear end of said conveyance mechanism in the recording medium conveyance direction are positioned respectively in a region where said first intermediate transfer belt faces said second intermediate transfer belt.

40. The image forming apparatus as claimed in claim 24, comprising a toner storage mechanism configured to store the toner that is used in the formation of said toner image, said toner storage mechanism stores toner which satisfies conditions that an average circularity is between 0.90 and 0.99, a shape factor SF-1 is between 120 and 180, a shape factor SF-2 is between 120 and 190, and a particle size distribution is between 1.05 and 1.30.

41. The image forming apparatus as claimed in claim 24, wherein toner satisfying the conditions that an average circularity is between 0.90 and 0.99, a shape factor SF-1 is between 120 and 180, a shape factor SF-2 is between 120 and 190, and a particle size distribution is between 1.05 and 1.30, is prescribed for use as the toner used in the formation of said toner image.

* * * * *